US008439450B2

(12) United States Patent
Harrison et al.

(10) Patent No.: US 8,439,450 B2
(45) Date of Patent: May 14, 2013

(54) TUNNELING APPARATUS INCLUDING VACUUM AND METHOD OF USE

(75) Inventors: Stuart Harrison, Clyde (AU); Andis Normunds Salins, Footscray (AU); Matthew Arlen Mills, Pella, IA (US); Melvin Nguyen, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 349 days.

(21) Appl. No.: 12/704,295

(22) Filed: Feb. 11, 2010

(65) Prior Publication Data

US 2010/0206635 A1 Aug. 19, 2010

Related U.S. Application Data

(60) Provisional application No. 61/246,616, filed on Sep. 29, 2009, provisional application No. 61/151,727, filed on Feb. 11, 2009.

(51) Int. Cl.
*E21D 9/13* (2006.01)

(52) U.S. Cl.
USPC ..... 299/1.8; 299/1.9; 175/213

(58) Field of Classification Search ..... 175/213; 299/1.3, 1.8, 1.9
See application file for complete search history.

(56) References Cited

U.S. PATENT DOCUMENTS

| | | | |
|---|---|---|---|
| 134,506 | A | 1/1873 | Ball |
| 825,857 | A | 7/1906 | Moran et al. |
| 858,525 | A | 7/1907 | Mettler |
| 1,026,412 | A | 5/1912 | Stone |
| 1,772,491 | A | 8/1930 | Koppl |
| 2,317,729 | A | 4/1943 | Bruno |
| 2,494,803 | A | 1/1950 | Frost et al. |
| 2,745,650 | A | 5/1956 | Smith |
| 2,786,652 | A | 3/1957 | Wells |
| 2,850,264 | A | 9/1958 | Grable |
| 3,145,789 | A | 8/1964 | Lawry |

(Continued)

FOREIGN PATENT DOCUMENTS

| | | |
|---|---|---|
| AU | B-80723/87 | 4/1988 |
| AU | A-12360/88 | 9/1988 |

(Continued)

OTHER PUBLICATIONS

International Search Report and Written Opinion mailed Sep. 30, 2010.

(Continued)

*Primary Examiner* — John Kreck
(74) *Attorney, Agent, or Firm* — Merchant & Gould P.C.

(57) ABSTRACT

The present disclosure relates to a tunneling apparatus including a pipe string having a distal end and a proximal end. The pipe string includes a plurality of pipe-sections connected end-to end. The pipe string also includes a cutting head coupled to a distal-most one of the pipe-sections. The pipe string defines a vacuum passage that extends through the pipe string from the proximal end to the distal end of the pipe string. A source of vacuum is in fluid communication with the vacuum passage for drawing cuttings through the vacuum passage. A blockage sensor can be used for sensing whether a precursor blockage condition exists within the vacuum passage. A source of air pressure can be used to force air distally through the pipe string to assist in moving cuttings proximally through the vacuum passage.

11 Claims, 55 Drawing Sheets

U.S. PATENT DOCUMENTS 3,208,539 A 9/1965 Henderson
3,297,100 A 1/1967 Crews
3,321,248 A 5/1967 Williamson et al.
3,354,950 A 11/1967 Hyde
3,419,092 A 12/1968 Elenburg
3,459,442 A 8/1969 Yarmett et al.
3,482,103 A 12/1969 Martinsen
3,498,673 A 3/1970 Ledray et al.
3,508,622 A 4/1970 Benetti et al.
3,554,301 A 1/1971 Adkins et al.
3,635,108 A 1/1972 Prince
3,707,330 A 12/1972 Pine
3,778,107 A 12/1973 Haspert
3,799,615 A 3/1974 Taylor et al.
3,821,993 A 7/1974 Kniff et al.
3,837,413 A 9/1974 Dunn
3,857,449 A 12/1974 Kimura
3,938,597 A 2/1976 Richmond et al.
3,939,926 A 2/1976 Barnes et al.
4,013,134 A 3/1977 Richmond et al.
4,023,861 A 5/1977 Schnell
4,026,371 A 5/1977 Takada et al.
4,027,210 A 5/1977 Weber
4,059,163 A 11/1977 Stedman
4,076,084 A 2/1978 Tighe
4,099,585 A 7/1978 Emmerich
4,122,683 A 10/1978 Follert et al.
4,149,739 A 4/1979 Morris
4,186,808 A 2/1980 Cox
4,221,503 A 9/1980 Cherrington
4,273,468 A 6/1981 Cyfka
4,281,723 A 8/1981 Edmond et al.
4,311,344 A 1/1982 Akesaka
4,378,057 A 3/1983 O'connell
4,392,744 A 7/1983 Tatsuhama et al.
4,394,881 A 7/1983 Shirley
4,403,664 A 9/1983 Sullinger
4,406,336 A 9/1983 Olsen et al.
4,406,498 A 9/1983 Akesaka
4,494,617 A 1/1985 Snyder
4,506,745 A 3/1985 Bjor
4,553,612 A 11/1985 Durham
4,556,256 A 12/1985 Follert et al.
4,576,515 A 3/1986 Morimoto et al.
4,624,605 A 11/1986 Akesaka
4,630,869 A 12/1986 Akesaka et al.
4,655,493 A 4/1987 Sumi
4,683,944 A 8/1987 Curlett
4,692,062 A 9/1987 Akesaka
4,698,491 A 10/1987 Lysen
4,705,120 A 11/1987 Ebeling et al.
4,784,230 A 11/1988 Cherrington et al.
4,790,395 A 12/1988 Gack et al.
4,828,050 A 5/1989 Hashimoto
4,834,193 A 5/1989 Leitko, Jr. et al.
4,836,305 A 6/1989 Curlett
4,868,648 A 9/1989 Nobunaga
4,875,292 A 10/1989 Gibson
4,886,394 A 12/1989 Akesaka
4,961,469 A 10/1990 Larsson et al.
5,046,903 A 9/1991 Nagayoshi et al.
5,076,729 A 12/1991 Grotenhofer
5,078,545 A 1/1992 Akesaka
5,099,927 A 3/1992 Gibson et al.
5,101,912 A 4/1992 Smet
5,102,201 A 4/1992 Akesaka
5,123,708 A 6/1992 Akesaka
5,133,418 A 7/1992 Gibson et al.
5,156,490 A 10/1992 Terasawa
5,163,520 A 11/1992 Gibson et al.
5,236,284 A 8/1993 Ilomaki
5,265,682 A 11/1993 Russell et al.
5,296,915 A 3/1994 Akesaka
5,316,092 A 5/1994 Ilomäki
5,361,854 A 11/1994 Tull et al.
5,366,031 A 11/1994 Rickards
5,393,172 A 2/1995 Akesaka
5,423,575 A 6/1995 Parks
5,425,429 A 6/1995 Thompson
5,437,500 A 8/1995 Lehmann et al.
5,465,797 A 11/1995 Wentworth et al.
5,470,132 A 11/1995 Cartwright
5,484,232 A 1/1996 Hayashi et al.
5,485,889 A 1/1996 Gray
5,501,548 A 3/1996 Hayashi et al.
5,527,135 A 6/1996 Hayashi et al.
5,529,437 A 6/1996 Filipowski et al.
5,632,575 A 5/1997 Lorenzen et al.
5,682,953 A 11/1997 Buysse
5,682,956 A 11/1997 Deken et al.
5,687,807 A 11/1997 Woods et al.
5,846,027 A 12/1998 Fujii
5,860,232 A 1/1999 Nathenson et al.
5,887,667 A 3/1999 Van Zante et al.
5,890,771 A 4/1999 Cass
5,931,240 A 8/1999 Cox
5,938,288 A 8/1999 Saint-Pierre et al.
6,017,095 A 1/2000 DiMillo
6,050,350 A 4/2000 Morris et al.
6,148,935 A 11/2000 Wentworth et al.
6,158,529 A 12/2000 Dorel
6,216,800 B1 * 4/2001 Wilson et al. ..... 175/27
6,332,652 B1 12/2001 Nakakuro
6,342,946 B1 1/2002 Holstein
6,367,412 B1 4/2002 Ramaswamy et al.
6,390,087 B1 5/2002 Wentworth et al.
6,454,025 B1 9/2002 Runquist et al.
6,470,605 B1 10/2002 Gilman et al.
6,527,054 B1 3/2003 Fincher et al.
6,533,052 B2 3/2003 Wentworth et al.
6,585,062 B2 7/2003 Rozendaal et al.
6,588,515 B2 7/2003 Wentworth et al.
6,637,522 B2 * 10/2003 Wilson et al. ..... 175/25
6,659,202 B2 12/2003 Runquist et al.
6,668,946 B2 12/2003 Rankin et al.
RE38,418 E 2/2004 Deken et al.
6,712,556 B2 3/2004 Penza
7,055,627 B2 6/2006 Fontana et al.
7,070,359 B2 7/2006 Richardson et al.
7,093,671 B2 8/2006 Puttmann
7,111,695 B2 9/2006 Puttmann
7,152,702 B1 12/2006 Bhome et al.
7,216,724 B2 5/2007 Self et al.
7,243,737 B2 7/2007 Michael
7,367,412 B2 5/2008 Barbera et al.
7,389,831 B2 6/2008 Mullins et al.
7,845,432 B2 12/2010 Salins et al.
2004/0060740 A1 4/2004 Puttmann
2004/0074672 A1 4/2004 Rives
2004/0108139 A1 6/2004 Davies
2005/0103527 A1 5/2005 Church et al.
2005/0257959 A1 11/2005 Richardson et al.
2006/0060384 A1 3/2006 Michael
2006/0279078 A1 12/2006 Johnson et al.
2007/0089906 A1 4/2007 Davies
2007/0143773 A1 6/2007 Park et al.
2008/0099248 A1 5/2008 Davies
2009/0152010 A1 6/2009 Salins et al.
2009/0152012 A1 6/2009 Salins et al.
2009/0301783 A1 12/2009 Salins et al.
2010/0206636 A1 8/2010 Harrison et al.
2010/0206637 A1 8/2010 Harrison et al.
2010/0230171 A1 9/2010 Harrison et al.

FOREIGN PATENT DOCUMENTS

DE 32 03 924 A1 8/1983
DE 40 18 842 C1 7/1991
DE 101 32 972 C1 10/2002
EP 1 316 670 B1 6/2003
JP 53-126713 11/1978
JP 61-40988 2/1986
JP 63-190394 12/1988
JP 2-16287 1/1990
JP 3-33393 2/1991
JP 3-47396 2/1991
JP 4-83083 3/1992
JP 4-353189 12/1992

| | | | |
|---|---|---|---|
| JP | 5-202688 | | 8/1993 |
| JP | 6-40094 | | 5/1994 |
| JP | 7-293191 | | 11/1995 |
| JP | 2000-328876 | | 11/2000 |
| JP | 2004-19302 | | 1/2004 |
| JP | 2005-213848 | | 8/2005 |
| SU | 1579976 | A1 | 7/1990 |
| WO | WO 88/02435 | | 4/1988 |
| WO | WO 94/20726 | | 9/1994 |
| WO | WO 02/40819 | A2 | 5/2002 |
| WO | WO 02/44508 | A2 | 6/2002 |
| WO | WO 02/44511 | A1 | 6/2002 |
| WO | WO 02/057590 | A2 | 7/2002 |
| WO | WO 02/064939 | A1 | 8/2002 |
| WO | WO 2006/119797 | A1 | 11/2006 |
| WO | WO 2007/124789 | A1 | 11/2007 |
| WO | WO2007-143773 | * | 12/2007 |
| WO | WO 2007/143773 | A1 | 12/2007 |

OTHER PUBLICATIONS

"Auger Boring Tools & Accessories," *Catalog 501-4*, McLaughlin Boring Systems, pp. 1-10 (Date Unknown).
"Conventional Tunneling Boring Machine (TBM)" Product information. Akkerman Inc. Downloaded Jun. 2, 2009. (http://www.akkerman.com/products-conventional-tbm.php).
"Earth Pressure Balance Machines (EPBM)" Product information. Akkerman Inc. Downloaded Jun. 2, 2009. (http://www.akkerman.com/products-epb.php).
"EPB Machine Part No. A10500F" Product information sheet. Akkerman Inc. www.akkerman.com.
"Guided Boring Machine" Technical Manual. Akkerman Inc. Downloaded Jun. 2, 2009. (http://www.akkerman.com/products-products-manuals.php).
"Guided Boring Machines (GBM)" Product information. Akkerman Inc. Downloaded Jun. 2, 2009. (http://www.akkerman.com/products-gbm.php).
"McLaughlin Announces the McL54/60 Auger Boring Machine," http://www.mightymole.com/, McLaughlin Boring Systems, 2 pages (Copyright 2008).
"Microtunneling" Product information. Akkerman Inc. Downloaded Jun. 2, 2009. (http://www.akkerman.com/products-microtunneling.php).
"Thrust Frame—4812A" Product information sheet. Akkerman Inc. www.akkerman.com.
"Thrust Frame—Latching—308A" Product information sheet. Akkerman Inc. www.akkerman.com.
"Upsizing Tool—Powered Cutter Head" Product information sheet. Akkerman Inc. www.akkerman.com.
Klein et al. "New Developments in Microtunneling." Paper presented at 36$^{th}$ Engineering Geology and Geotechnical Engineering Symposium, University of Nevada, Las Vegas. Mar. 28-30, 2001.
Nagashima et al. "'Trunk Mole': Long Distance Micro-Tunneling Method for Gas Transmission Pipelines." 1995 International Gas Research Conference, Pipeline Engineering and Development Center, Tokyo Gas Co., Ltd.
Vermeer HDD Tooling & Accessories catalog, vol. 6, 2005.

* cited by examiner

TUNNELING APPARATUS INCLUDING VACUUM AND METHOD OF USE

CROSS REFERENCE TO RELATED APPLICATIONS

This application claims the benefit of U.S. Provisional Patent Application Ser. No. 61/246,616, filed Sep. 29, 2009 and claims the benefit of U.S. Provisional Patent Application Ser. No. 61/151,727, filed Feb. 11, 2009, which applications are hereby incorporated by reference in their entireties.

TECHNICAL FIELD

The present disclosure relates generally to trenchless drilling equipment. More particularly, the present disclosure relates to tunneling (e.g., drilling, backreaming, etc.) equipment capable of maintaining a precise grade and line.

BACKGROUND

Modern installation techniques provide for the underground installation of services required for community infrastructure. Sewage, water, electricity, gas and telecommunication services are increasingly being placed underground for improved safety and to create more visually pleasing surroundings that are not cluttered with visible services.

One method for installing underground services involves excavating an open trench. However, this process is time consuming and is not practical in areas supporting existing construction. Other methods for installing underground services involve boring a horizontal underground hole. However, most underground drilling operations are relatively inaccurate and unsuitable for applications on grade and on line.

PCT International Publication No. WO 2007/143773 discloses a micro-tunneling system and apparatus capable of boring and reaming an underground micro-tunnel at precise grade and line. While this system represents a significant advance over most prior art systems, further enhancements can be utilized to achieve even better performance.

SUMMARY

One aspect of the present disclosure relates to a tunneling (e.g., drilling, backreaming, etc.) apparatus having a drill head including a main body and a steering member that is moveable relative to the main body. The tunneling apparatus also includes a position indicator that moves in response to relative movement between the main body of the drill head and the steering member of the drill head. In certain embodiments, the position indicator can be located within the field of view of a camera mounted at the drill head. In certain embodiments, the tunneling apparatus can include a laser for use in steering the tunneling apparatus, and the drill head can include a laser target that is within the field of view of the camera.

Another aspect of the present disclosure relates to a tunneling apparatus including a steerable drill head. The drill head includes a main body and a steering shell positioned around the main body. The drill head also includes a plurality of radial pistons used to steer the tunneling apparatus by generating relative radial movement between the steering shell and the main body of the drill head. The radial pistons preferably contact the shell at flattened regions that allow the steering shell and the ends of the radial pistons to slide more freely or easily relative to one another in response to extension and/or retraction of selected ones of the radial pistons.

Another aspect of the present disclosure relates to a tunneling apparatus having a drill head including a main body rotatably supporting a drive stem. The main body of the drill head includes a distal end positioned opposite from a proximal end. The drill head includes a bearing arrangement for transferring radial and axial loads between the drive stem and the main body of the drill head. The bearing arrangement is preferably configured to occupy a relatively small amount of space adjacent the distal end of the main body. This allows other structures, such as a vacuum passage, to be relatively large in size adjacent the distal end of the drill head.

A further aspect of the present disclosure relates to a tunneling apparatus including a drill head having a proximal end and a distal end. A cutting unit is located at the distal end of the drill head. The cutting unit includes a main body including a hub and a plurality of arms that project outwardly from the hub. The arms include cutter mounts positioned at radially outermost portions of the arms. Cutting bits can be removably attached to the cutter mounts. When the cutter bits are attached to the cutter mounts, the cutting unit cuts a bore having a first diameter larger than an outer diameter of a steering shell of the drilling/tunneling unit. When the bits are removed from the cutter mounts, the cutting unit cuts a bore having a second diameter smaller than the first diameter. In one embodiment, the second diameter is equal to or smaller than the outer diameter of the steering shell.

Still another aspect of the present disclosure relates to a tunneling apparatus having a drill head with a distal end and a proximal end. A drive stem is rotatably mounted within a main body of the drill head. A cutting unit is mounted to the drive stem at the distal end of the drill head. The cutting unit is attached to the drive stem by a connection that allows the cutting unit to be rotated in a clockwise direction and also allows the cutting unit to be rotated in a counter clockwise direction. Thus, during use of the tunneling apparatus, the cutting unit can be rotated either clockwise or counter clockwise depending upon the characteristics of the geological material through which the cutting unit is drilling the bore. The drill head can also include a bi-directional pump powered by the drive stem. Hydraulic fluid from the pump can be used to control operation of a steering arrangement of the drill head. The bi-directional pump generates fluid pressure for use by the steering arrangement when the drive stem is rotated in a clockwise direction, and also generates fluid pressure for use by the steering arrangement when the drive stem is rotated in a counter clockwise direction.

A further aspect of the disclosure relates to systems and methods for preventing vacuum channel plugging in a drilling apparatus. In certain embodiments, the systems/methods use sensors such as vacuum pressure sensors or air flow sensors.

A further aspect of the disclosure relates to a tunneling apparatus including a drill head having a drill head main body. The drill head also includes a drive stem rotatably mounted in the drill head main body. The drive stem defines a longitudinal axis, and the drill head main body includes a front end defining a vacuum entrance opening. The drill head further includes a cutting unit that mounts to the drive stem and is rotated about the longitudinal axis of the drive stem by the drive stem. The cutting unit has a cutting unit main body including a hub and a plurality of arms that project outwardly from the hub. The cutting unit main body includes a front cutting side and a back side. The back side of the cutting unit main body is configured to direct slurry flow at least partially in a rearward direction toward the vacuum entrance opening.

Still another aspect of the present disclosure relates to a backreamer including a distal end configured for connection to product and a proximal end configured for attachment to a distal end of a drill string. The backreamer includes a backreaming cutter, a proximal assembly that extends between the proximal end of the backreamer and the backreaming cutter, and a drive stem for transferring torque to the backreaming cutter for rotating the backreaming cutter. The drive stem is rotatably supported within the proximal assembly such that the drive stem and the backreaming cutter are rotatable relative to the proximal assembly. The proximal assembly also defines a vacuum passage for removing material cut by the backreaming cutter. The back reamer further includes a distal assembly that extends between the backreaming cutter and the distal end of the backreamer. The distal assembly includes a vacuum blocking plate positioned distally with respect to the backreaming cutter. The backreaming cutter and the drive stem are rotatable relative to the vacuum blocking plate.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

DETAILED DESCRIPTION

A. Overview of Example Drilling Apparatus

Figure 1:
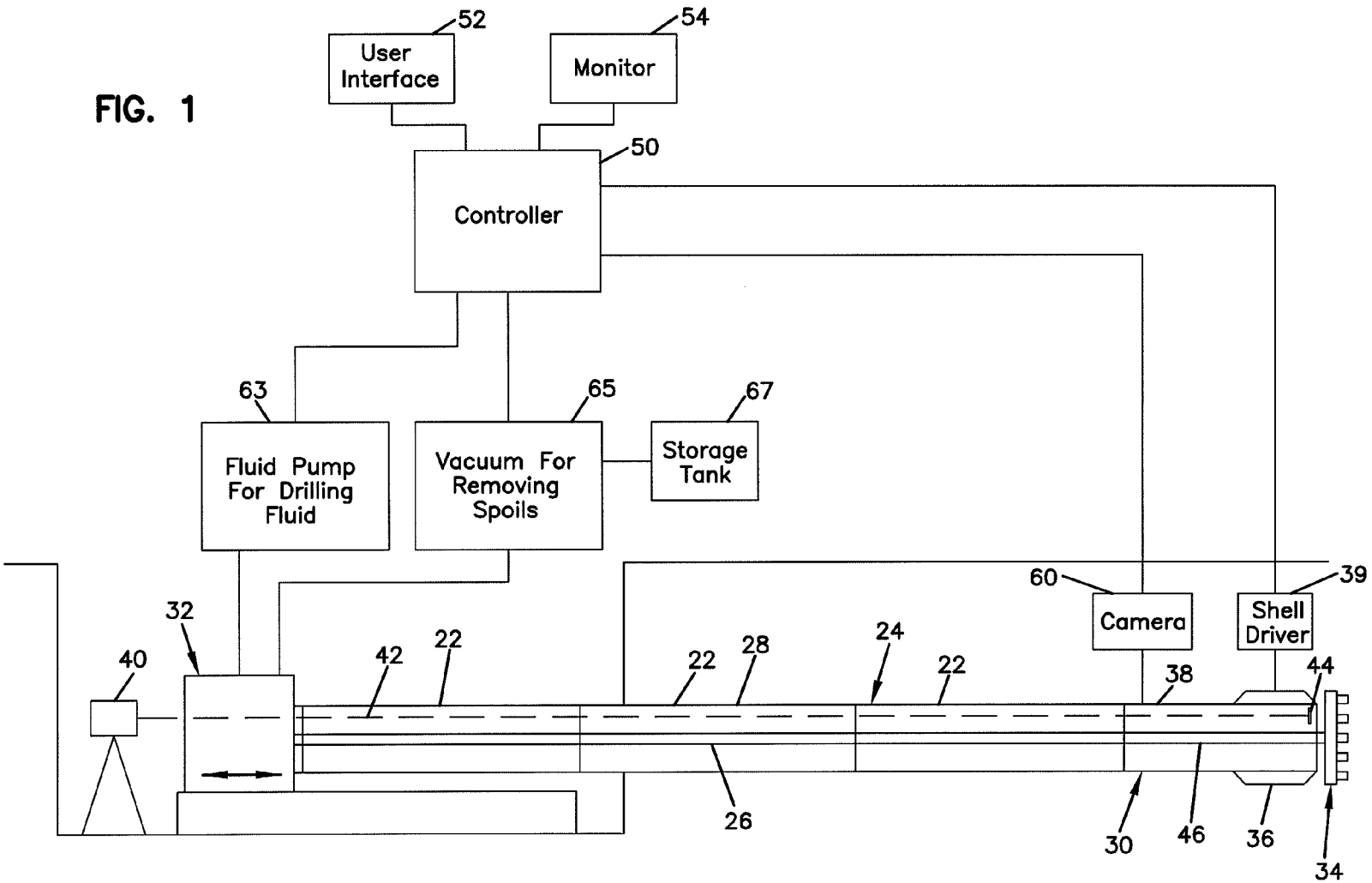
FIG. 1 is a schematic depiction of a tunneling apparatus having features in accordance with the principles of the present disclosure.

FIG. 1 shows a tunneling apparatus 20 having features in accordance with the principles of the present disclosure. Generally, the apparatus 20 includes a plurality of pipe sections 22 that are coupled together in an end-to-end relationship to form a drill string 24. Each of the pipe sections 22 includes a drive shaft 26 rotatably mounted in an outer casing assembly 28. A drill head 30 is mounted at a distal end of the drill string 24 while a drive unit 32 is located at a proximal end of the drill string 24. The drive unit 32 includes a torque driver adapted to apply torque to the drill string 24 and an axial driver for applying thrust or pull-back force to the drill string 24. Thrust or pull-back force from the drive unit 32 is transferred between the proximal end to the distal end of the drill string 24 by the outer casing assemblies 28 of the pipe sections 22. Torque is transferred from the proximal end of the drill string 24 to the distal end of the drill string 24 by the drive shafts 26 of the pipe sections 22 which rotate relative to the casing assemblies 28. The torque from the drive unit 32 is transferred through the apparatus 20 by the drive shafts 26 and ultimately is used to rotate a cutting unit 34 of the drill head 30.

The pipe sections 22 can also be referred to as drill rods, drill stems or drill members. The pipe sections are typically used to form an underground bore, and then are removed from the underground bore when product (e.g., piping) is installed in the bore.

The drill head 30 of the drilling apparatus 20 can include a drive stem 46 rotatably mounted within a main body 38 of the drill head 30. The main body 38 can include a one piece body, or can include multiple pieces or modules coupled together. A distal end of the drive stem 46 is configured to transfer torque to the cutting unit 34. A proximal end of the drive stem 46 couples to the drive shaft 26 of the distal-most pipe section 22 such that torque is transferred from the drive shafts 26 to the drive stem 46. In this way, the drive stem 46 functions as the last leg for transferring torque from the drive unit 32 to the cutting unit 34. The outer casing assemblies 28 transfer thrust and/or pull back force to the main body 38 of the drill head. The drill head 30 preferably includes bearings (e.g., axial/thrust bearings and radial bearings) that allow the drive stem 46 to rotate relative to the main body 38 and also allow thrust or pull-back force to be transferred from the main body 38 through the drive stem 46 to the cutting unit 34.

In certain embodiments, the tunneling apparatus 20 is used to form underground bores at precise grades. For example, the tunneling apparatus 20 can be used in the installation of underground pipe installed at a precise grade. In some embodiments, the tunneling apparatus 20 can be used to install underground pipe or other product having an outer diameter less than 600 mm or less than 300 mm.

It is preferred for the tunneling apparatus 20 to include a steering arrangement adapted for maintaining the bore being drilled by the tunneling apparatus 20 at a precise grade and line. For example, referring to FIG. 1, the drill head 30 includes a steering shell 36 mounted over the main body 38 of the drill head 30. Steering of the tunneling apparatus 20 is accomplished by generating radial movement between the steering shell 36 and the main body 38 (e.g., with radially oriented pistons, one or more bladders, mechanical linkages, screw drives, etc.). Radial steering forces for steering the drill head 30 are transferred between the shell 36 and the main body 38. From the main body 38, the radial steering forces are transferred through the drive stem 46 to the cutting unit 34.

Steering of the tunneling apparatus 20 is preferably conducted in combination with a guidance system used to ensure the drill string 24 proceeds along a precise grade and line. For example, as shown at FIG. 1, the guidance system includes a laser 40 that directs a laser beam 42 through a continuous axially extending air passage (e.g., passage 43 shown at FIG. 13) defined by the outer casing assemblies 28 of the pipe sections 22 to a target 44 located adjacent the drill head 30. The air passage extends from the proximal end to the distal end of the drill string 24 and allows air to be provided to the cutting unit 34.

The tunneling apparatus 20 also includes an electronic controller 50 (e.g., a computer or other processing device) linked to a user interface 52 and a monitor 54. The user interface 52 can include a keyboard, joystick, mouse or other interface device. The controller 50 can also interface with a camera 60 such as a video camera that is used as part of the steering system. For example, the camera 60 can generate images of the location where the laser hits the target 44. It will be appreciated that the camera 60 can be mounted within the drill head 30 or can be mounted outside the tunneling apparatus 20 (e.g., adjacent the laser). If the camera 60 is mounted at the drill head 30, data cable can be run from the camera through a passage that runs from the distal end to the proximal end of the drill string 24 and is defined by the outer casing assemblies 28 of the pipe sections 22. In still other embodiments, the tunneling apparatus 20 may include wireless technology that allows the controller to remotely communicate with the down-hole camera 60.

During steering of the tunneling apparatus 20, the operator can view the camera-generated image showing the location of the laser beam 42 on the target 44 via the monitor 54. Based on where the laser beam 42 hits the target 44, the operator can determine which direction to steer the apparatus to maintain a desired line and grade established by the laser beam 42. The operator steers the drill string 24 by using the user interface to cause a shell driver 39 to modify the relative radial position of the steering shell 36 and the main body 38 of the drill head 30. In one embodiment, a radial steering force/load is applied to the steering shell 36 in the radial direction opposite to the radial direction in which it is desired to turn the drill string. For example, if it is desired to steer the drill string 24 upwardly, a downward force can be applied to the steering shell 36 which forces the main body 38 and the cutting unit 34 upwardly causing the drill string to turn upwardly as the drill string 24 is thrust axially in a forward/distal direction. Similarly, if it is desired to steer downwardly, an upward force can be applied to the steering shell 36 which forces the main body 38 and the cutting unit 34 downwardly causing the drill string 24 to be steered downwardly as the drill string 24 is thrust axially in a forward/distal direction.

In certain embodiments, the radial steering forces can be applied to the steering shell 36 by a plurality of radial pistons that are selectively radially extended and radially retracted relative to a center longitudinal axis of the drill string through operation of a hydraulic pump and/or valving (e.g., see pump 700 at FIGS. 25-28). The hydraulic pump and/or valving are controlled by the controller 50 based on input from the user interface. In one embodiment, the hydraulic pump and/or the valving are located outside the hole being bored and hydraulic fluid lines are routed from pump/valving to the radial pistons via a passage that runs from the distal end to the proximal end of the drill string 24 and is defined within the outer casing assemblies 28 of the pipe sections 22. In other embodiments, the hydraulic pump and/or valving can be located within the drill head 30 and control lines can be routed from the controller 50 to the hydraulic pump and/or valving through a passage that runs from the distal end to the proximal end of the drill string 24 and is defined within the outer casing assemblies 28 of the pipe sections 22. In still other embodiments, the tunneling apparatus 20 may include wireless technology that allows the controller to remotely control the hydraulic pump and/or valving within the drill head 30.

To assist in drilling, the tunneling apparatus 20 can also include a fluid pump 63 for forcing drilling fluid from the proximal end to the distal end of the drill string 24. In certain embodiments, the drilling fluid can be pumped through a central passage (e.g., passage 45 shown at FIG. 13) defined through the drive shafts 26. The central passage defined through the drive shafts 26 can be in fluid communication with a plurality of fluid delivery ports provided at the cutting unit 34 such that the drilling fluid is readily provided at a cutting face of the cutting unit 34. Fluid can be provided to the central passage though a fluid swivel located at the drive unit 32.

The tunneling apparatus 20 can also include a vacuum system for removing spoils and drilling fluid from the bore being drilled. For example, the drill string 24 can include a vacuum passage (e.g., passage 47 shown at FIG. 13) that extends continuously from the proximal end to the distal end of the drill string 24. The proximal end of the vacuum passage can be in fluid communication with a vacuum 65 and the distal end of the vacuum passage is typically directly behind the cutting unit 34 adjacent the bottom of the bore. The vacuum 65 applies vacuum pressure to the vacuum passage to remove spoils and liquid (e.g., drilling fluid from fluid passage 45) from the bore being drilled. At least some air provided to the distal end of the drill string 24 through the air passage 43 is also typically drawn into the vacuum passage to assist in preventing plugging of the vacuum passage. In certain embodiments, the liquid and spoils removed from the bore though the vacuum passage can be delivered to a storage tank 67.

B. Example Pipe Section

FIGS. 2-11 show an example of one of the pipe sections 22 in accordance with the principles of the present disclosure. The pipe section 22 is elongated along a central axis 120 and includes a male end 122 (see FIG. 2) positioned opposite from a female end 124 (see FIG. 3). When a plurality of the pipe sections 22 are strung together, the female ends 124 are coupled to the male ends 122 of adjacent pipe sections 22.

Figure 2:
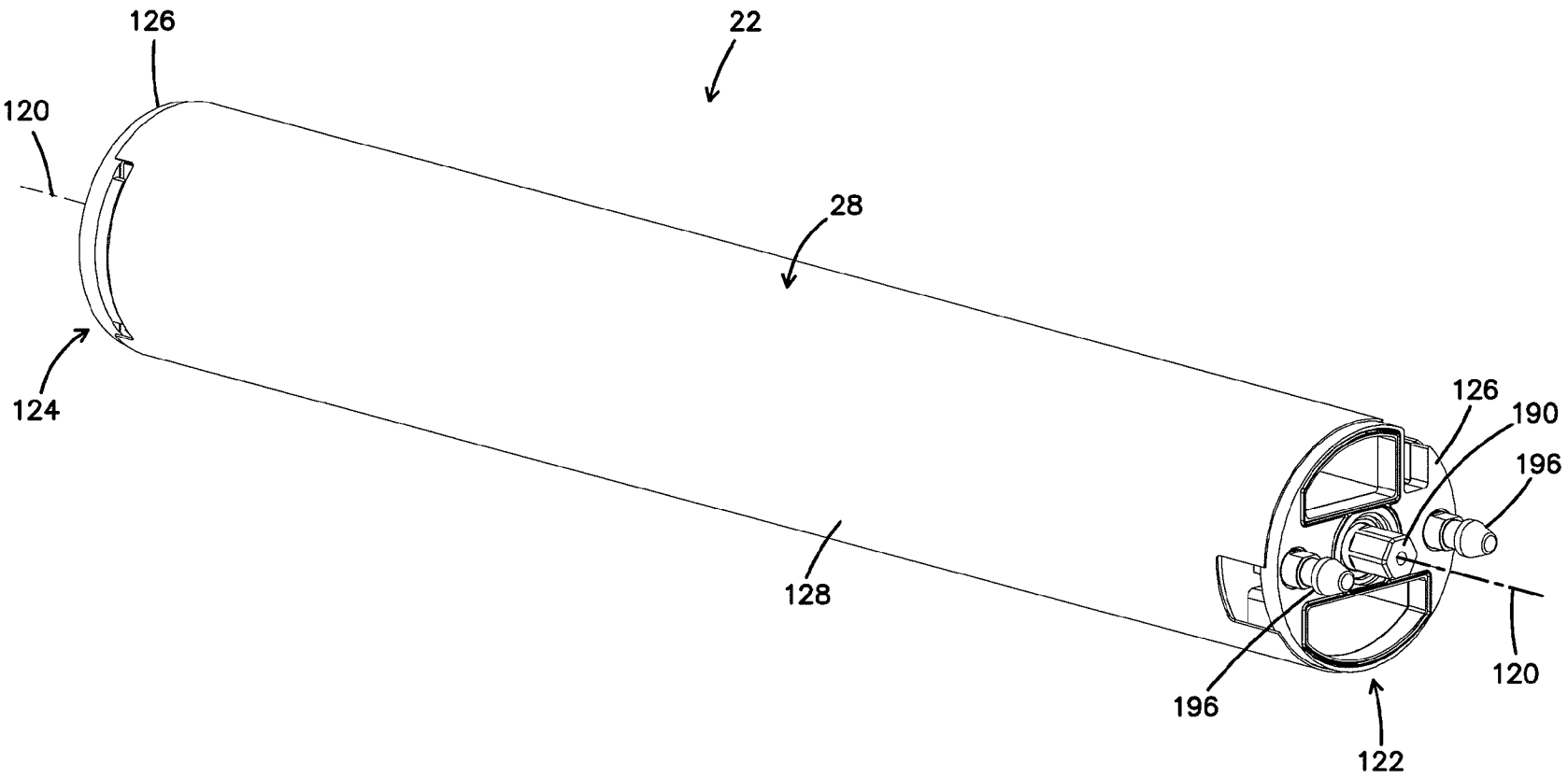
FIG. 2 is a perspective view showing a male end of a pipe section suitable for use with the tunneling apparatus schematically depicted at FIG. 1.
Figure 3:
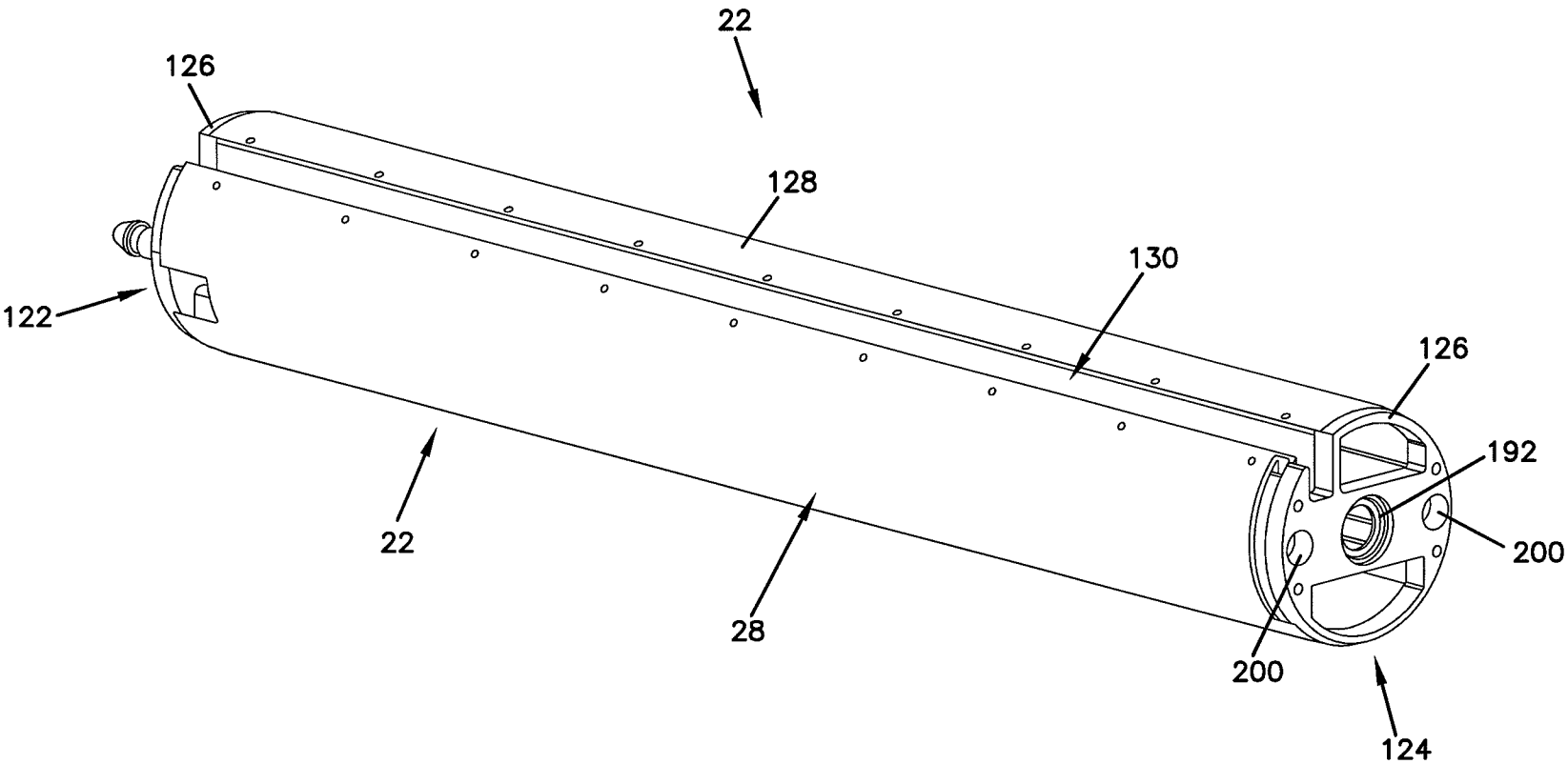
FIG. 3 is a perspective view showing a female end of the pipe section of FIG. 2.

Referring to FIGS. 2 and 3, the outer casing assembly 28 of the depicted pipe section 22 includes end plates 126 positioned at the male and female ends 122, 124. The outer casing assembly 28 also includes an outer shell 128 that extends from the male end 122 to the female end 124. The outer shell 128 is generally cylindrical and defines an outer diameter of the pipe section 22. In a preferred embodiment, the outer shell 128 is configured to provide support to a bore being drilled to prevent the bore from collapsing during the drilling process.

As shown at FIG. 3, the outer casing assembly 28 also defines an open-sided passage section 130 having a length that extends from the male end 122 to the female end 124 of the pipe section 22. The open-sided passage section 130 is defined by a channel structure 132 (see FIG. 11) having outer portions 134 secured (e.g., welded) to the outer shell 128. The channel structure 132 defines an open side 136 positioned at the outer shell 128. The open side 136 faces generally radially outwardly from the outer shell 128 and extends along the entire length of the pipe section 22. When the pipe sections 22 are coupled together to form the drill string 24, the open-sided passage sections 130 co-axially align with one another and cooperate to define a continuous open-sided exterior channel that extends along the length of the drill string 24.

Figure 4:
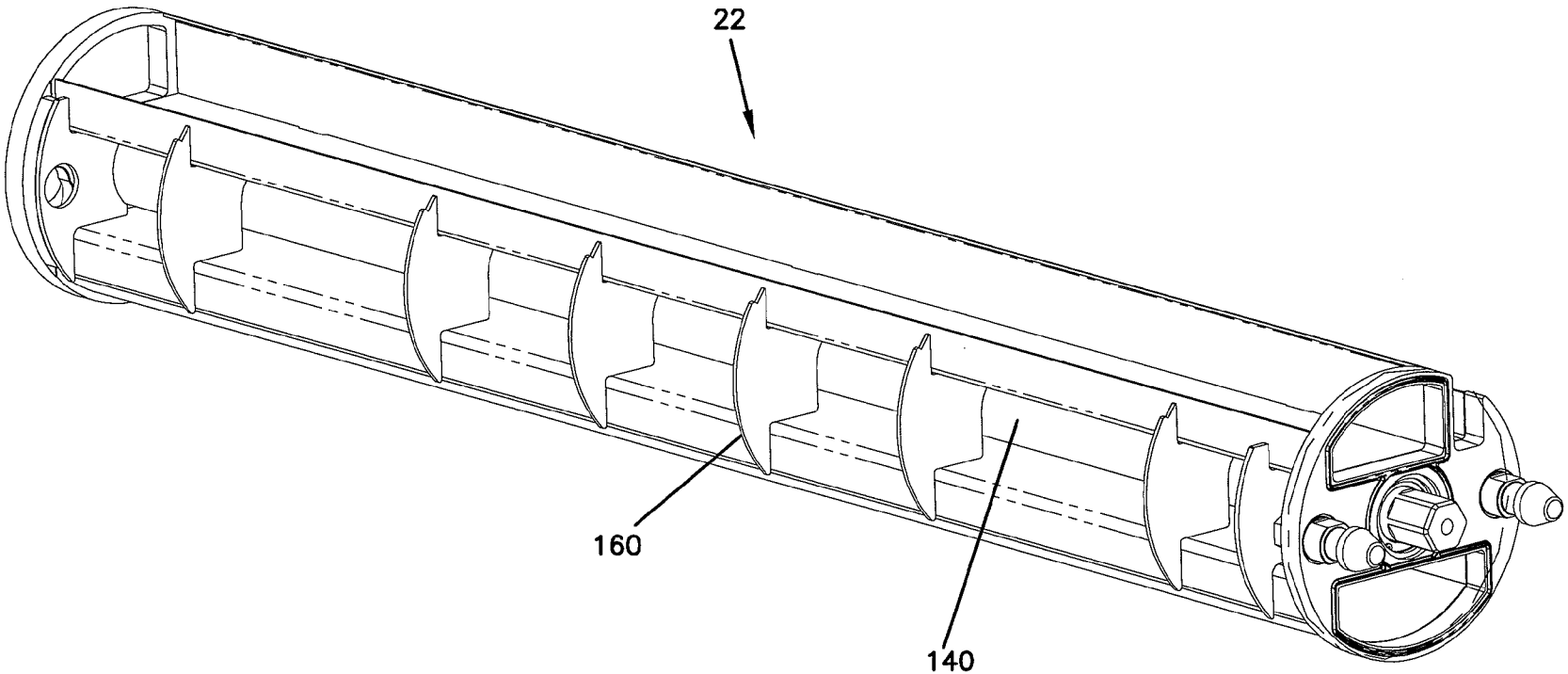
FIG. 4 is a perspective view of the pipe section of FIG. 2 with an outer shell removed to show internal components of the pipe section.
Figure 5:
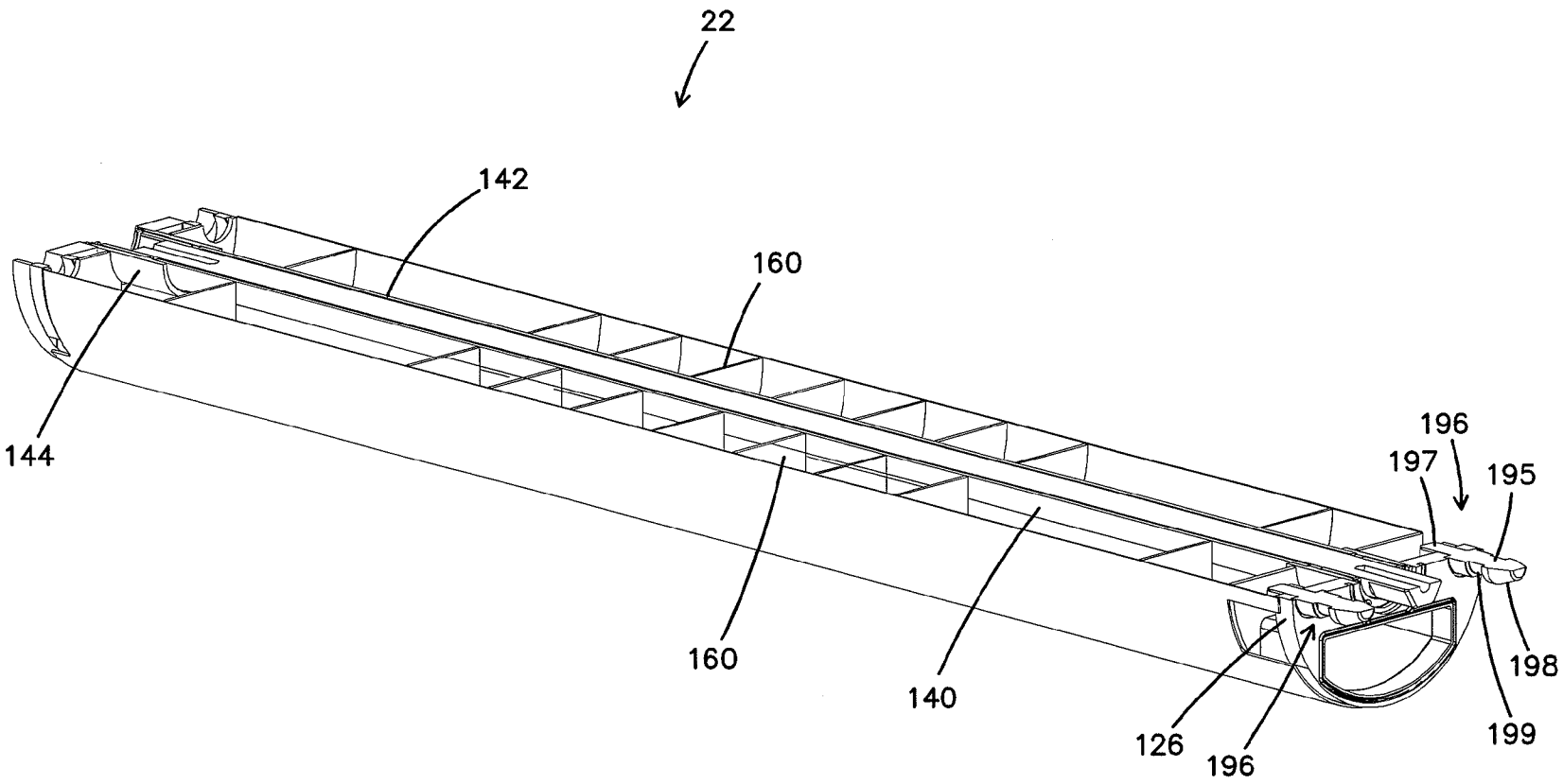
FIG. 5 is a perspective cross-sectional view of the pipe section of FIG. 2 with the pipe section being cut along a horizontal cross-sectional plane that bisects the pipe section.
Figure 6:
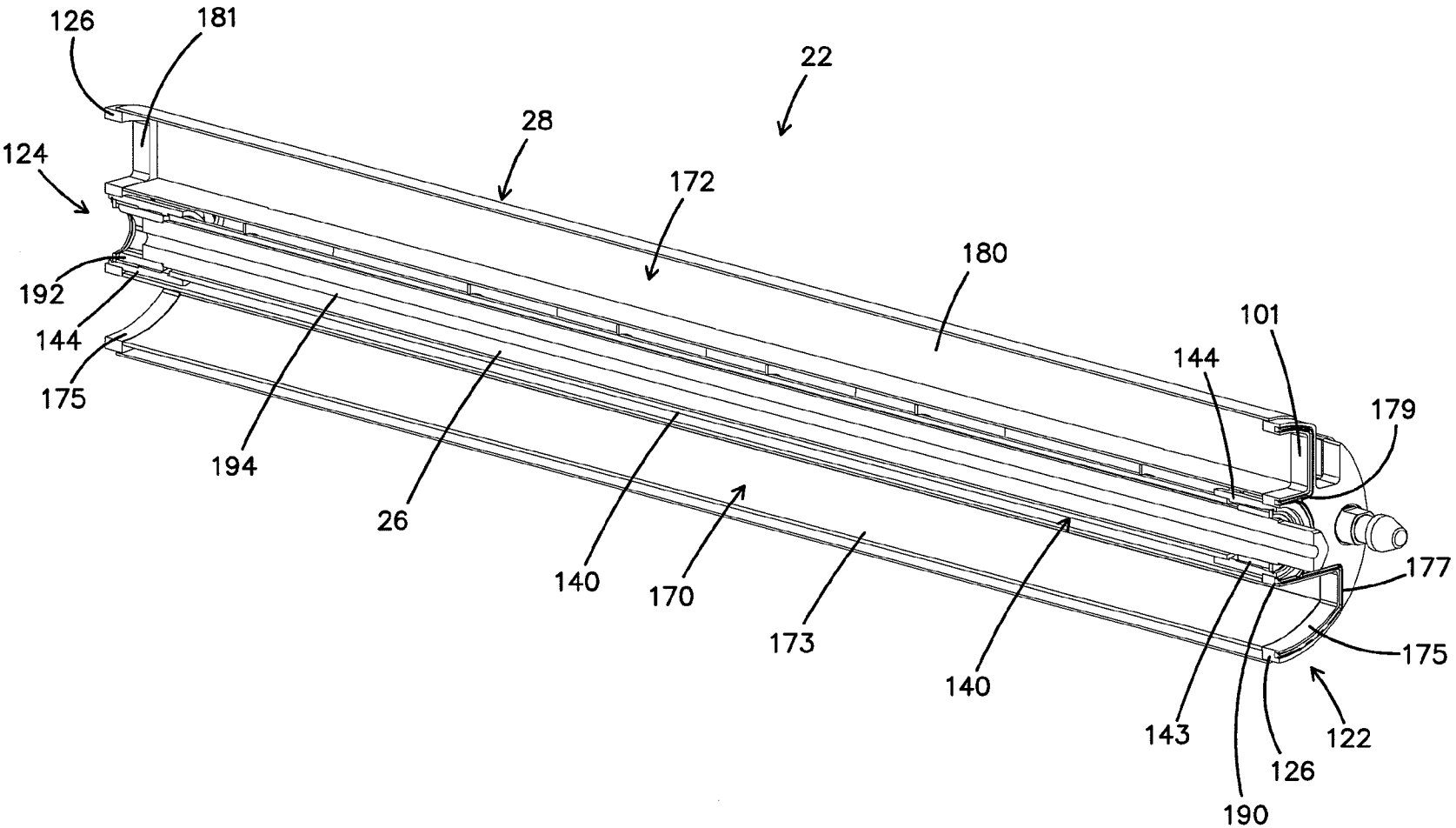
FIG. 6 is a perspective cross-sectional view of the pipe section of FIG. 2 with the pipe section being cut along a vertical cross-sectional plane that bisects the pipe section.

The outer casing assembly 28 of the pipe section 22 also includes structure for rotatably supporting the drive shaft 26 of the pipe section 22. For example, as shown at FIGS. 4-6, the outer casing assembly 28 includes a tubular shaft receiver 140 that extends along the central axis 120 from the male end 122 to the female end 124. Opposite ends of the shaft receiver 140 are secured (e.g., welded) to the end plates 126. The shaft receiver 140 includes a central portion 142 and end collars 144. The end collars 144 are secured (e.g., welded) to ends of the central portion 142. The end collars 144 are of larger diameter than the central portion 142. The end collars 144 are also secured (e.g., welded) to the end plates 126 such that the collars 144 function to fix the central portion 142 relative to the end plates 126.

Referring still to FIGS. 4-6, the drive shaft 26 is rotatably mounted within the shaft receiver 140 of the outer casing assembly 28. A bearing 143 (e.g., a radial bushing type bearing as shown at FIG. 6) is preferably provided in at least one of the collars 144 to rotatably support the drive shaft 26 within the shaft receiver 140. In certain embodiments, bearings for supporting the drive shaft 26 can be provided in both of the collars 144 of the shaft receiver 140.

Figure 11:
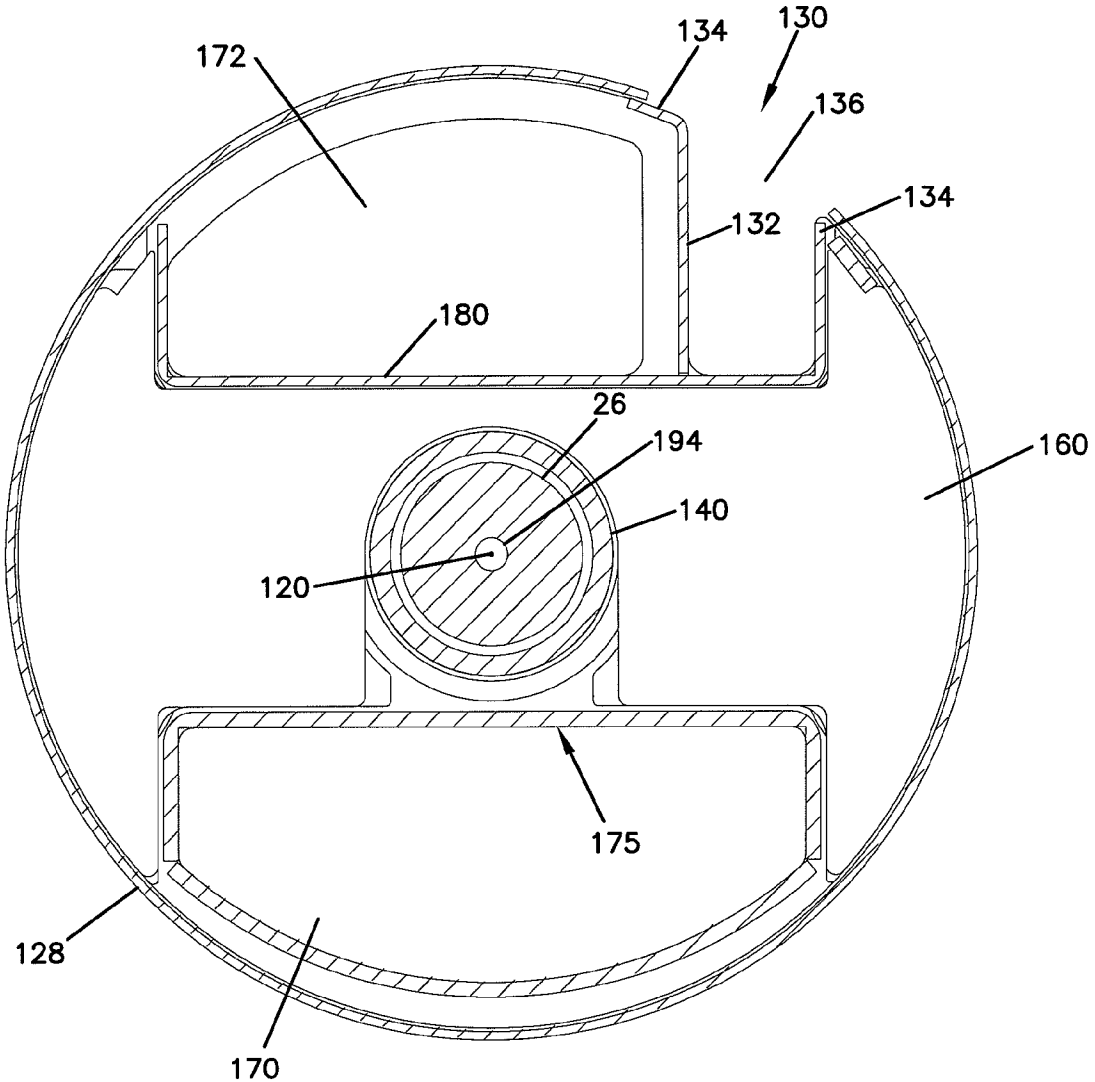
FIG. 11 is a cross-sectional view through a reinforcing plate of the pipe section of FIG. 2.

The outer casing assembly 28 also includes a plurality of gusset plates 160 secured between the outer shell 128 and the central portion 142 of the shaft receiver 140 (see FIGS. 4, 5 and 11). The gusset plates 160 assist in reinforcing the outer shell 128 to prevent the outer shell from crushing during handling or other use.

The pipe section 22 also includes a plurality of internal passage sections that extend axially through the pipe section 22 from the male end 122 to the female end 124. For example, referring to FIG. 6, the outer casing assembly 28 defines a first internal passage section 170 and a separate second internal passage section 172. The first and second internal passage sections 170, 172 each extend completely through the length of the pipe section 22. The first internal passage section 170 is defined by a tube structure 173 that extends along the length of the pipe section 22 and has opposite ends secured to the end plates 126. The end plates 126 define openings 175 that align with the tube structure 173. A face seal 177 or other sealing member can be provided at an outer face of at least one of the end plates 126 surrounding the openings 175 such that when two of the pipe sections 22 are coupled together, their corresponding passage sections 170 co-axially align and are sealed at the interface between the male and female ends 122, 124 of the connected pipe sections 22. When the pipe sections 22 are coupled together to form the drill string 24, the first internal passage sections 170 are co-axially aligned with each other and cooperate to form the continuous vacuum passage 47 that extends axially through the length of the drill string 24.

Referring again to FIG. 6, the second internal passage section 172 is defined by a tube structure 180 having opposite ends secured to the end plates 126. The end plates 126 have openings 181 that align with the tube structure 180. A face seal 179 or other sealing member can be provided at an outer face of at least one of the end plates 126 surrounding the openings 181 such that when two of the pipe sections 22 are coupled together, their corresponding passage sections 172 co-axially align and are sealed at the interface between the male and female ends 122, 124 of the connected pipe sections 22. When the pipe sections 22 are coupled together to form the drill string 24, the second internal passage sections 172 are co-axially aligned with each other and cooperate to form the continuous air passage 43 that extends axially through the length of the drill string 24.

Referring still to FIG. 6, the drive shaft 26 extends through the shaft receiver 140 and includes a male torque transferring feature 190 positioned at the male end 122 of the pipe section 22 and a female torque transferring feature 192 positioned at the female end 124 of the pipe section 22. The male torque transferring feature 190 is formed by a stub (e.g., a driver) that projects outwardly from the end plate 126 at the male end 122 of the pipe section 22. The male torque transferring feature 190 has a plurality of flats (e.g., a hexagonal pattern of flats forming a hex-head) for facilitating transmitting torque from drive shaft to drive shaft when the pipe sections 22 are coupled in the drill string 24. The female torque transferring feature 192 of the drive shaft 26 defines a receptacle (e.g., a socket) sized to receive the male torque transferring feature 190 of the drive shaft 26 of an adjacent pipe section 22 within the drill string 24. The female torque transferring feature 192 is depicted as being inset relative to the outer face of the end plate 126 at the female end 124 of the pipe section 22. In one embodiment, the female torque transferring feature 192 has a shape that complements the outer shape of the male torque transferring feature 190. For example, in one embodiment, the female torque transferring feature 192 can take the form of a hex socket. The interface between the male and female torque transferring features 190, 192 allows torque to be transferred from drive shaft to drive shaft within the drill string 24 defined by interconnected the pipe sections 22.

As shown at FIG. 6, each of the drive shafts 26 defines a central passage section 194 that extends longitudinally through the drive shaft 26 from the male end 122 to the female end 124. When the pipe sections 22 are interconnected to form the drill string 24, the central passage sections 194 of the drive shafts 26 are axially aligned and in fluid communication with one another such that a continuous, interrupted central passage (e.g., central passage 45 shown at FIG. 13) extends through the drive shafts 26 of the drill string 24 from the proximal end to the distal end of the drill string 24. The continuous central passage 45 defined within the drive shafts 26 allows drilling fluid to be pumped through the drill string 24 to the cutting unit 34.

Figure 6A:
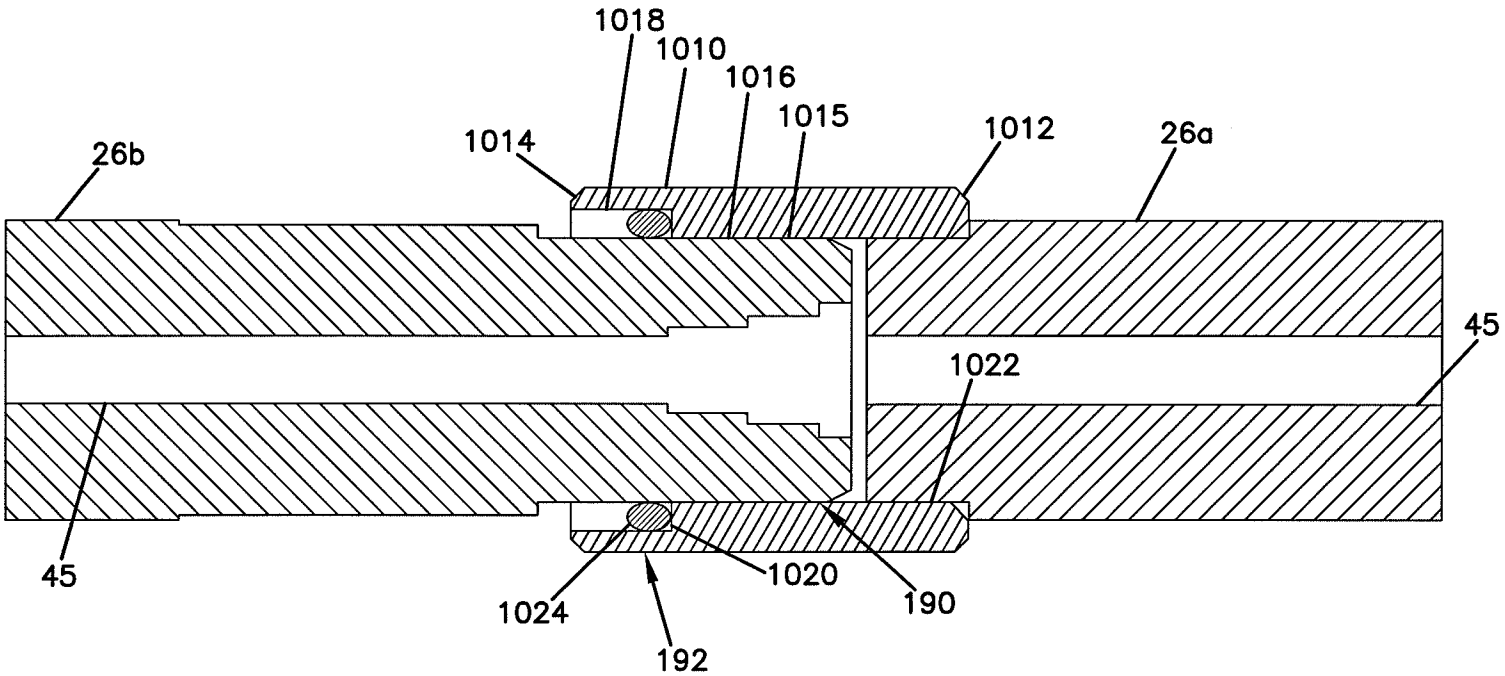
FIG. 6A is a longitudinal cross-sectional view of an interface between two drive shafts of the pipe sections.
Figure 7:
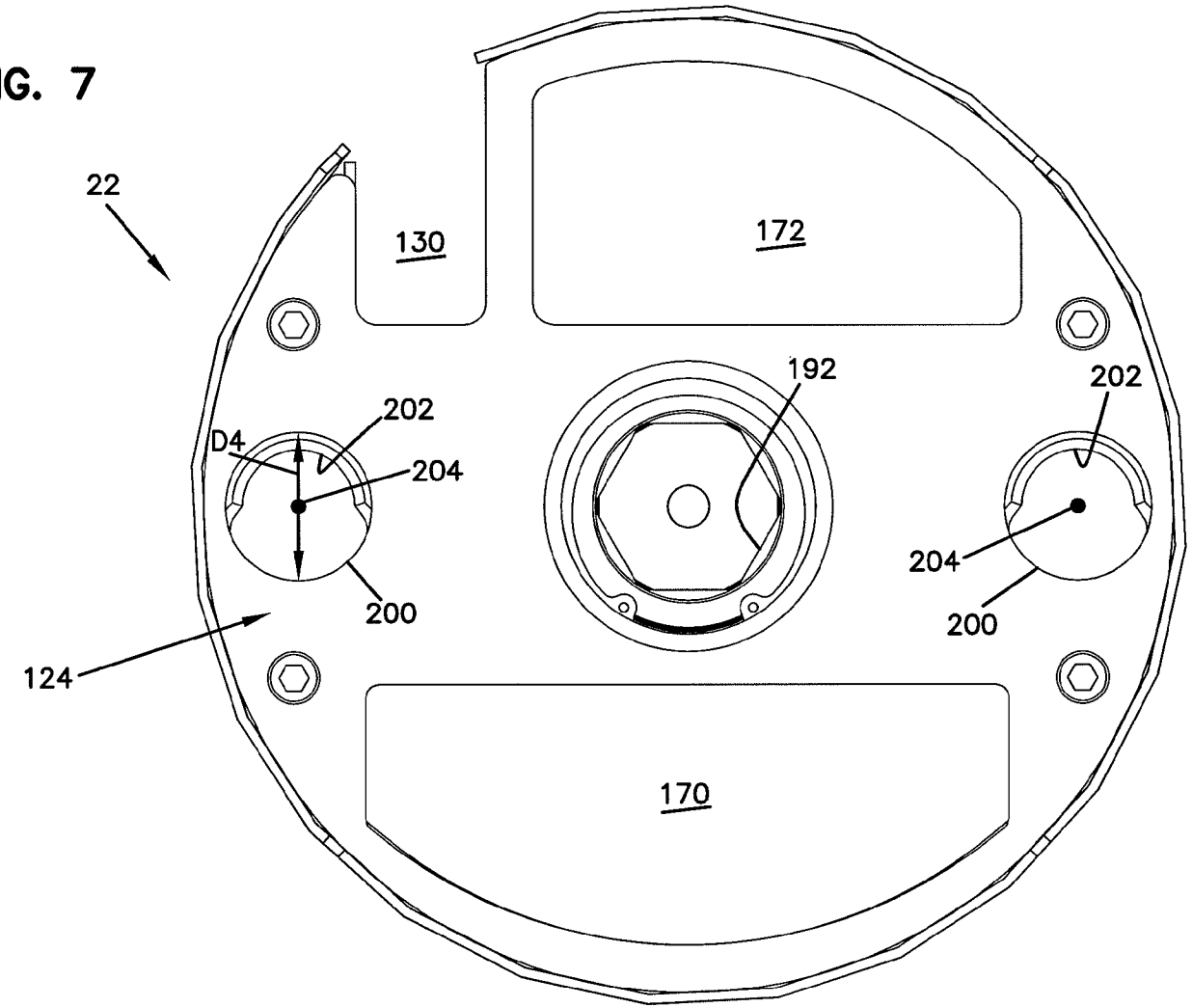
FIG. 7 is an end view showing the female end of the pipe section of FIG. 2.
Figure 8:
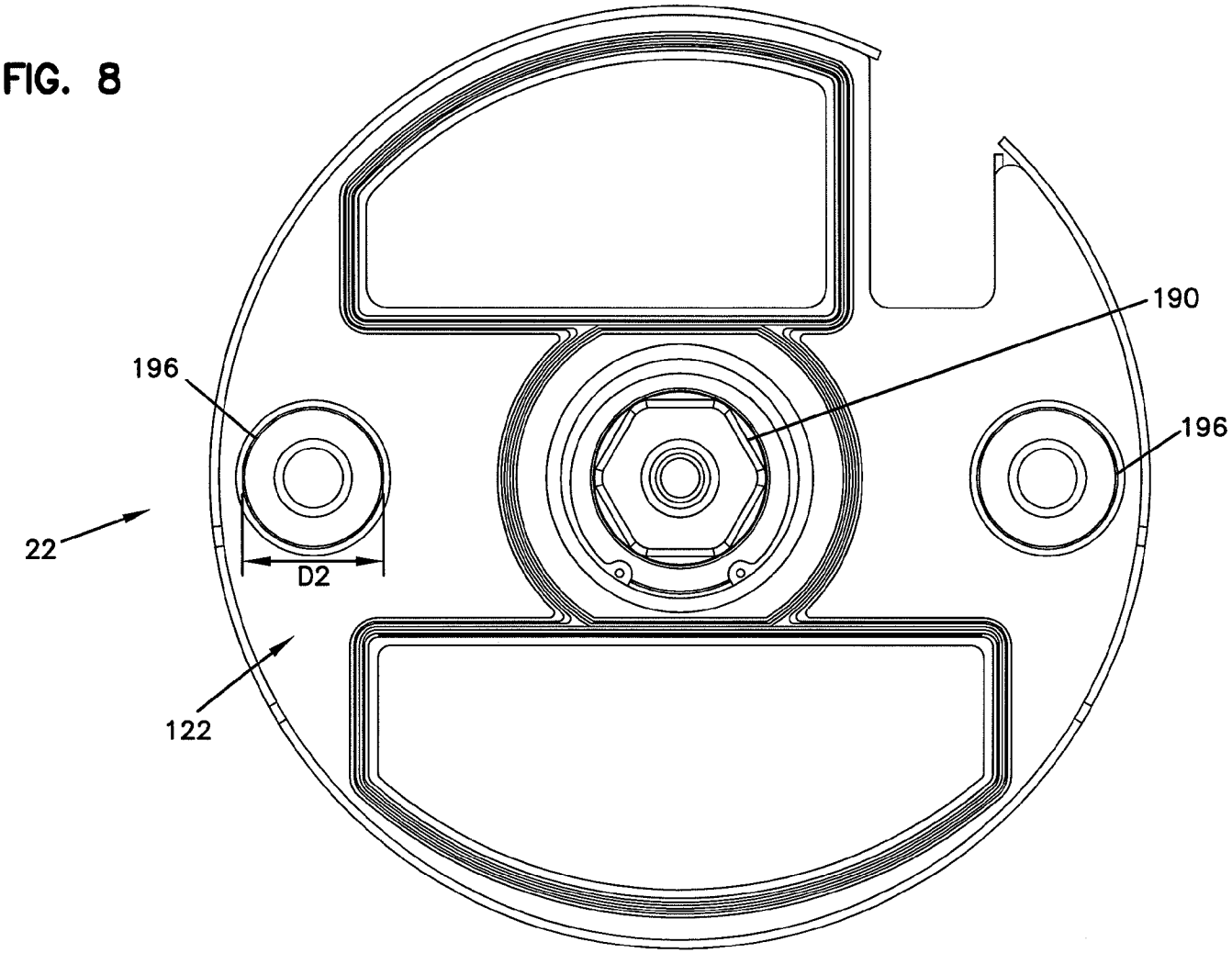
FIG. 8 is an end view showing the male end of the pipe section of FIG. 2.

FIG. 6A shows an example coupling between the male and female torque transferring features 190, 192. The female torque transferring feature 192 is shown as a collar 1010 having a first end 1012 positioned opposite from a second end 1014. A bore 1015 passes through the collar 1010 from the first end 1012 to the second end 1014. The bore 1015 has a first region 1016 defining torque transferring features (e.g., internal flats in a pattern such as a hexagonal pattern, internal splines, etc.) and a second region 1018 having an enlarged cross-dimension as compared to the first region 1016. The first region 1016 extends from the first end 1012 of the collar 1010 to a radial shoulder 1020. The second region 1018 extends from the second end 1014 of the collar 1010 to the radial shoulder 1020. The first end 1012 of the collar 1010 is fixedly secured (e.g., welded) to a corresponding drive shaft 26*a* having a shortened torque transmitting section 1022 that fits within the first region 1016 of the bore 1015. The torque transmitting section 1022 has torque transmitting features (e.g., external flats, splines, etc.) that engage the first region 1016 such that torque can be transferred between the shaft 26*a* and the collar 1010. In one embodiment, the torque transmitting section 1022 has a length less that one-third a corresponding length of the first region 1016 of the collar 1010. The portion of the first region 1016 that is not occupied by the shortened torque transmitting section 1022 is configured to receive the male torque transferring feature 190 of an adjacent drive shaft 26*b* such that torque can be transferred between the drive shafts 26*a*, 26*b*. The second region 1018 of the bore 1015 can be defined by an inner cylindrical surface of the collar 1010 that assists in guiding the male torque transferring feature 190 into the first region 1016 when the drive shafts 26*a*, 26*b* are moved axially into connection with one another. Additionally, a sealing member 1024 (e.g., a radial seal such as an o-ring seal) can be mounted within the second region 1018. The sealing member 1024 can provide a seal between the male torque transferring feature 190 and the second region 1018 of the bore 1015 for preventing drilling fluid from escaping from the central passage 45 at the joint between the drive shafts 26*a*, 26*b*.

The male and female ends 122, 124 of the pipe sections 22 are configured to provide rotational alignment between the pipe sections 22 of the drill string 24. For example, as shown at FIG. 2, the male end 122 includes two alignment projections 196 (e.g., pins) positioned at opposite sides of the central longitudinal axis 120. Referring to FIG. 5, each of the alignment projections 196 includes a base section 197 anchored to the end plate 126 at the male end 122. Each of the alignment projections 196 also includes a main body 195 that projects axially outwardly from the base section 197. The main body 195 includes a head portion 198 with a tapered outer end and a necked-down portion 199 positioned axially between head portion 198 and the base section 197. When a male end 122 of a first pipe section 22 is brought into engagement with the female end 124 of a second pipe section 22, the main bodies 195 of the alignment projections 196 provided at the male end 122 fit within (e.g., slide axially into) corresponding projection receptacles 200 (shown at FIG. 3) provided at the female end 124. As the main bodies 195 of the alignment projections 196 slide axially within the projection receptacles 200, slide latches 202 positioned at the female end 124 (see FIG. 9) are retained in non-latching positions in which the latches 202 do not interfere with the insertion of the projections 196 through the receptacles 200. The slide latches 202 include openings 206 corresponding to the projection receptacles 200 at the female end 124. The openings 206 include first regions 208 each having a diameter D1 (see FIG. 9) larger than an outer diameter D2 (see FIG. 8) of the head portions 198 and second portions 210 each having a diameter D3 (see FIG. 9) that generally matches an outer diameter defined by the necked-down portion 199 of the alignment projections 196. The diameter D3 is smaller than the outer diameter D2 defined by the head portion 198. The projection receptacles 200 have a diameter D4 (see FIG. 7) that is only slightly larger than the diameter D2. When the slide latches 202 are in the non-latching position, the first regions 208 of the openings 206 co-axially align with the projection receptacles 200. After the main bodies of the alignment projections 196 are fully inserted within the projection receptacles 200, a separate connection step is performed in which the latches 202 are moved (e.g., manually with a hammer) to latching positions in which the alignment projections 196 are retained within the projection receptacles 200.

Figure 9:
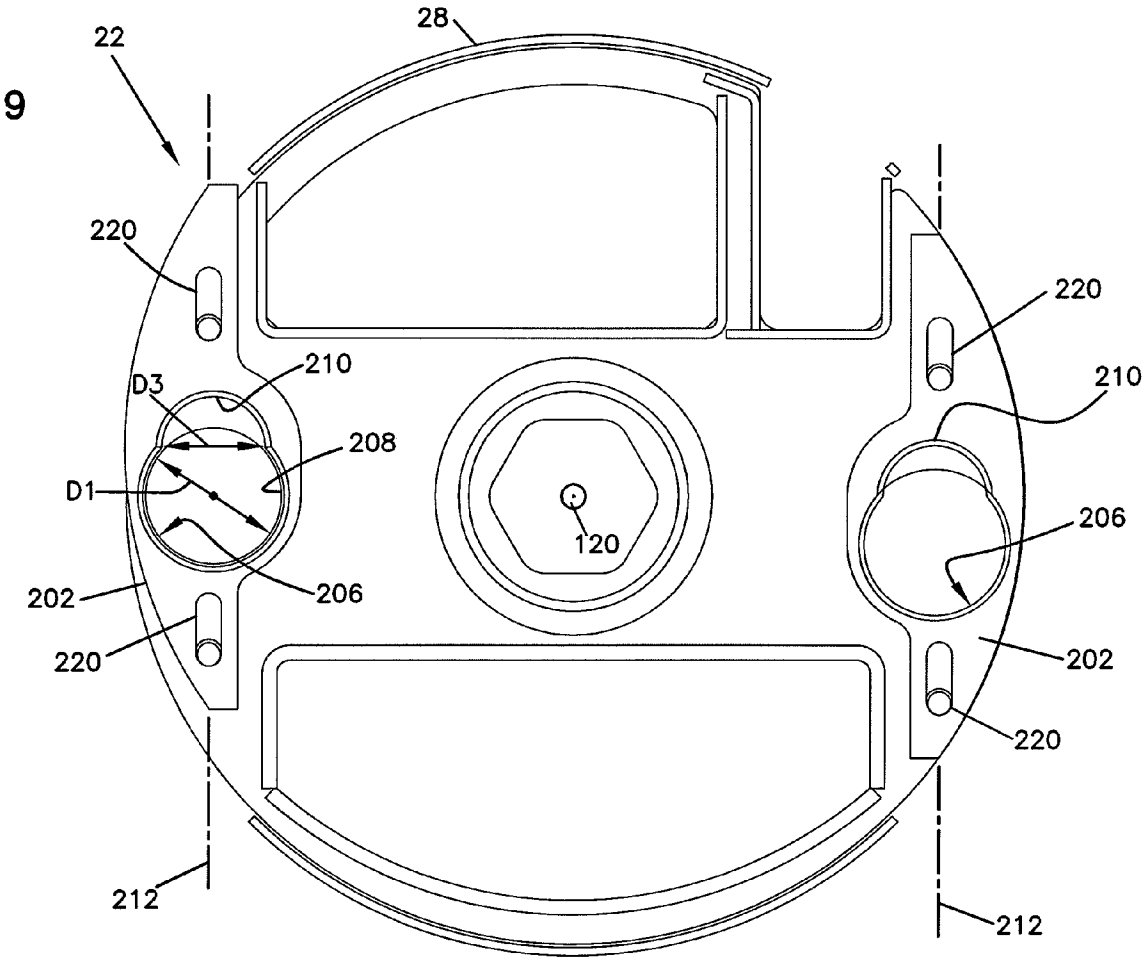
FIG. 9 is a cross-sectional view showing latches mounted at the female end of the pipe section of FIG. 2, the latches are shown in a non-latching orientation.
Figure 10:
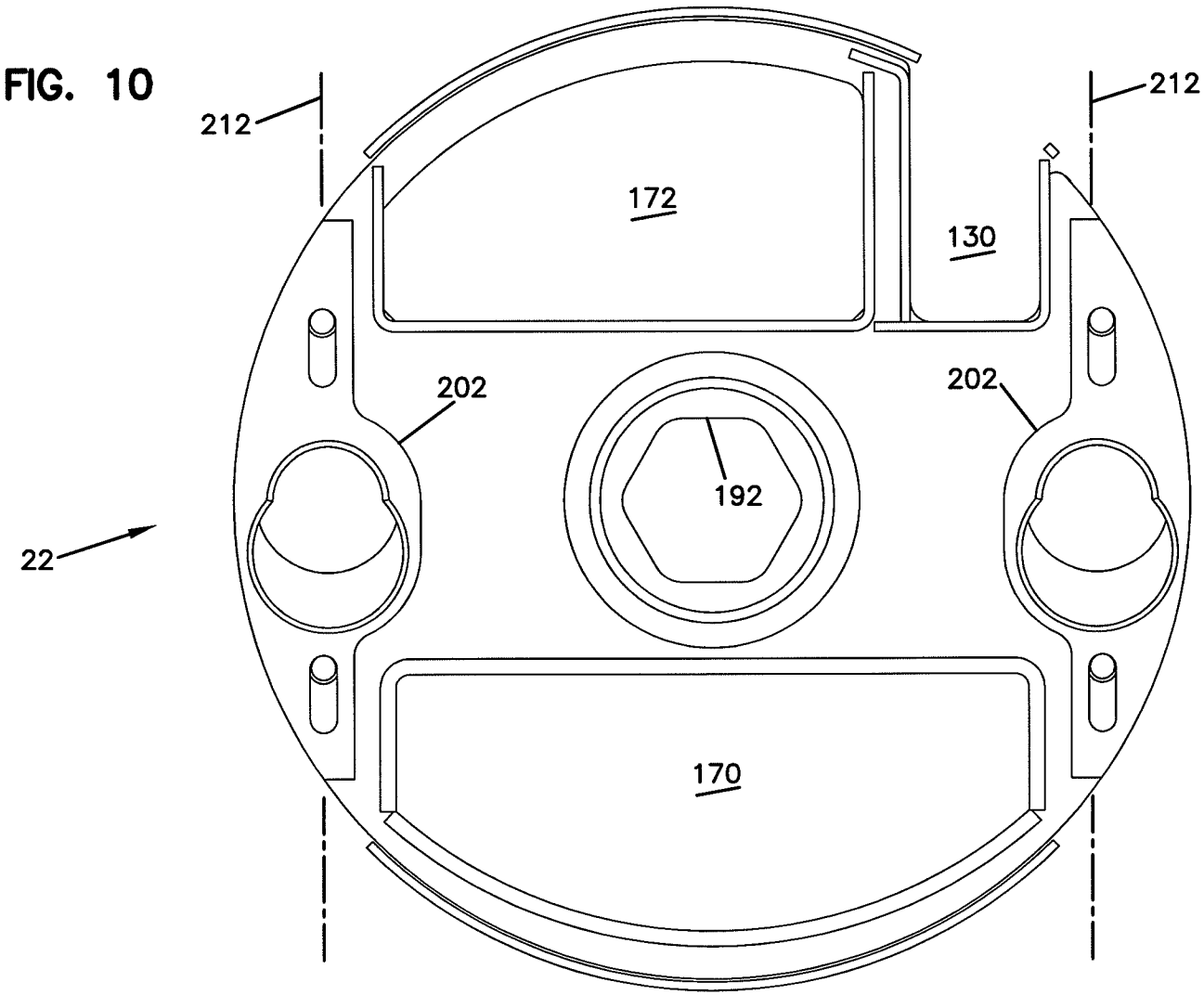
FIG. 10 is a cross-sectional view showing the latches of FIG. 9 in a latching orientation.

The slide latches 202 are slideable along slide axes 212 relative to the outer casing 28 of the pipe section 22 between the latching positions (see FIG. 10) and the non-latching positions (see FIG. 9). In non-latching positions, the first regions 208 of the openings 206 of the slide latches 202 coaxially align with the projection receptacles 200. In the latching positions, the first regions 208 of the openings 206 are partially offset from the projections receptacles 200 and the second regions 210 of the openings 206 at least partially overlap the projection receptacles 200.

To couple two pipe sections together, the alignment projections 196 of one of the pipe sections can be inserted into the projection receptacles 200 of the other pipe section. With the slide latches 202 retained in the non-latching positions (i.e., a projection clearance position), the main bodies 195 of the alignment projections 196 can be inserted axially into the projection receptacles 200 and through the first regions 208 of the openings 206 without interference from the slide latches 202. After the alignment projections 196 have been fully inserted into the projection receptacles 200 and relative axial movement between the pipe sections has stopped, the slide latches 202 can be moved to the latching positions to make a connection between the pipe sections 22. When in the latching positions, the second regions 210 of the openings 206 fit over the necked-down portions 199 of the alignment projections 196 such that portions of the slide latches 202 overlap the head portions 198 of the projections 196. This overlap/interference between the slide latches 202 and the head portions 198 of the alignment projections 196 prevents the main bodies 195 of the alignment projections 196 from being axially withdrawn from the projection receptacles 200. In this way, a secure mechanical coupling is provided between adjacent individual pipe sections 22. No connection is made between the pipe sections 22 until the slide latches 202 have been moved to the latched position. To disconnect the pipe sections 22, the slide latches 202 can be returned to the non-latching position thereby allowing the alignment projections 196 to be readily axially withdrawn from the projection receptacles 200 and allowing the pipe sections 22 to be axially separated from one another.

The slide axis 212 of each slide latch 202 extends longitudinally through a length of its corresponding slide latch 202. Each slide latch 202 also includes a pair of elongate slots 220 having lengths that extend along the slide axis 212. The outer casing assembly 28 of the pipe section 22 includes pins 222 that extend through the slots 220 of the slide latches 202. The pins 222 prevent the slide latches 202 from disengaging from the outer casing assemblies 28. The slots 220 also provide a range of motion along the slide axes 212 through which the slide latches 202 can slide between the non-latching position and the latching position.

When two of the pipe sections are latched, interference between the slide latches 202 and the enlarged heads/ends 198 of the projections 196 mechanically interlocks or couples the adjacent pipe sections 22 together such that pull-back load or other tensile loads can be transferred from pipe section 22 to pipe section 22 in the drill string 24. This allows the drill string 24 to be withdrawn from a bored hole by pulling the drill string 24 back in a proximal direction. The pull-back load is carried by/through the casing assemblies 28 of the pipe sections 22 and not through the drive shafts 26. Prior to pulling back on the drill string 24, the drill head 30 can be replaced with a back reamer adapted to enlarge the bored hole as the drill string 24 is pulled back out of the bored hole.

The alignment projections 196 and receptacles 200 also maintain co-axial alignment between the pipe sections 22 and ensure that the internal and external axial passage sections defined by each of the pipe sections 22 co-axially align with one another so as to define continuous passageways that extend through the length of the drill string 24. For example, referring to FIG. 9, the alignment provided by the projections 196 and the receptacles 200 ensures that the first internal passage sections 170 of the pipe sections 22 are all co-axially aligned with one another (e.g., all positioned at about the 6 o'clock position relative to the central axis 120), the second internal passages 172 are all co-axially aligned with one another (e.g., all positioned generally at the 12 o'clock position relative to the central axial 120), and the open-sided passage sections 130 are all co-axially aligned with one another (e.g., all positioned generally at the 1 o'clock position relative to the central axis 120).

C. Example Drive Unit

Figure 12:
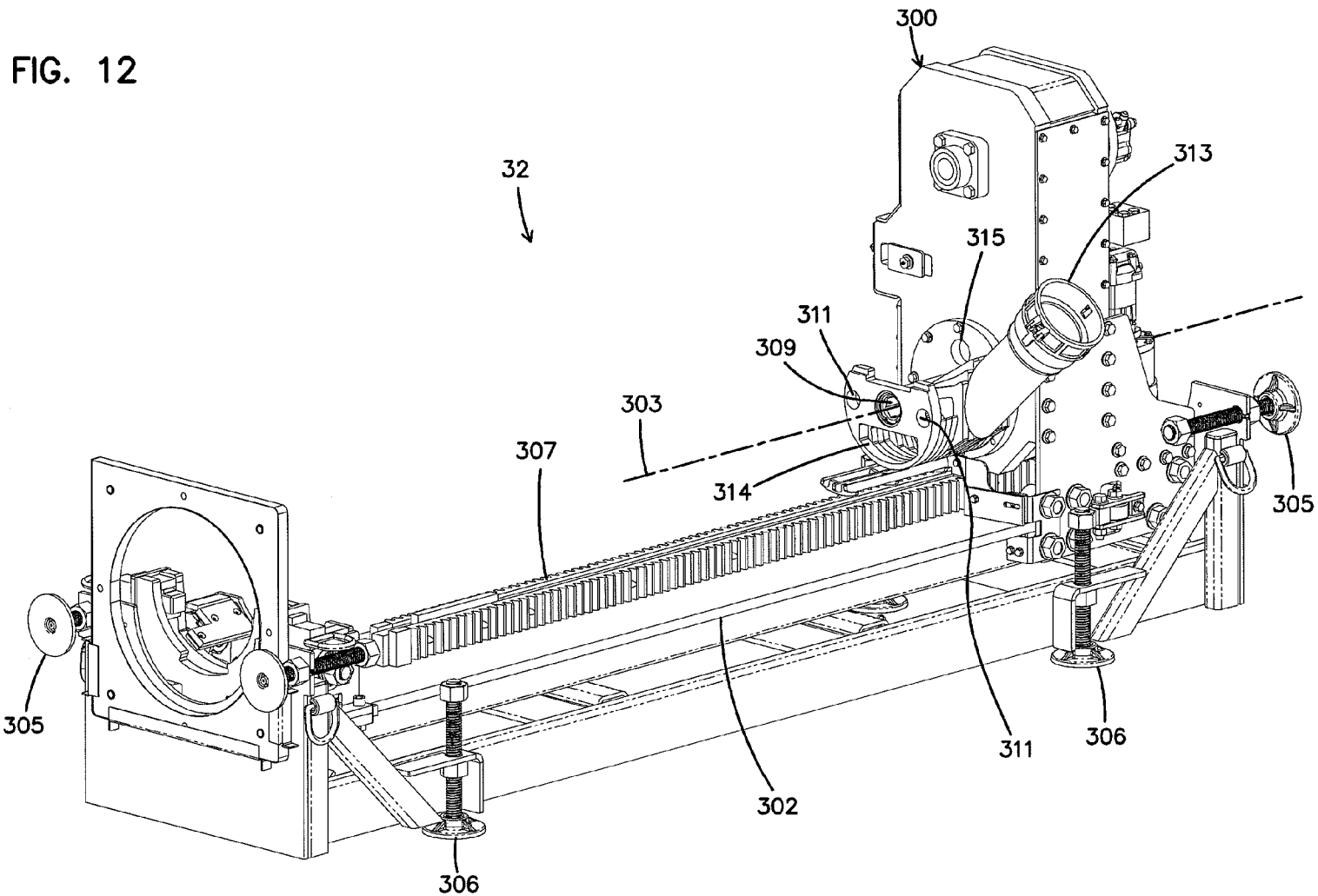
FIG. 12 shows an example drive unit suitable for use with the tunneling apparatus schematically depicted at FIG. 1.

FIG. 12 shows an example configuration for the drive unit 32 of the tunneling/drilling apparatus 20. Generally, the drive unit 32 includes a carriage 300 that slidably mounts on a track structure 302. The track structure 302 is supported by a base of the drive unit 32 adapted to be mounted within an excavated structure such as a pit. Extendable feet 305 can be used to anchor the tracks within the pit and extendable feet 306 can be used to set the base at a desired angle relative to horizontal. The drive unit 32 includes a thrust driver for moving the carriage 300 proximally and distally along an axis 303 parallel to the track structure 302. The thrust driver can include a hydraulically powered pinion gear arrangement (e.g., one or more pinion gears driven by one or more hydraulic motors) carried by the carriage 300 that engages an elongated gear rack 307 that extends along the track structure 302. In other embodiments, hydraulic cylinders or other structures suitable for moving the carriage distally and proximally along the track can be used. The drive unit 32 also includes a torque driver (e.g., a hydraulic drive) carried by the carriage 300 for applying torque to the drill string 24. For example, as shown at FIG. 12, the drive unit can include a female rotational drive element 309 mounted on the carriage 300 that is selectively driven/rotated in clockwise and counter clockwise directions about the axis 303 by a drive (e.g., hydraulic drive motor) carried by the carriage 300. The female rotational drive element 309 can be adapted to receive the male torque transferring feature 190 of the drive shaft 26 corresponding to the proximal-most pipe section of the drill string 24. Projection receptacles 311 are positioned on opposite sides of the female drive element 309. The projection receptacles 311 are configured to receive the projections 196 of the proximal-most pipe section 22 to ensure that the proximal-most pipe section 22 is oriented at the proper rotational/angular orientation about the central axis 303 of the drill string.

The carriage also carries a vacuum hose port 313 adapted for connection to a vacuum hose that is in fluid communication with the vacuum 65 of the tunneling apparatus 20. The vacuum hose port 313 is also in fluid communication with a vacuum port 314 positioned directly beneath the female drive element 309. The vacuum port 314 co-axially aligns with the first internal passage section 170 of the proximal-most pipe section 22 when the proximal-most pipe section is coupled to the drive unit 32. In this way, the vacuum 65 is placed in fluid communication with the vacuum passage 47 of the drill string 24 so that vacuum can be applied to the vacuum passage 47 to draw slurry through the vacuum passage 47.

The carriage 300 also defines a laser opening 315 through which the laser beam 42 from the laser 40 can be directed. The laser beam opening 315 co-axially aligns with the second internal passage section 172 of the proximal-most pipe section 22 when the proximal-most pipe section 22 is coupled to the drive unit 32. In this way, the laser beam 42 can be sent through the air passage 43 of the drill string 24.

The female rotational drive element 309 also defines a central opening in fluid communication with a source of drilling fluid (e.g., the fluid/liquid pump 63 of the tunneling apparatus 20). When the female rotational drive element 309 is connected to the male torque transferring feature 190 of the drive shaft 26 of the proximal-most pipe section, drilling fluid can be introduced from the source of drilling fluid through the male torque transferring feature 190 to the central fluid passage (e.g., passage 45) defined by the drive shafts 26 of the pipe sections 22 of the drill string 24. The central fluid passage defined by the drive shafts 26 carries the drilling fluid from the proximal end to the distal end of the drill string 24 such that drilling fluid is provided at the cutting face of the cutting unit 34.

To drill a bore, a pipe section 22 with the drill head 30 mounted thereon is loaded onto the drive unit 32 while the carriage is at a proximal-most position of the track structure 302. The proximal end of the pipe section 22 is then coupled to the carriage 300. Next, the thrust driver propels the carriage 300 in a distal direction along the axis 303 while torque is simultaneously applied to the drive shaft 26 of the pipe section 22 by the female rotational drive element 309. By using the thrust driver to drive the carriage 300 in the distal direction along the axis 303, thrust is transferred from the carriage 300 to the outer casings 28 of the pipe section 22 thereby causing the pipe section 22 to be pushed distally into the ground. Once the carriage 300 reaches the distal-most position of the track structure 302, the proximal end of the pipe section 22 is disconnected from the carriage 300 and the carriage 300 is returned back to the proximal-most position. The next pipe section 22 is then loaded into the drive unit 32 by connecting the distal end of the new pipe section 22 to the proximal end of the pipe section 22 already in the ground and also connecting the proximal end of the new pipe section 22 to the carriage 300. The carriage 300 is then propelled again in the distal direction while torque is simultaneously applied to the drive shaft 26 of the new pipe section 22 until the carriage 300 reaches the distal-most position. Thereafter, the process is repeated until the desired number of pipe sections 22 have been added to the drill string 24.

The drive unit 32 can also be used to withdraw the drill string 24 from the ground. By latching the projections 196 of the proximal-most pipe section 22 within the projection receptacles 311 of the drive unit carriage 300 (e.g., with slide latches provided on the carriage) while the carriage 300 is in the distal-most position, and then using the thrust driver of the drive unit 32 to move the carriage 300 in the proximal direction from the distal-most position to the proximal-most position, a pull-back load is applied to the drill string 24 which causes the drill string 24 to be withdrawn from the drilled bore in the ground. If it is desired to back ream the bore during the withdrawal of the drill string 24, the cutting unit 34 can be replaced with a back reamer that is rotationally driven by the torque driver of the drive unit 32 as the drill string 24 is pulled back. After the proximal-most pipe section 22 has been withdrawn from the bore and disconnected from the drive unit 32, the carriage 300 can be moved from the proximal-most position to the distal-most position and connected to the proximal-most pipe section still remaining in the ground. Thereafter, the retraction process can be repeated until all of the pipe sections have been pulled from the ground.

D. Example Vacuum Passage Plug Detection System

Figure 13:
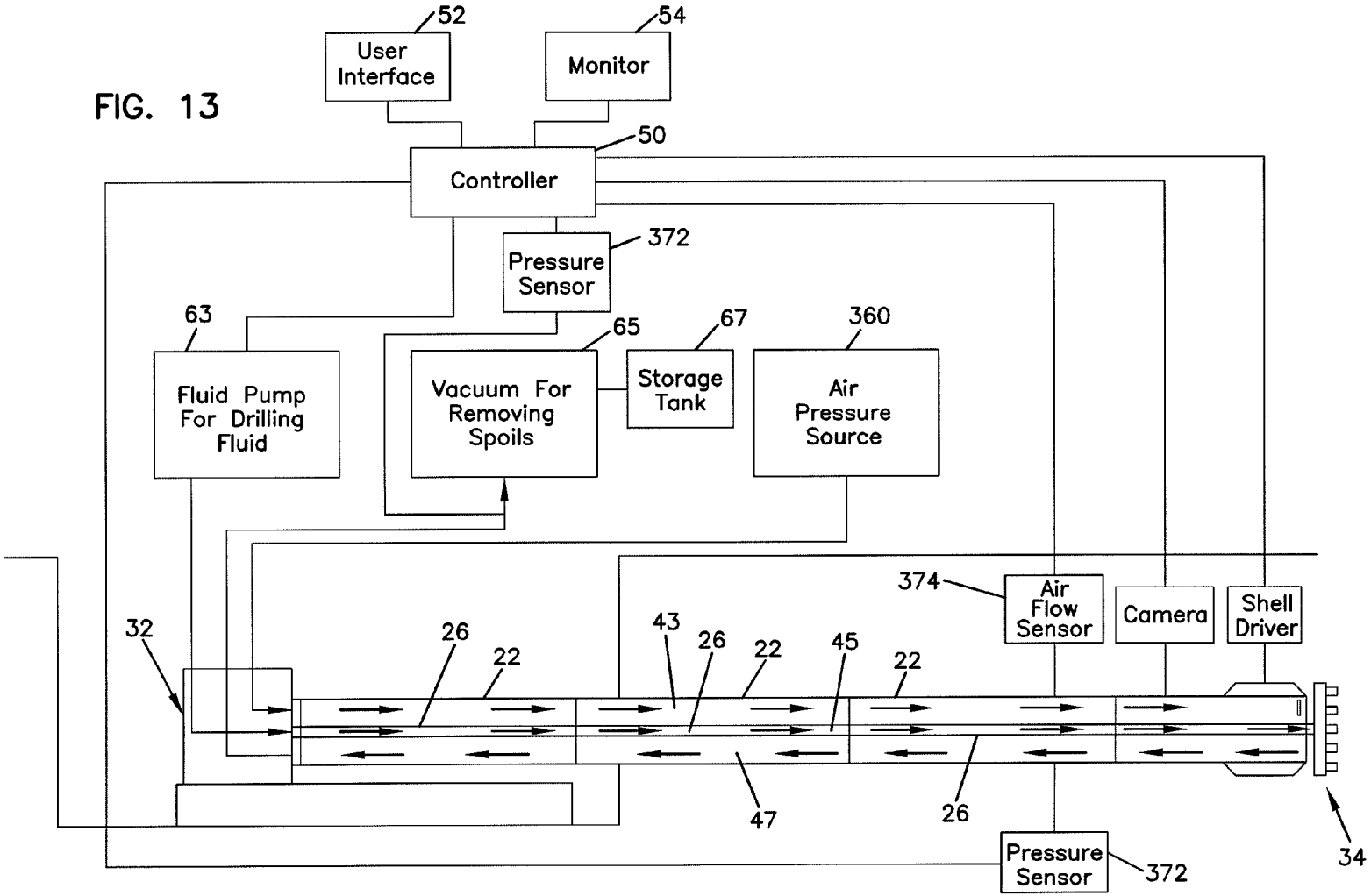
FIG. 13 is another schematic depiction of the tunneling apparatus of FIG. 1.

FIG. 13 is another schematic view of the tunneling apparatus 20 of FIG. 1. Referring to FIG. 13, the air and vacuum passages 43, 47 that extend axially through the drill string 24 are schematically depicted. The drive shafts 26 that extend axially through the drill string from the drive unit 32 to the cutting unit 34 are also schematically depicted. The fluid/liquid pump 63 is shown directing drilling fluid through the central fluid passageway 45 that is defined by the drive shafts 26 and that extends from the proximal end to the distal end of the drill string 24. In other embodiments, the fluid/liquid pump 63 can convey the drilling fluid down a fluid line positioned within the channel defined by the open-sided passage sections 130 of the pipe sections 22. The air passage 43 is shown in fluid communication with an air pressure source 360 that directs compressed air into the proximal end of the air passage 43. The air pressure source 360 can include a fan, blower, air compressor, air pressure accumulator or other source of compressed air. The vacuum passage 47 is shown in fluid communication with the vacuum 65 for removing spoils from the bore. The vacuum 65 applies vacuum to the proximal end of the vacuum passage 47.

As a bore is formed by the tunneling apparatus 20, it is possible for the vacuum passage 47 to become plugged adjacent the distal end of the drill string 24. Once the vacuum passage 47 becomes plugged, the vacuum passage 47 can be difficult to clear. For example, it may be necessary to withdraw the drill string 24 from the bore and manually clear the obstruction. Thus, the tunneling apparatus 20 is equipped with features that reduce the likelihood of the vacuum passage 47 becoming plugged. For example, by applying positive air pressure to the proximal end of the air passage 43 via the source of air pressure 360, more air is provided to the distal end of the drill string 24 thereby reducing the likelihood of plugging. The air is forced to flow (i.e., blown by the source of air pressure 360) down the air passage 43 to adjacent the cutting unit 34 and then flows into the vacuum passage 47. In this way, positive pressure from the source or air pressure 360 helps push debris/spoils proximally into and through the vacuum passage 47 and the source of vacuum 65 pulls debris/spoils proximally into and through the vacuum passage 47. In certain embodiments, the flow rate and pressure of the air blown down the air passage 43 are coordinated and balanced with the evacuation rate provided by the source of vacuum 65.

One or more pressure sensing locations 370*a*, 370*b* can be provided at locations along the vacuum path from the distal end of the drill string to the vacuum 65. The pressure sensing location 370*a* is provided down-hole at the vacuum passage 47 near the distal end of the drill string. For example, the pressure sensing location 370*a* can be within the drill head. The pressure sensing location 370*b* is located above-ground adjacent to an intake for the vacuum 65. For example, the pressure sensing location 370*b* can be at a transition between the pipe sections and the intake to the vacuum 65. Another pressure sensing location can be provided at or within the vacuum 65 itself. This sensing location can provide an indication regarding whether the vacuum 65 is operating properly. The pressure sensing locations are locations along the vacuum path where pressure sensors 372 are placed in fluid communication with the vacuum path. In this way, the pressure sensors can be used to take vacuum pressure readings representative of the real-time vacuum pressure at the pressure sensing locations 370*a*, 370*b*. By sensing pressure at multiple locations, it is possible to better diagnose where a blockage may be occurring and to better assess the overall effectiveness of the system.

The pressure sensors 372 preferably interface with the controller 50 and provide vacuum pressure data used by the controller 50 to monitor the status of the vacuum system. A variation in vacuum pressure compared to the vacuum pressure associated with normal (i.e., unplugged) operation of the vacuum system can be a precursor plugging characteristic used by the controller 50 as an indicator that the vacuum path is becoming plugged. Therefore, if the controller 50, via the pressure data provided by the pressure sensors 372, detects a variation in vacuum pressure that reaches a predetermined alert level, the controller 50 may take action suitable for reducing the likelihood that the vacuum passage 47 becomes fully blocked. For example, the controller 50 may reduce the amount of thrust that is being applied to the drill string 24 or may modify the rotational speed of the cutting unit 34 (e.g., the rotational speed of the cutting unit may be increased, decreased, stopped or reversed). The controller 50 may also completely stop thrusting of the drill string or may even retract the drill string until the pressure sensor 372 indicates that the vacuum pressure within the vacuum channel has returned to an acceptable level. In certain embodiments, the controller may cause the vacuum to stop applying vacuum pressure to the passage 47, and positive pressure can be applied to the passage 47 to blow the possible obstruction distally out of the passage 43 back to the cutting unit where the possible obstruction can be further reduced in size. Alternatively, vacuum may be applied to the air channel 43 to draw debris toward the air channel 43 while positive pressure is applied to the passage 47 to blow debris from the passage 47. In other embodiments, the controller 50 may issue an alert or alarm to the operator (e.g., via monitor 54, an alarm light or audible signal) indicating that a vacuum plug event has been detected. The controller 50 may also provide operational instructions/recommendations for preventing the vacuum passage from being plugged (e.g., stop thrust, reverse thrust, etc.). In still other embodiments, the controller may cause the amount of drilling fluid being provided down the hole to increase when a plug condition is detected. In one example embodiments, the controller automatically decreases thrust, increases the rotational speed of the cutting unit and increase the amount of drilling fluid provided down the hole when a precursor plugging characteristic is detected. Any combination of the above actions may be automatically implemented by the controller 50 or manually implemented by the operator.

In still other embodiments, the controller 50 may interface with a vacuum pressure read-out (e.g., a digital or mechanical display/gauge) that displays the vacuum pressure sensed by the pressure sensor 372. Therefore, by monitoring the vacuum pressure read-out, the operator can note variations in vacuum pressure and modify operation of the tunneling apparatus accordingly to reduce the likelihood of plugging. For example, the operator can implement one or more of the remedial actions described above.

In one example, a precursor plugging characteristic is detected by the controller 50 when the vacuum pressure increases (i.e., moves or spikes in magnitude in a direction extending away from atmospheric pressure and toward complete vacuum) to a predetermined alert level greater in magnitude than the vacuum pressure associated with normal unplugged operating conditions. This would typically occur when a plug begins to form at a location down-hole from a given pressure sensing location (i.e., the pressure sensing location is between the source of vacuum and the plugging location). In another example, a precursor plugging characteristic is detected by the controller 50 when the vacuum pressure decreases (i.e., moves or spikes in magnitude in a direction extending away toward atmospheric pressure and away from complete vacuum) to a predetermined alert level less in magnitude than the vacuum pressure associated with normal unplugged operating conditions. This would typically occur when a plug begins to form at a location between the source of vacuum and the pressure sensing location. When a precursor plugging characteristic is detected, the controller can alert the operator of the precursor plugging condition (e.g., with an audible or visual signal) and/or can automatically modify operation of the tunneling apparatus to prevent full blockage of the vacuum channel.

Air flow in the air channel 43 can also function as an indicator (i.e., a precursor plugging characteristic) regarding whether the vacuum path is in the process of becoming blocked. For example, a reduction in air flow within the air channel 43 compared to the amount of air flow through the air channel 43 during normal operation of the vacuum system in an unplugged state can provide an indication that the vacuum path is in the process of becoming blocked. To monitor air flow within the air passage 43, the controller 50 can interface with an air flow sensor 374 that senses the amount of air flow within the air channel 43. If the controller 50 detects that the air flow within the air passage 43 has fallen below a predetermined alert level, the controller 50 can modify operation of the tunneling apparatus to prevent full blockage of the vacuum channel as described above. Further, as indicated above, the controller may issue an alert to the operator and provide recommended remedial actions.

In still other embodiments, the controller 50 may interface with an air-flow read-out (e.g., a digital or mechanical display/gauge) that displays the air flow rate sensed by the sensor 374. Therefore, by monitoring the air flow read-out, the operator can note variations in air flow and modify operation of the tunneling apparatus accordingly to reduce the likelihood of plugging. For example, the operator can implement one or more of the remedial actions described above.

Additional structures can also be provided for clearing and/or preventing blockage of the vacuum passage 47. For example, nozzle jets can be provided at the drill head for directing spray at the entrance to the passage 47. Also, blockages can be mechanically cleared by mechanical structures such as rods/snakes passed axially through either of the passages 43, 47.

E. Example Drill Head

Figure 14:
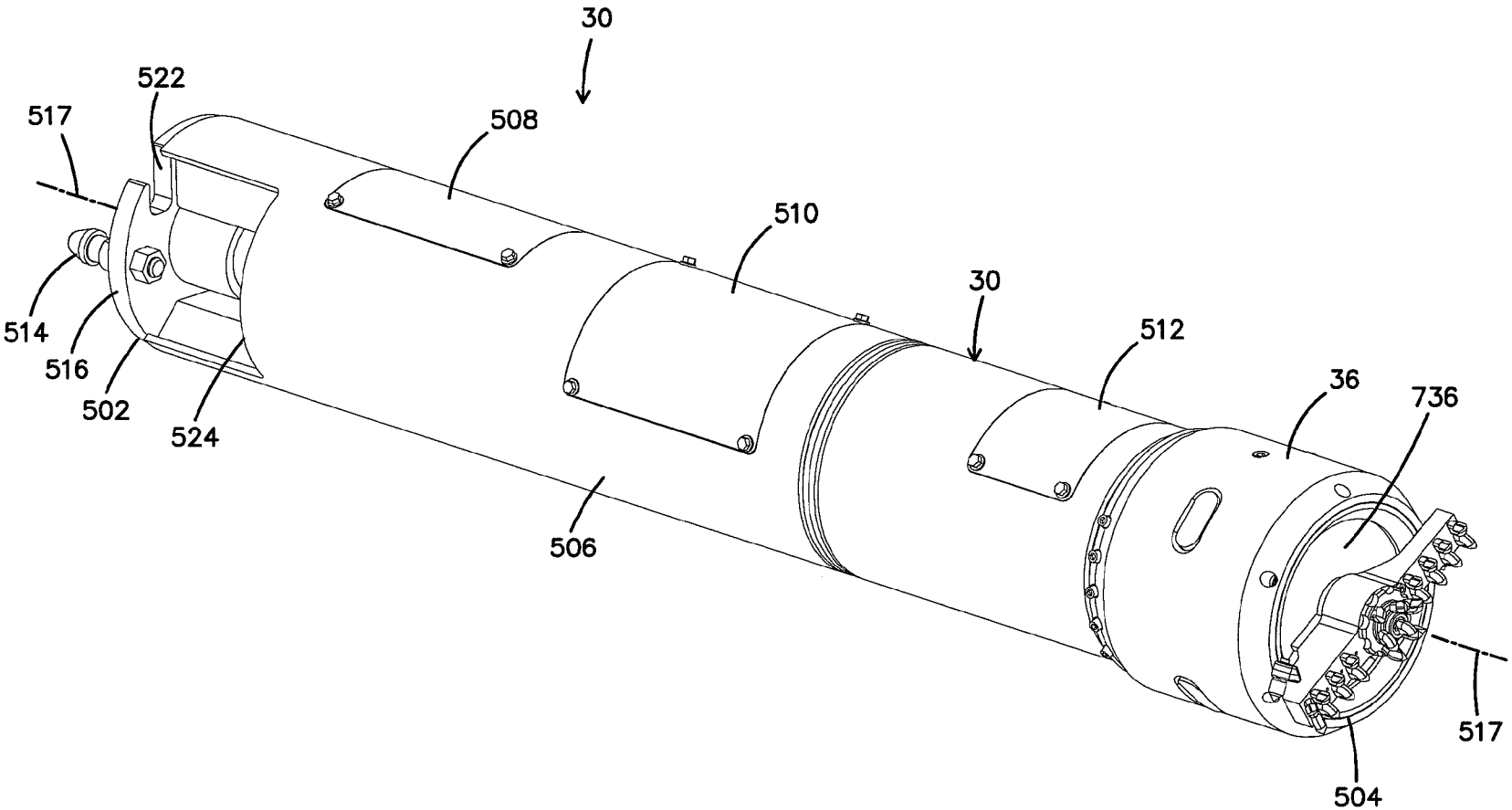
FIG. 14 is a perspective distal end view of a drill head suitable for use with the tunneling apparatus of FIG. 1.
Figure 15:
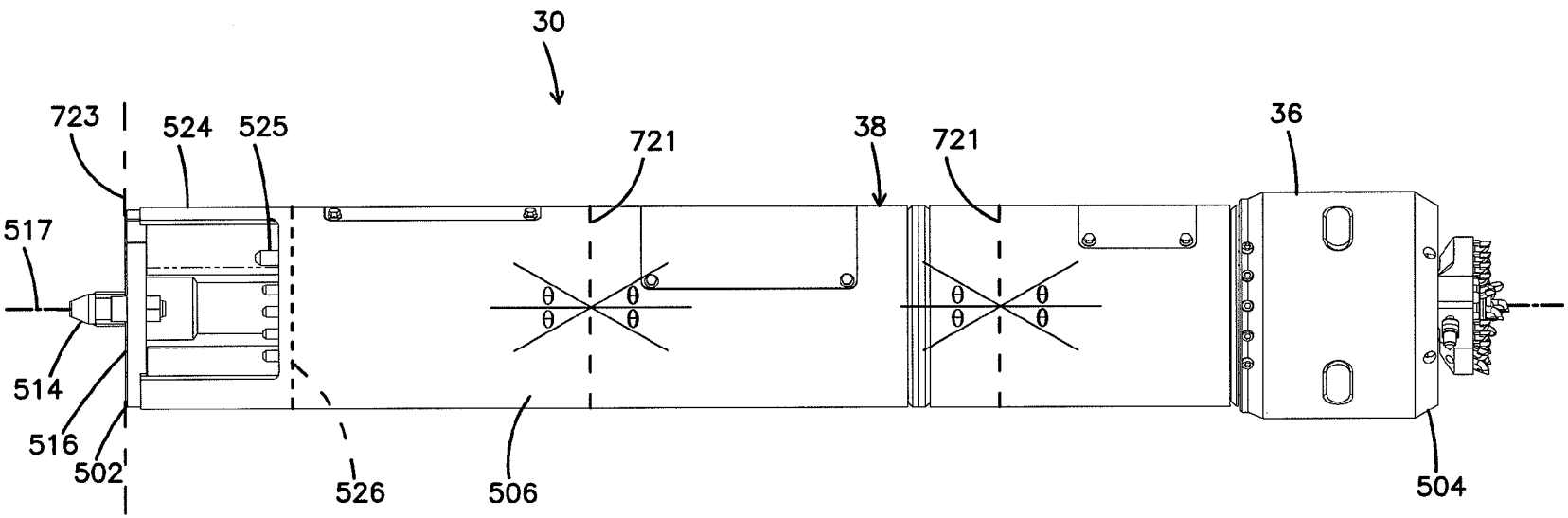
FIG. 15 is a side view of the drill head of FIG. 14.
Figure 21:
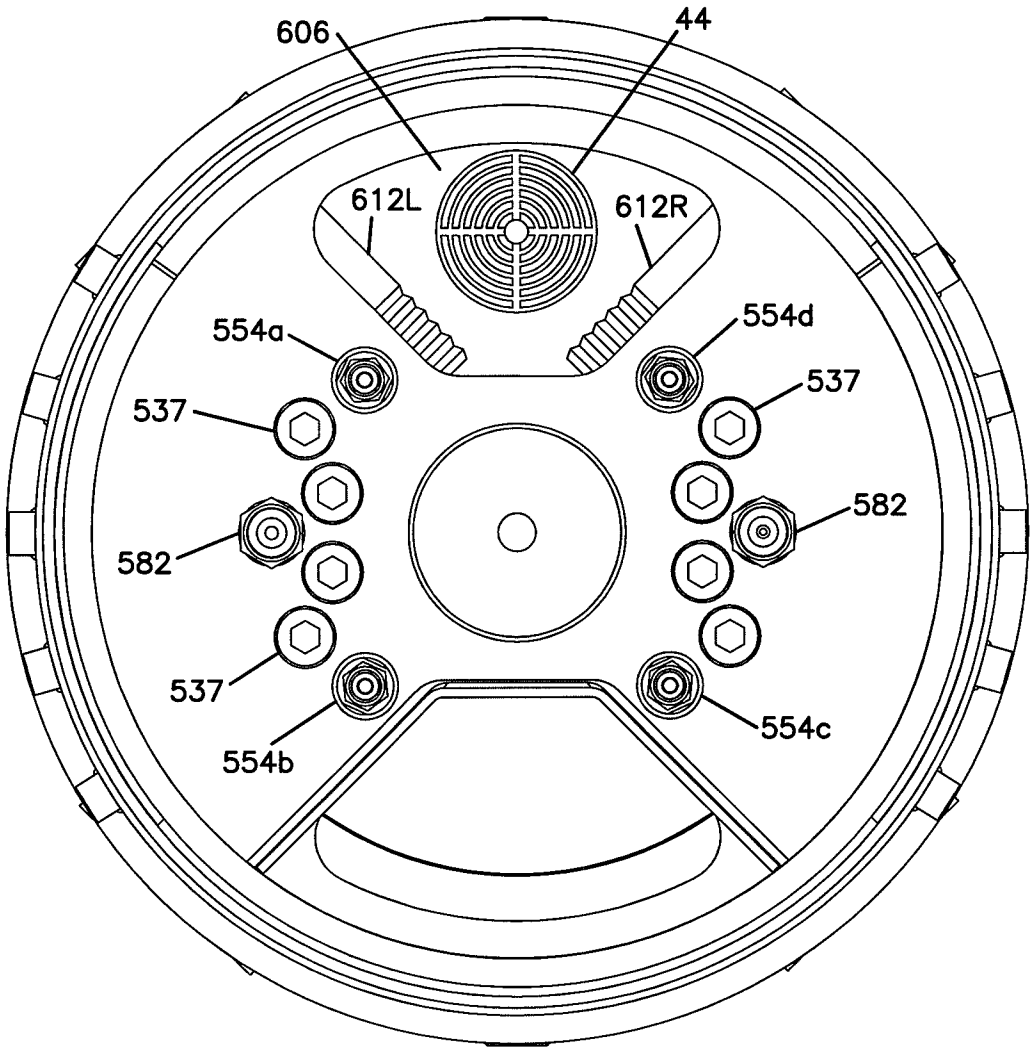
FIG. 21 is a cross-sectional view taken along section line 21-21 of FIG. 20.
Figure 22:
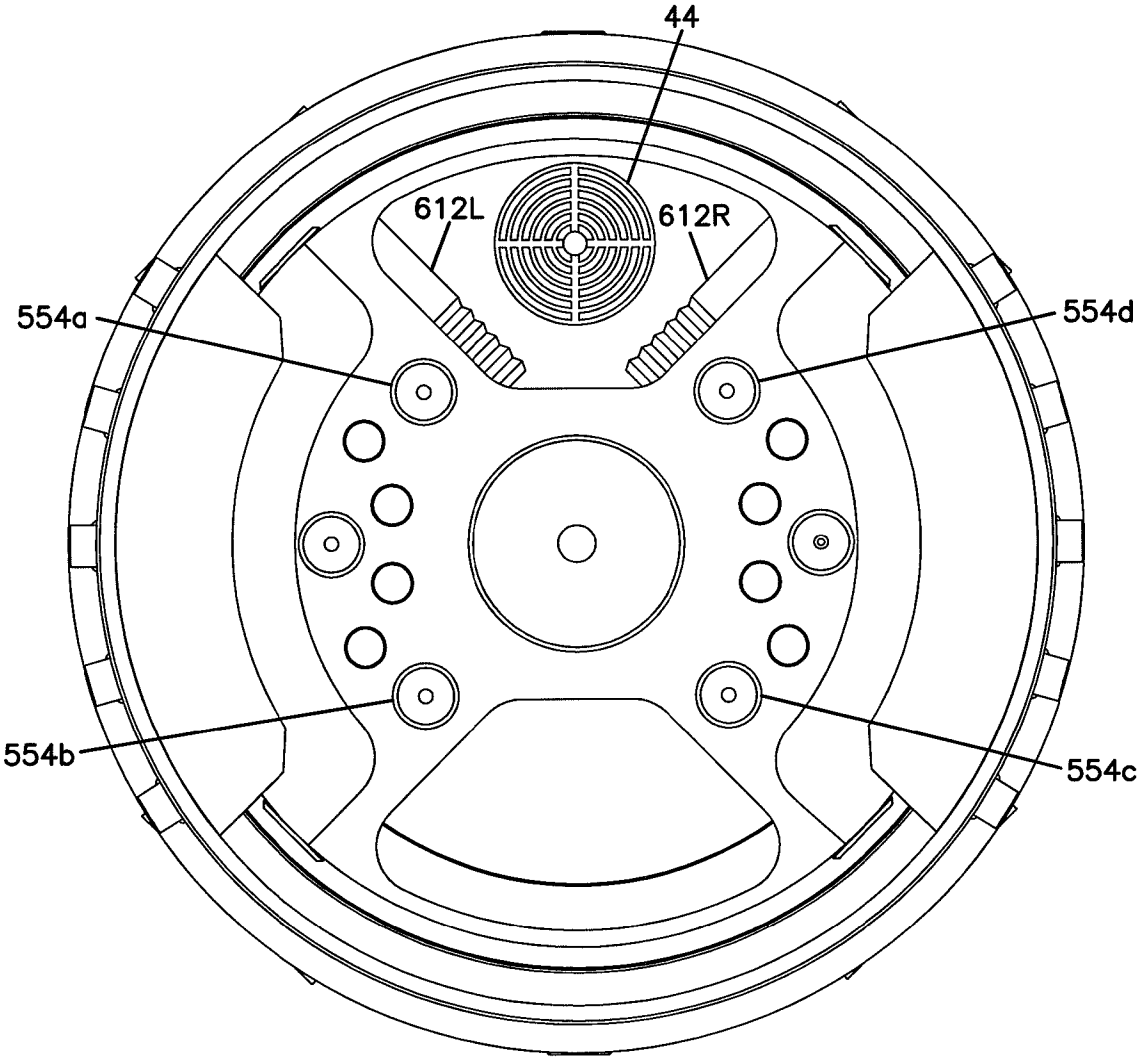
FIG. 22 is a cross-sectional view taken along section line 22-22 of FIG. 20.

FIGS. 14 and 15 depict an example embodiment of the drill head 30 of the tunneling apparatus 20. The drill head 30 is elongated on a central longitudinal axis 517 that extends from a proximal end 502 to a distal end 504 of the drill head 30. The axis 517 of the drill head 30 is preferably coaxially aligned with the overall central axis defined by the pipe sections 22 of the drill string 24. The cutting unit 34 and the steering shell 36 are mounted at the distal end 504 of the drill head 30. The main body 38 of the drill head 30 includes a cylindrical outer cover 506 that extends generally from the steering shell 36 to the proximal end 502 of the drill head 30. The steering shell 36 has a larger outer diameter than the outer diameter of the cover 506. The cover 506 has a plurality of removable access panels 508, 510 and 512 that can be removed to facilitate accessing the interior of the drill head 30. The main body 38 of the drill head 30 also includes a plurality of mechanically interconnected plates or modules 536*a*-536*f* (see FIG. 16) that are mechanically anchored/fixed to the distal end of the outer cover 506. The modules 536*a*-536*f* are fixed relative to one another (e.g., by fasteners, welding or other techniques) and the steering shell 36 is mounted over the modules 536*a*-536*f*. As shown at FIG. 21, axially extending fasteners 537 are used to fix the modules 536*a*-536*f* together.

The proximal end 502 of the drill head 30 is configured to be mechanically coupled to the distal end of the of the distal-most pipe section 22 of the drill string 24. For example, the proximal end 502 of the drill head 30 includes two projections 514 positioned on diametrically opposite sides of the center axis 517 of the drill head 30. The projections 514 project proximally outwardly from an end plate 516 mounted at the proximal end 502 of the drill head 30. The projections 514 are configured to be received and latched within the projection receptacles 200 provided at the distal end of the distal-most pipe section 22 of the drill string 24.

The proximal end 502 of the drill head 30 is also configured to provide a torque transmitting connection between the drive stem 46 of the drill head 30 and the drive shaft 26 of the distal-most pipe section. For example, the drive stem 46 of the drill head 30 also includes a male torque transferring feature 518 (e.g., a hex-driver) that is in alignment with the central axis 517 of the drill head 30 and projects axially outwardly from the end plate 516 in a proximal direction. When the drill head 30 is coupled to the distal-most pipe section 22, the male torque transferring feature 518 is received within the female torque transmitting feature 192 (e.g., a hex receptacle) provided at the distal end of the distal-most pipe section 22 of the drill string 24 such that torque can be transferred from the drive shaft 26 of the distal-most pipe section 22 to the drive stem 46.

The end plate 516 of the drill head 30 defines a notch 522 (see FIG. 14) that extends axially through the end plate 516 and has an open side that faces outwardly from the circumference of the end plate 516. When the drill head 30 is coupled to the distal-most pipe section, the notch 522 co-axially aligns with the open-sided passage section 130 defined by the distal-most pipe section 22. The notch 522 is in communication with an open region 524 (e.g., a cut-away region) in the cover 506 of the drill head 30. The open region 524 and notch 522 facilitate routing components (e.g., control lines, data lines, hydraulic lines, etc.) from the open-sided passage section 130 into the interior of the drill head 30. Once the components have been routed into the open region 524, the components can be routed through one or more fittings 525 (see FIGS. 15 and 27) provided on a wall 526 separating the open region 524 from the remainder of the interior of the drill head 30.

Figure 16:
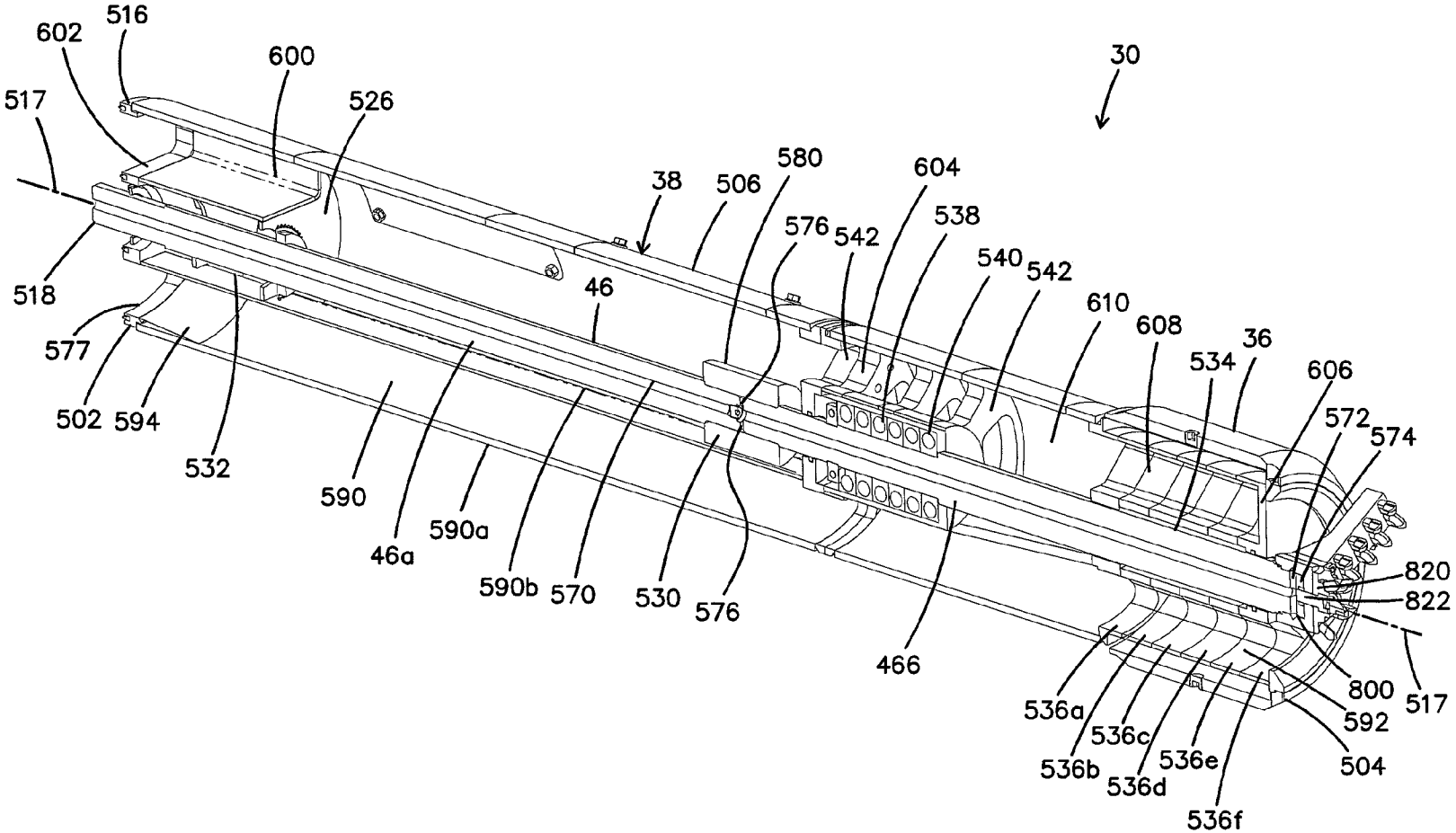
FIG. 16 is a perspective, cross-sectional view of the drill head of FIG. 14 with the drill head being cut along a vertical cross-sectional plane that bisects the drill unit.

Referring to FIG. 16, the drive stem 46 of the drill head 30 extends along the central longitudinal axis 517 of the drill head 30 from the proximal end 502 to the distal end 504. The drive stem 46 includes a proximal length 46*a* joined to a distal length 46*b* by a torque transferring coupler 530. A proximal end portion of the drive stem 46 is supported within radial bearings 532 (e.g., bushings) mounted within a collar secured to the end plate 516. A distal end portion of the drive stem 46 is supported within radial bearings 534 (e.g., bushings) mounted within a bore defined by the plurality of interconnected modules 536*a*-536*f*. The drive stem 46 is also supported by an axial bearing pack 538 at an intermediate location along the length of the drive stem 46. The axial bearing pack 538 supports thrust and pull-back loading (e.g., compressive and tensile loading) applied to the drive stem 46. It is preferred for the axial bearing pack to be offset from the radial bearings 534 and also proximally offset from the distal end 504 of the drill head 30. In a preferred embodiment, the axial bearing pack 538 is offset an axial distance S1 of at least 12 inches or at least 18 inches from the distal end of the main body of the drill head 30, and is offset an axial distance S2 of at least 12 inches from the radial bearings 534. The axial bearing pack 538 includes a plurality of axial bearings supported within a sleeve 540 that is anchored to the outer covering 506 by a plurality of reinforcing plates 542. The radial bearings 532, 534 are configured to transfer a majority of the radial load transferred between the main body 38 of the drill head 30 and the drive stem 46, and the axial bearing pack 538 is configured to transfer a majority of the axial loading (e.g., thrust or pull-back) transferred between the drive stem 46 and the main body 38 of the drill head 30.

Figure 20:
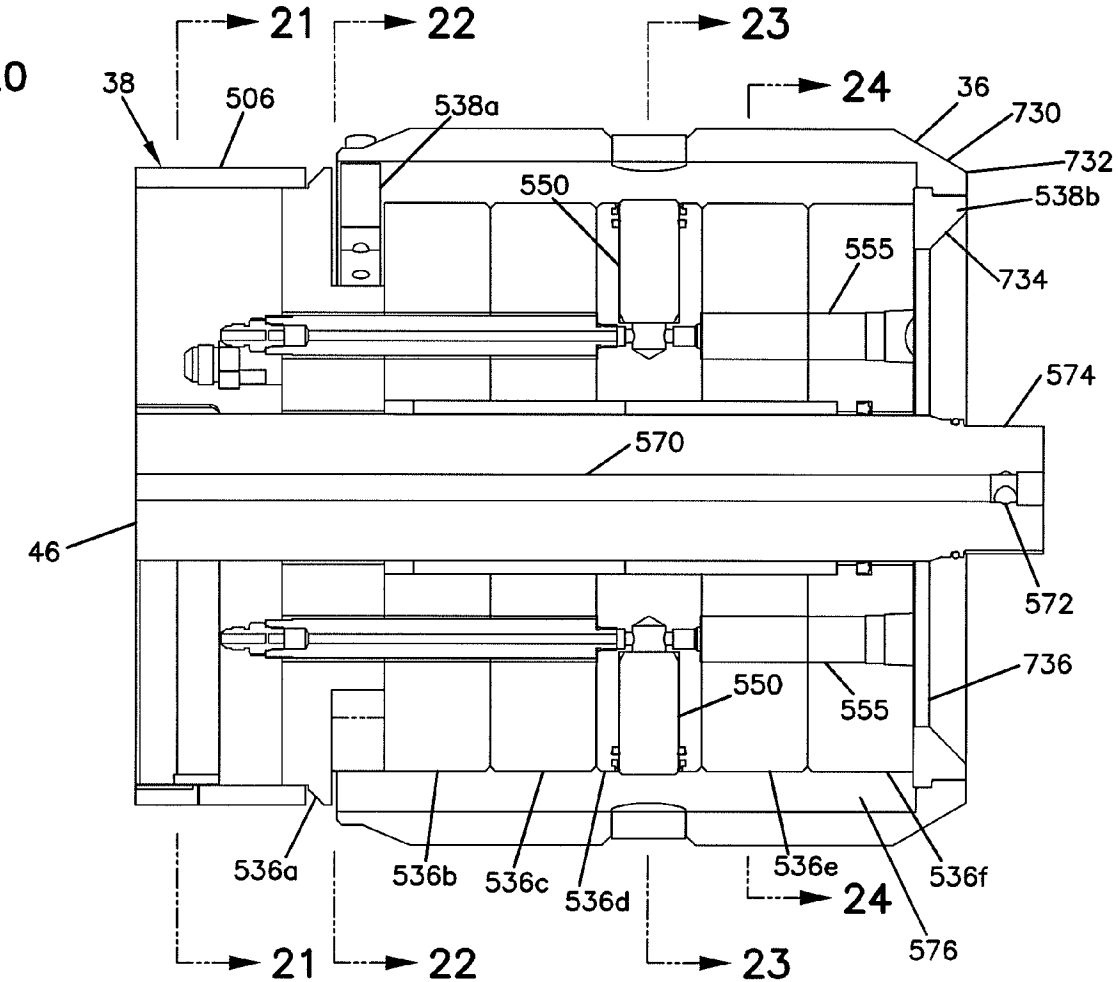
FIG. 20 is a side, cross-sectional view of a distal end portion of the drill head of FIG. 14 with the distal end portion of the drill head being cut along a vertical cross-sectional plane that extends along a central longitudinal axis of the drill head and bisects the distal end portion of the drill head.

Referring to FIG. 20, the steering shell 36 of the drill head is generally cylindrical and is mounted over the modules 536*a*-536*f* at the distal end of the drill head 30. To promote steering, the steering shell 36 is radially movable relative to the modules 536*a*-536*f* of the main body 38. In one embodiment, the steering shell 36 is radially movable in 360 degrees relative to the modules 536*a*-536*f*. Shell retainers 538*a*, 538*b* in the form of rings or partial rings are secured to proximal and distal ends of the steering shell 36. The rings radially overlap the module 536*b* and the module 536*f*. Interference between the shell retainers 538*a*, 538*b* and the modules 536*b*-536*f* limits axial movement of the steering shell 36 relative to the main body 38.

Relative radial movement between the main body 38 of the drill head 30 and the steering shell 36 is controlled by radial pistons 550 mounted within radial piston cylinders 552*a*-552*d* (see FIG. 23) defined within the module 536*d*. The piston cylinders 552*a*-552*d* are angularly spaced from one another by approximately 90 degrees about the central longitudinal axis 517. The pistons 550 are extended and retracted by fluid pressure (e.g., hydraulic fluid pressure) provided to the piston cylinders 552*a*-552*d* through axial hydraulic fluid passages 554*a*-554*d* defined by the modules 536*a*-536*d*. A hydraulic fluid bleed passage 555 is also defined through the modules 536*e* and 536*f* for each piston cylinder 552*a*-552*d* (only two passages are shown at FIG. 20). The bleed passages 555 are plugged when it is not needed to bleed the hydraulic fluid lines corresponding to the steering system.

Figure 23:
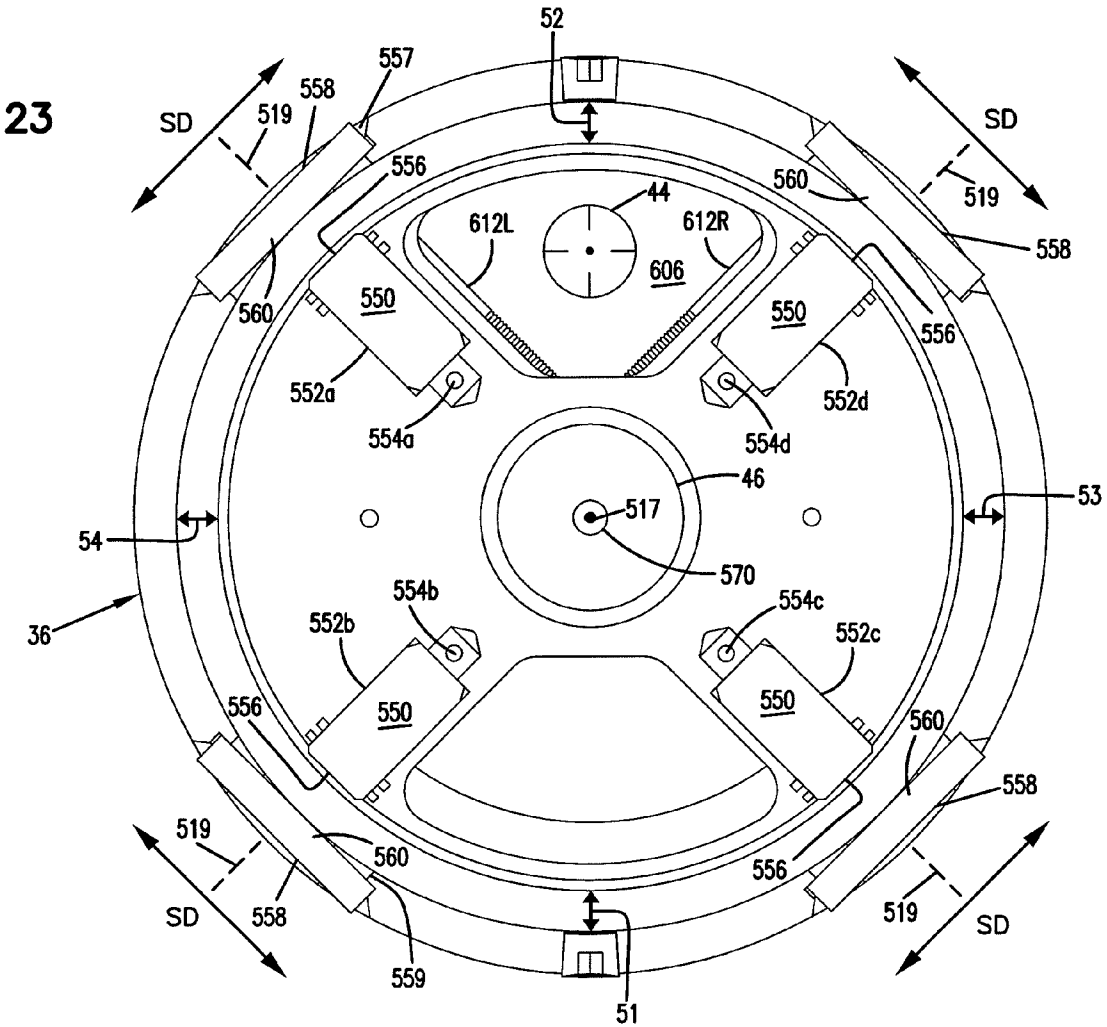
FIG. 23 is a cross-sectional view taken along section line 23-23 of FIG. 20.
Figure 24:
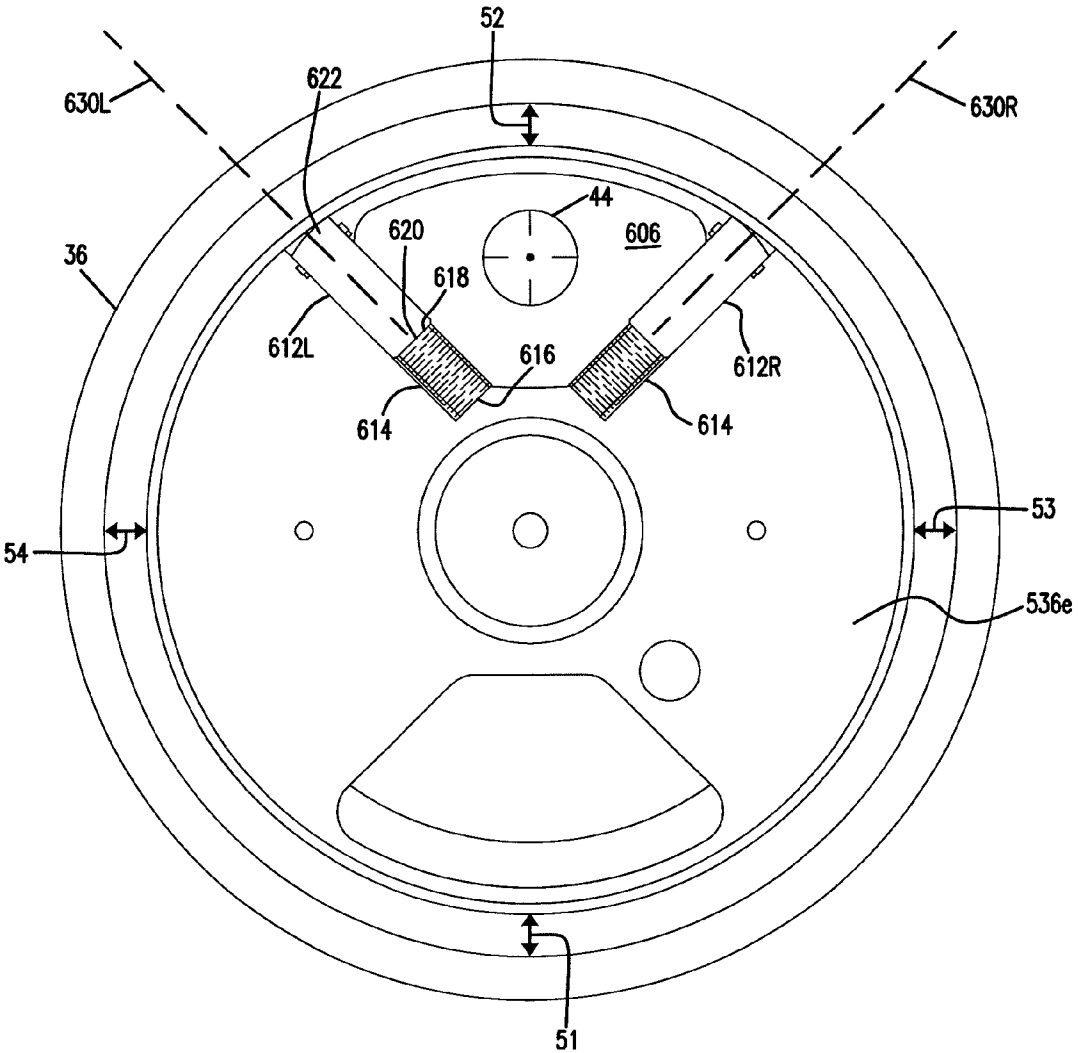
FIG. 24 is a cross-sectional view taken along section line 24-24 of FIG. 20.
Figure 25:
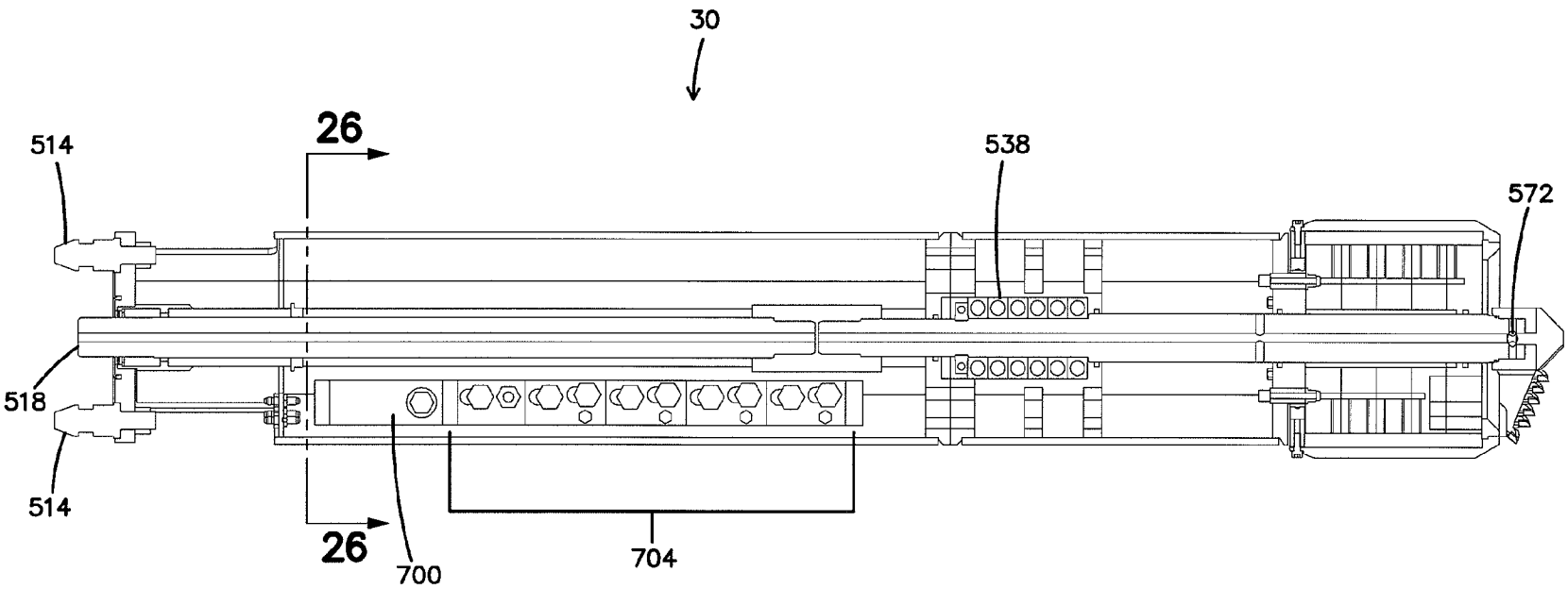
FIG. 25 shows a top cross-sectional view of the drill head of FIG. 14 with the drill head cut along a horizontal cross-sectional plane that bisects the drill head.
Figure 26:
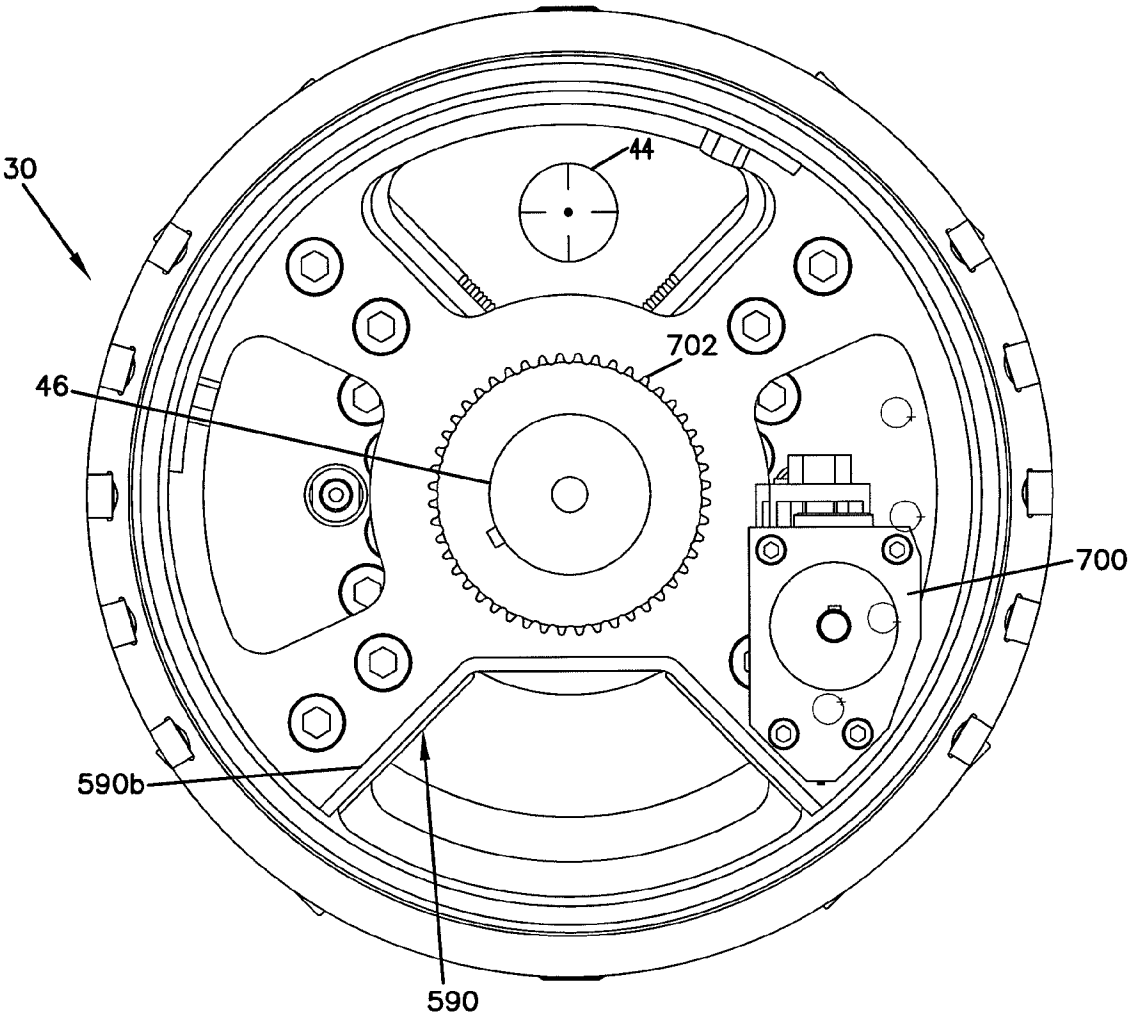
FIG. 26 is a cross-sectional view taken along section line 26-26 of FIG. 25.

When the pistons 550 are extended, outer ends 556 of the pistons 550 engage inner contact surfaces 560 of contact pads 558 of the steering shell 36. The inner surfaces 560 preferably are flat when viewed in a cross-section taken along a plane perpendicular to the central axis 517 of the drill head 30 (see FIG. 23). Thus, the surfaces 560 preferably include portions that do not curve as the portions extend generally in a shell sliding direction SD. The slide directions SD are defined within a plane generally perpendicular (i.e., perpendicular or almost perpendicular) to the central longitudinal axis 517 of the drill head 30. The slide directions SD are also generally perpendicular to central longitudinal axes 519 defined by the radial pistons 550. As shown at FIG. 23, the contact pads 558 are formed by inserts secured within openings 559 defined by a main body of the steering shell 36. Also, the inner contact surfaces 560 are depicted as being tangent to a curvature along which the inner surface of the main body of the steering shell 36 extends.

While it is preferred for the inner contact surfaces 560 to be flat in the orientation stated above, it will be appreciated that in other embodiments the surfaces 560 could be slightly curved or otherwise non-flat in the slide orientation SD. It is preferred for the inner contact surfaces 560 to have a flattened configuration in the slide direction SD as compared to a curvature along which the inner surface of the main body of the shell 36 extends. By flattened configuration, it is meant that the inner contact surfaces are flatter than the inner surface of the main body of the shell 36 in the slide direction SD. The flattened configuration of the inner contact surfaces 560 of the contact pads allows the steering shell 36 and the outer ends 556 of the radial pistons 550 to slide more freely or easily relative to one another in response to extension and retraction of selected ones of the radial pistons 550. Thus, the flattened configuration of the contact pads 558 along the slide directions SD assists in preventing binding during repositioning of the shell 36.

In other embodiments, pneumatic pressure can be used to move the pistons. In still other embodiments, structures other than pistons can be used to generate relative lateral movement between the steering shell 36 and the main body 38 (e.g., bladders that can be inflated and deflated with air or liquid, screw drives, mechanical linkages, etc.).

The drive stem 46 also defines a central passage 570 that forms the final leg of the central fluid flow passage 45 defined by the drill string 24. As shown at FIG. 20, the distal end of the drive stem 46 includes a male torque transferring feature 574 in which radial fluid flow passages 572 are defined. The radial fluid flow passages 572 extend radially outwardly from the central passage 570 to an exterior of the male torque transferring feature 574. The radial fluid flow passages 572 are adapted to direct fluid flow to fluid passages defined through the cutting unit 34. The drill head 30 is also configured to direct drilling fluid into a region 576 defined between the modules 536*b*-536*f* and the inner surface of the steering shell 36 to assist in keeping the region 576 free of debris. For example, the drive stem 46 defines radial passages 578 at a location just proximal to the module 536*a*. A fluid swivel 580 is provided to provide a fluid seal around the exterior of the drive stem 46 on proximal and distal sides of the radial passages 578 while still allowing the drive stem 46 to freely rotate about the longitudinal axis 517. From the fluid swivel 580, drilling fluid can be directed (e.g., by hoses) to passages 582 (see FIG. 21) that extend axially and then radially through at least some of the modules 536*a*-536*f*. The passages 582 can extend to discharge ports located at the outer circumferential surfaces of at least some of the modules 536*a*-536*f*. The discharge ports are positioned to dispense drilling fluid into the region 576 between the inner surface of the steering shell 36 and the outer circumferential surfaces of the modules 536*a*-536*f*.

Referring back to FIGS. 16 and 17, the drill head 30 also includes a vacuum channel structure 590 that coaxially aligns with the first internal passage sections 170 of the pipe sections 22 of the drill string 24 such that the channel structure 590 forms the last leg of the vacuum passage 47 of the tunneling/drilling apparatus 20. The vacuum channel structure 590 extends from the proximal end 502 to the distal end 504 of the drill head 30. The distal-most portion of the vacuum channel structure 590 is formed by a passage section 592 that extends axially through the modules 536*a*-536*f*. Because the axial bearing pack 538 has been proximally offset from the distal end of the drill head 30, it is possible to maximize the size (i.e., the transverse cross-sectional area) of the passage section 592 extending through the modules 536*a*-536*f* thereby reducing the likelihood of plugging at the distal-most end of the vacuum passage 47. The passage section 592 is defined by a plurality of co-axially aligned openings defined by the modules 536*a*-536*f*. The vacuum channel structure 590 also includes a ramp 594 providing a transition to an opening 577 defined through the end plate 516. When the drill head 30 is coupled to the distal end of the distal-most pipe section 22 of the drill string 24, the proximal face of the end plate 516 abuts against distal face of the end plate 126 of the distal-most pipe section 22 and the opening 577 co-axially aligns with the opening 175 in the distal end plate 126 of the distal-most pipe section 22. A first portion 590*a* of the channel structure 590 is defined by the cover 506 while a second portion 590*b* is provided by a channel member that is affixed to the cover 506 and that isolates the vacuum passage 47 from the remainder of the interior of the drill head 30.

Figure 19:
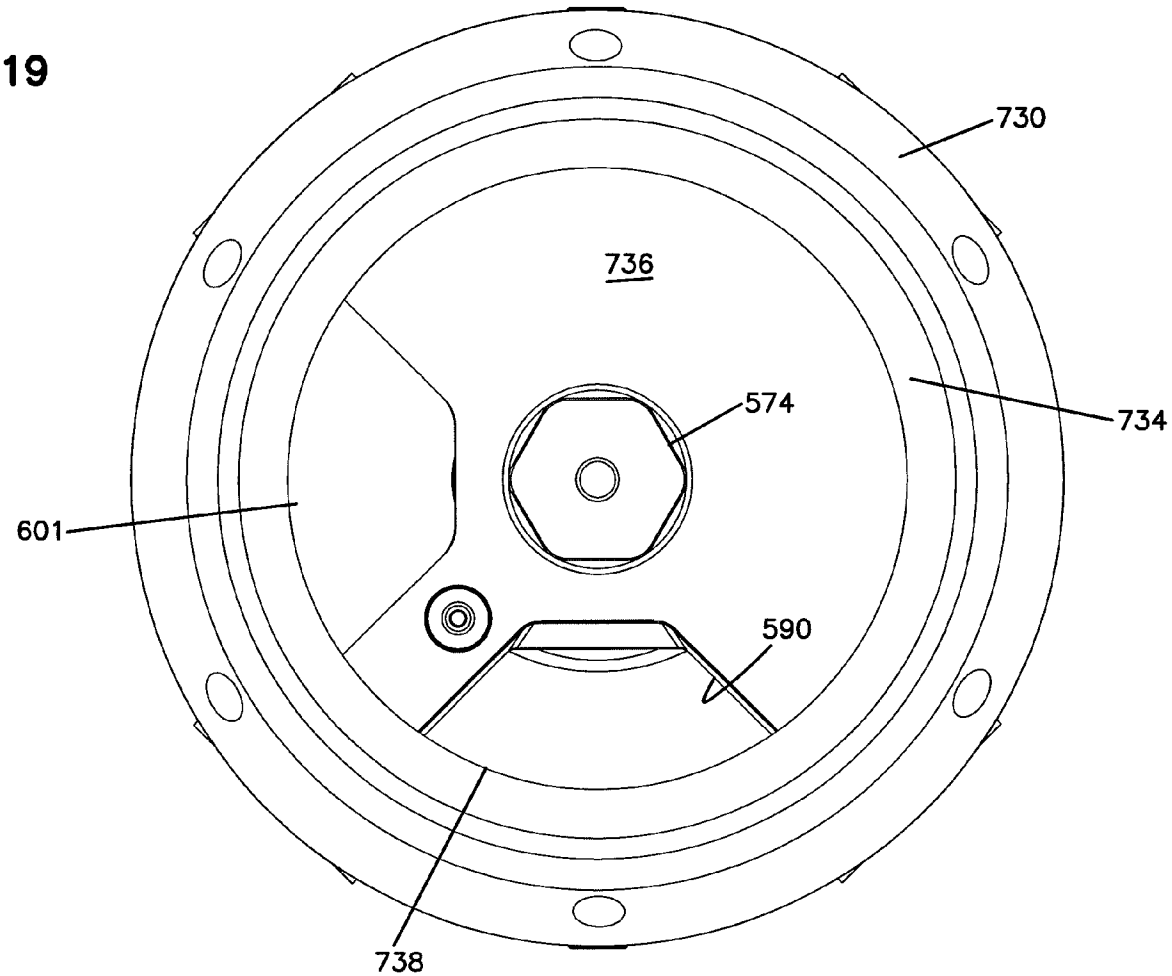
FIG. 19 is a distal end view of the drill head of FIG. 14 with the cutting unit removed.

The drill head 30 also includes an air passage channel structure 600 that forms a portion of the air passage 43 of the drill string 24. The air passage channel structure 600 co-axially aligns with an opening 602 defined through the end plate 516. When the drill head 30 is coupled to the distal end of the distal-most pipe section 22 of the drill string 24, the opening 602 co-axially aligns with the opening 181 in the distal end plate 126 of the distal-most pipe section 22. The air passage channel structure 600 also co-axially aligns with openings 604 defined axially through the reinforcing plates 542 supporting the axial bearing pack 538 and further co-axially aligns with a passage section 608 defined axially through the modules 536*a*-536*e*. The passage section 608 is formed by co-axially aligned openings defined by the modules 536*a*-536*e*. Air traveling through the air passage 43 of the drill string 24 enters the interior of the drill head 30 through the channel structure 600, moves distally through the interior of the drill head 30 and exits the drill head 30 at opening 601 (see FIG. 19). Opening 601 is defined through the module 336*f* and is in fluid communication with the passage section 608 extending through the modules 536*a*-536*e*.

The laser target 44 of the tunneling apparatus 20 is mounted to a wall 606 of the module 536*f*. The target 44 preferably axially aligns with the air passage channel structure 600 as well as the openings 604 defined by the reinforcing plates 542 and the passage section 608 defined by the modules 536*a*-536*e*. In this way, the laser 42 can be directed through the air passage 43 to reach the target 44. The camera 60 for viewing the target 44 is preferably mounted at a region 610 located axially between the axial bearing pack 538 and the modules 36*a*-36*f*. The panel 512 of the cover 506 is provided for accessing the camera 60. The camera 60 is preferably oriented to view through the passage section 608 defined by the modules 536*a*-536*e* such that the camera 60 can generate an image of the target 44. In addition to generating images of the target 44, the camera also generates images of right and left steering sleeve position indicators 612R, 612L mounted in the module 536*e*. The position indicators 612R, 612L partially overlap the passage section 608 so as to be visible by the camera (i.e., the position indicators are within the field of view of the camera). The position indicators 612R, 612L are biased outwardly from the module 536*e* by springs 614 into contact with the inner surface of the steering shell 36. Base ends 616 of the springs 614 are supported against the module 536*e* and outer ends 618 of the springs 614 are biased against inner 620 ends of the position indicators 612R, 612L. Outer ends 622 of the position indicators 612R, 612L preferably engage the steering shell 36. For example, the outer ends 622 can engage the inner surface of the steering shell 36.

During steering, the pistons 550 cause relative radial movement between the steering shell 36 and the module 536*e*. When this relative radial movement occurs, the position indicators 612R, 612L also change position relative to the modules 536*a*-536*f*. For example, the position indicators 612R, 612L move along slide axes 630R, 630L in response to relative radial movement between the steering shell 36 and the modules 536*a*-536*f*. The slide axes 630R, 630L are oriented so as to have a lateral component and a vertical component (i.e., the axes 630R, 630L are angled relative to both horizontal and vertical).

The direction the position indicators 612R, 612L move along the slide axes 630R, 630L is dependent upon the direction of relative radial movement between the steering shell 36 and the modules 536*a*-536*f*. For example, if a vertical spacing S1 between the bottom sides of the modules 536*a*-536*f* and the bottom of the steering shell 36 is decreased by the pistons 550, the springs 614 cause the position indicators 612R, 612L to move outwardly (i.e., away from the modules 536*a*-536*f*) along their respective axis 630R, 630L. In contrast, if a vertical spacing S2 between the top sides of the modules 536*a*-536*f* and the top of the steering shell 36 is decreased by the pistons 550, the indicators 612R, 612L move inwardly against the bias of the springs 614 (i.e., toward the modules 536*a*-536*f*) along their respective axis 630R, 630L. If a lateral spacing S3 between the right sides of the modules 536*a*-536*f* and the right side of the steering shell 36 is increased by the pistons 550, the indicator 612R is moved outwardly along axis 630R by its corresponding spring 614 (i.e., away from the modules 536*a*-536*f*) and indicator 612L is moved inwardly along axis 630L (e.g., toward the modules 536*a*-536*f*) against the bias of its corresponding spring 614. If a lateral spacing S4 between the left sides of the modules 536*a*-536*f* and the left side of the steering shell 36 is increased by the pistons 550, the indicator 612L is moved outwardly along axis 630L by its corresponding spring 614 (i.e., away from the modules 536*a*-536*f*) and indicator 612R is moved inwardly along axis 630R (e.g., toward the modules 536*a*-536*f*) against the bias of its corresponding spring 614.

An operator viewing the position indicators 612R, 612L while steering the drill string 24 can confirm at least two things. First, movement of the position indicators 612R, 612L indicates that the relative movement between the shell 36 and the modules 536*a*-536*f* is indeed occurring (i.e., the steering shell 36 is not jammed relative to the main body of the drill head 30). Second, by noting the position of the indicators 612R, 612L at a given time relative to the modules 536*a*-536*f* or other feature of the drill head main body 38, the operator can confirm that the actual relative position between the steering shell 36 and the main body 38 of the drill head 30 matches the desired relative position between the steering shell 36 and the main body 38 of the drill head 30. A measuring scale or other markings may be provided on the main body 38 (e.g., on the module 536*e*) adjacent to position indicators 612R, 612L at a location within the field of view of the camera 60 so that an operator can quickly ascertain the relative positions of the position indicators 612R, 612L as compared to the main body 38.

Referring to FIGS. 25-28, a hydraulic pump 700 is mounted within the interior region of the drill head 30 for pumping hydraulic fluid used to operate the steering system. In a preferred embodiment, torque is transferred from the drive stem 46 of the drill head 30 to the hydraulic pump 700 to power the hydraulic pump 700. For example, in one embodiment, a gear 702 can be mounted on the drive stem 46. A torque transferring member such as a chain can be used to transfer torque from the gear to a corresponding gear on a drive shaft of the hydraulic pump 700. It is preferred for the hydraulic pump 700 to comprise a bi-directional pump. Thus, the pump is preferably capable of pumping pressurized hydraulic fluid to the steering system regardless of whether the drive stem 46 is rotated in a clockwise direction or a counter clockwise direction about it central longitudinal axis. Thus, the hydraulic pump 700 is capable of providing hydraulic pressure to the piston cylinders 552*a*-552*d* when the drive stem 46 is rotated in a clockwise direction and when the drive stem 46 is rotated in a counter clockwise direction.

The pump 700 is shown mounted within the interior region of the drill head 30 at a location where the pump 700 can be accessed through access panels 508 and 510. The pump is in fluid communication with a valve arrangement 704 that controls the flow of hydraulic fluid to the piston cylinders 552*a*-552*d* of the steering mechanism. For example, the valve arrangement 704 can include hydraulic fluid ports 705*a*-705*d* that are respectively connected (e.g., with hydraulic fluid hoses) to the fluid passages 554*a*-554*d* in fluid communications with the piston cylinders 552*a*-552*d*. The valve arrangement 704 preferably is adapted to selectively place one or more of the piston cylinders 552*a*-552*d* in fluid communication with the pressurized sides of the hydraulic pump 700, and to selectively place one or more of the piston cylinders 552*a*-552*d* in fluid communication with an intake side of the pump 700. Control lines for controlling the pump 700 and valve arrangement 704 can be routed through the external open sided passage defined by the open-sided passage sections 130 of the pipe sections 22 to the drill head 30.

In certain embodiments, the drill head 30 can include one or more angular transition locations (e.g., joints provided by hinges, pivots, resilient gaskets, etc.) for facilitating steering operations. The angular transition locations can be configured to allow portions of the length of the drill head 30 to become angularly offset from one another. The angular transition locations can provide regions of increased flexibility (i.e., increased bendability or increased pivotability) as compared to the remainder of the length of the drill head 30. In embodiments where the drill head 30 has more than one angular transition location, the angular transition locations can be spaced apart-from one another along the length of the drill head 30. As shown schematically at FIG. 15, two angular transition locations 721 are schematically shown. The angular transition locations 721 allow longitudinal segments of the drill head 30 on opposite sides of the angular transition locations 721 to be universally angularly offset relative to one another by an angle θ. The size of the angle θ is exaggerated in FIG. 15 for illustration purposes. An additional angular transition location 723 can be provided at the interface between the drill head 30 and the distal-most pipe section 22.

Figure 27:
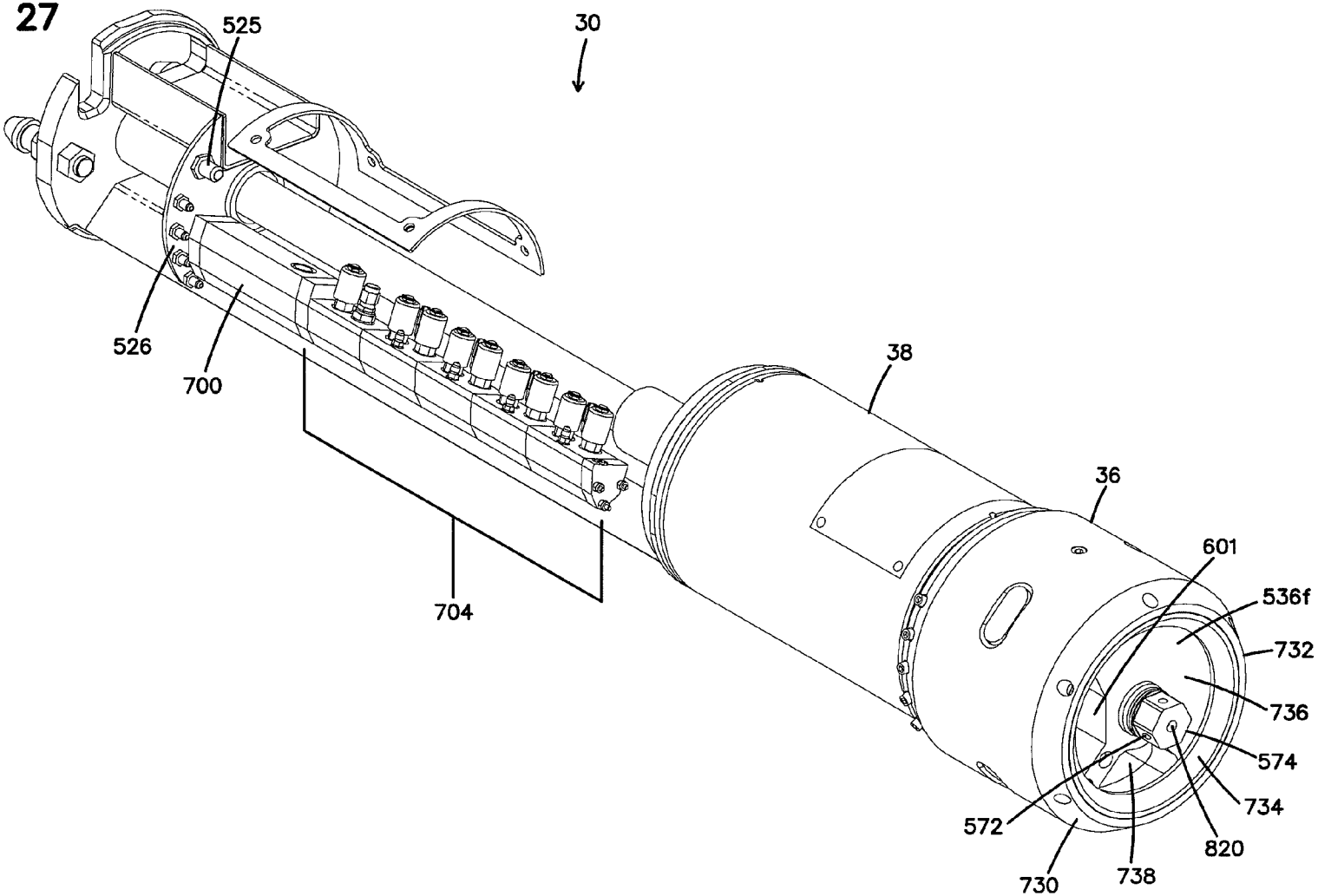
FIG. 27 is a perspective view of the drill head of FIG. 14 with portions of the outer shell removed to show an internal bi-directional pump arrangement of the drill head.
Figure 28:
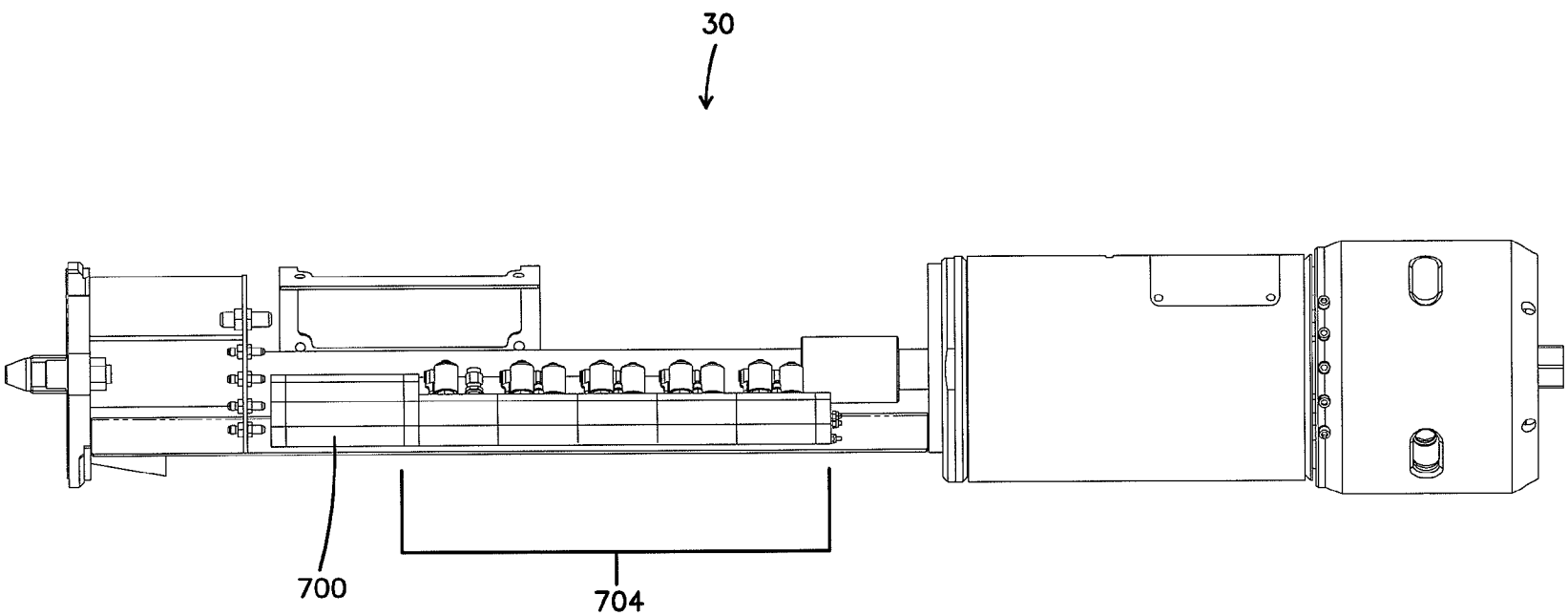
FIG. 28 is a side view of the drill head of FIG. 14 with portions of the outer shell removed to show the bi-directional pump arrangement.

Referring to FIG. 27, the distal end of the drill head 30 has a chamfered configuration. For example, the distal end of the steering shell 36 includes an outer chamfer surface 730 that provides a gradual increase in outer diameter as the outer chamfer surface 730 extends proximally from a distal-most edge 732 of the steering shell 36. The distal end of the main body 38 of the drill head 30 also includes an inner chamfer surface 734 that provides a gradual decrease in inner diameter as the inner chamfer surface 734 extends proximally from a distal-most end of the main body 38 to a generally planar distal end face 736 defined by the module 536*f*. An entrance opening 738 to the passage section 592 of the vacuum passage 47 is defined through the end face 736. The exit opening 601 for the air passage 43 is also defined through the end face 736.

Figure 29:
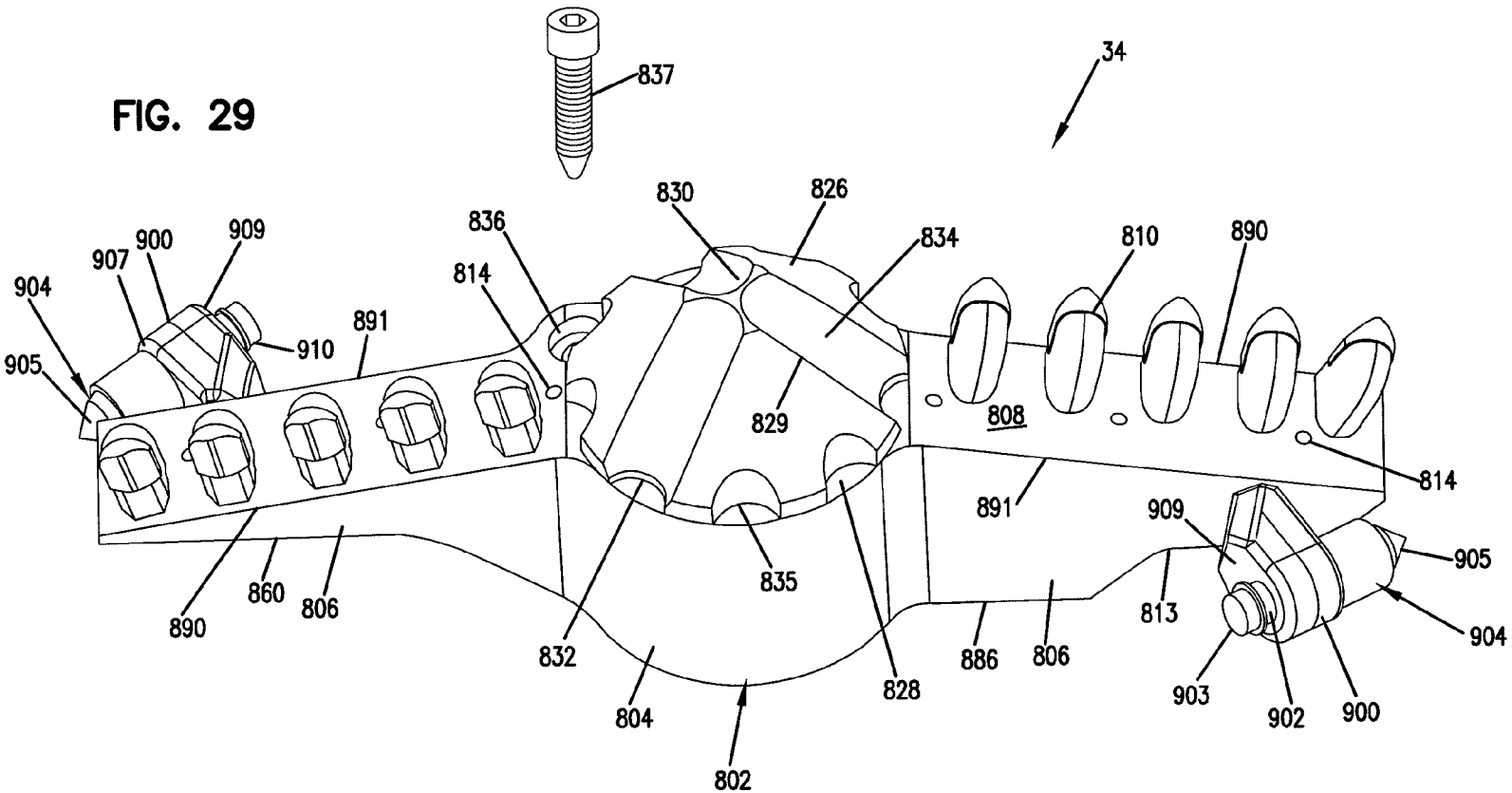
FIG. 29 is a perspective view showing a front/distal side of a first cutting unit suitable for use with the drill head of FIG. 14.

Referring to FIGS. 16 and 29-31, the male torque transferring feature 574 of the drive stem 46 is adapted to fit within a corresponding female torque transferring feature 800 (e.g., a hex socket) defined within a main body 802 of the cutting unit 34. The main body 802 of the cutting unit 34 includes a central hub portion 804 in which the female torque transferring feature 800 is provided, and a plurality of arms 806 that project radially outwardly from the hub portion 804. As shown at FIG. 29, the cutting unit 34 includes two radial arms 806 that project radially outwardly from opposite sides of the hub portion 804. Each of the radial arms 806 includes a front side 808 (see FIG. 29) at which cutting elements 810 (e.g., cutting bits, teeth or blades) are mounted and a back side 809 (see FIG. 30). The front sides 808 angle slightly in a proximal direction as the front sides 808 extend radially outwardly from the hub portion 804 (see FIG. 31). Each of the arms 806 also defines an interior radial fluid passage 812 that extends radially through the arm 806 and communicates with a plurality of outlet ports 814 provided at the front and back sides 808, 809 of the cutting arms 806. When the cutting unit 34 is mounted to the drive stem 46, the back sides 809 oppose the end face 736 (see FIG. 27) of the module 536*f* and the radial fluid passages 812 are in fluid communication with the central passage 570 defined through the drive stem 46 via the radial passages 572 defined through the male torque transferring feature 574 of the drive stem 46. The back sides 809 of the arms 806 define notches 813 (e.g., recesses) adjacent radial outermost portions of the arms 806. When the cutting unit 34 is rotated about the axis 517 of the drill head by the drive stem 46, the notches 813 move along an annular path having a portion that extends directly across the front of the entrance opening 738 of the vacuum passage 47 and the exit opening 601 of the air passage 43.

The notches 813 allow at least a portion of the back side of the hub portion 804 to be recessed proximally into the drill head 30. For example, at least a portion of the back side of the hub portion is proximally offset from the distal-most edge 732 of the steering shell 36. The notches 813 allow the back side 809 of the cutting unit 34 to be positioned in close proximity to the end face 736 of the drill head 30 and in close proximity to the entrance opening 738 to the vacuum passage 47 without causing the cutting unit 34 to interfere with the relative radial movement between the steering shell 36 and the main body 38 of the drill head 30. During normal drilling operations, the cutting unit 34 is rotated a first rotation direction (see arrow 851) about the axis 517 of the drill head 30.

The back sides 809 of the cutting arms 806 include slurry flow directing structures 852 for directing slurry flow toward the entrance opening 738 of the vacuum passage 47 when the cutting unit 34 is rotated in the first rotation direction 851. The flow directing structures 852 include distal and proximal edges 860, 862 that extend at least partially along the lengths of the arms 806. The distal edges 860 have stepped configurations that extend along perimeters of the notches 813. The flow directing structures 852 include first surfaces 852*a* and second surfaces 852*b* positioned between the distal and proximal edges 860, 862. The surfaces 852*a* are configured to direct flow in a net proximal direction toward the end face of the main body 38 and the entrance opening 738 when the cutting unit 34 is rotated in the first rotation direction 851. The first surfaces 852*a* are positioned distally with respect to the notches 813 and are positioned radially outwardly from the second surfaces 852*b*. The first surfaces 852*a* are angled to face partially in a proximal direction and partially in the first rotation direction 851. The second surfaces 852*b* are concave and are angled to face partially in a proximal direction, partially in the first rotation direction 851 and partially radially outwardly from the axis 517. The angling of the surfaces 852*b* causes slurry flow to be directed proximally and radially outwardly toward the entrance opening 738 when the cutting unit 34 is rotated in the first rotation direction 851.

The cutting arms 806 also include leading sides 880 that face in the direction of rotation 851 and trailing sides 881 that face away from the direction of rotation 851. The leading sides 880 and the trailing sides 881 extend from the front sides 808 to the back sides 809 of the arms 806 and also extend from the hub portion 804 to outer radial ends of the arms 806. The contouring provided by the surfaces 852*a*, 852*b* of the back sides 809 reduces the overall area of the leading sides 880 thereby minimizing the degree to which material collects on the leading sides 880 when the cutting unit 34 is rotated in the direction 851 about the axis 517 of the drill head 30.

The back sides 809 of the cutting arms 806 also include rear faces 882*a*, 882*b* that face in a rearward/proximal direction and are aligned along planes that are generally perpendicular (i.e., perpendicular or substantially perpendicular) to the axis of rotation 517. The rear faces 882*a* are forwardly and radially outwardly offset from the rear faces 882*b*. Offset surfaces 883 extend forwardly and radially outwardly from the rear faces 882*b* to the rear faces 882*a*. The rear faces 882*a* extend from the offset surfaces 883 to the edges 874. The offset surfaces 883 and the rear faces 882*a* define at least portions of the notches 813. Ports 814 are defined through the rear faces 882*a*, 882*b*. The rear faces 882*a*, 882*b* and the offset surfaces 883 extend from the proximal edges 862 of the flow directing structures 852 to edges 886 defining the trailing sides 881 of the cutting arms 806. Edges 860 define a boundary between the leading sides 880 of the cutting arms 806 and the flow directing structures 852. Edges 862 define a boundary between the flow directing structures 852 and the surfaces 882*a*, 882*b* and 883. Edges 890 define a boundary between the leading sides 880 of the cutting arms 806 and the front sides 808 of the cutting arms 806. Edges 891 define a boundary between the trailing sides 881 of the cutting arms 806 and the front sides 808 of the cutting arms 806.

The cutting arms 806 also include end surfaces 870 having distal edges 872 and proximal edges 874. The distal edges 872 are outwardly radially offset from the proximal edges 874 relative to the axis of rotation 851 to provide a relief behind the distal edges 872.

Figure 30:
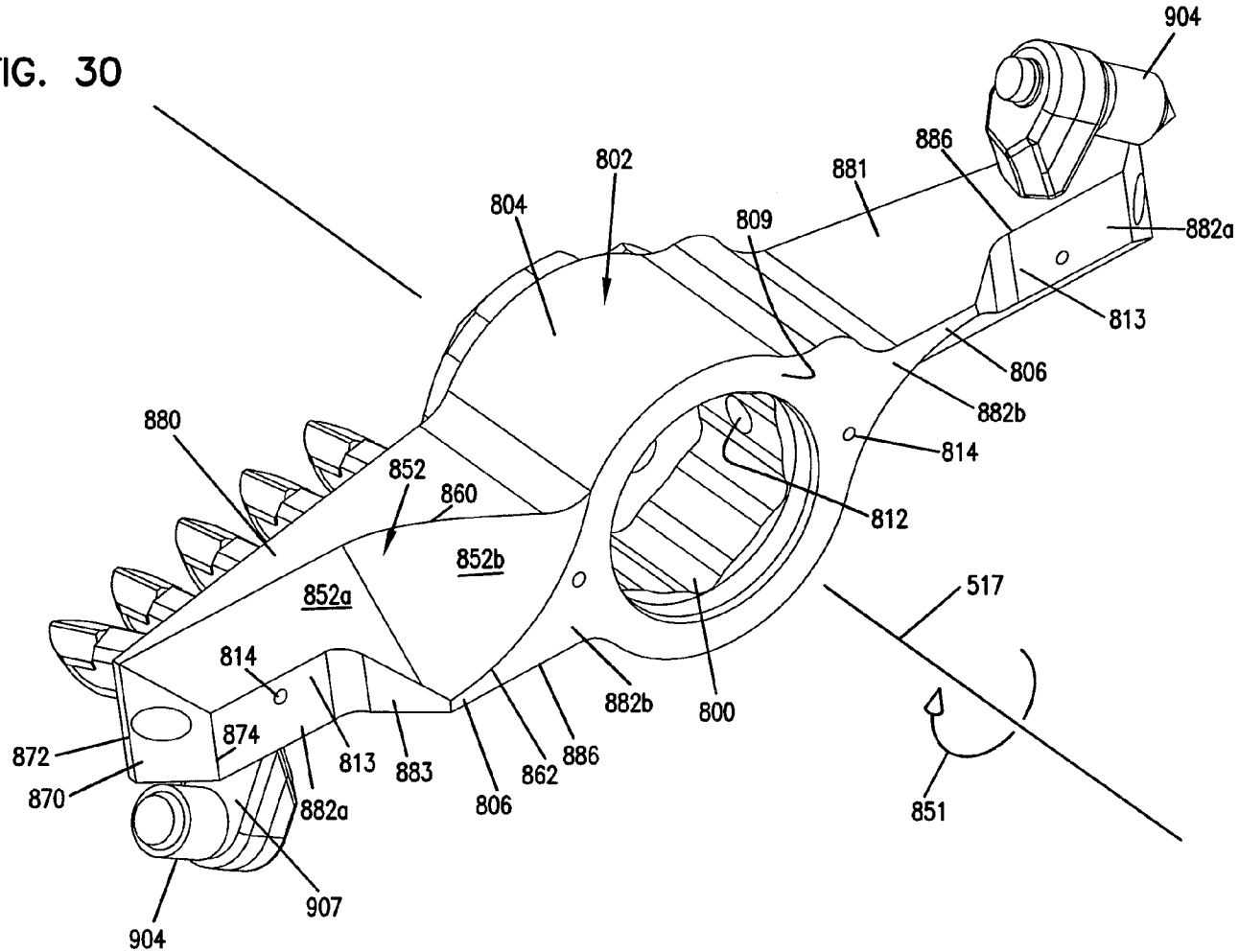
FIG. 30 is a perspective view showing a back/proximal side of the cutting unit of FIG. 29.
Figure 31:
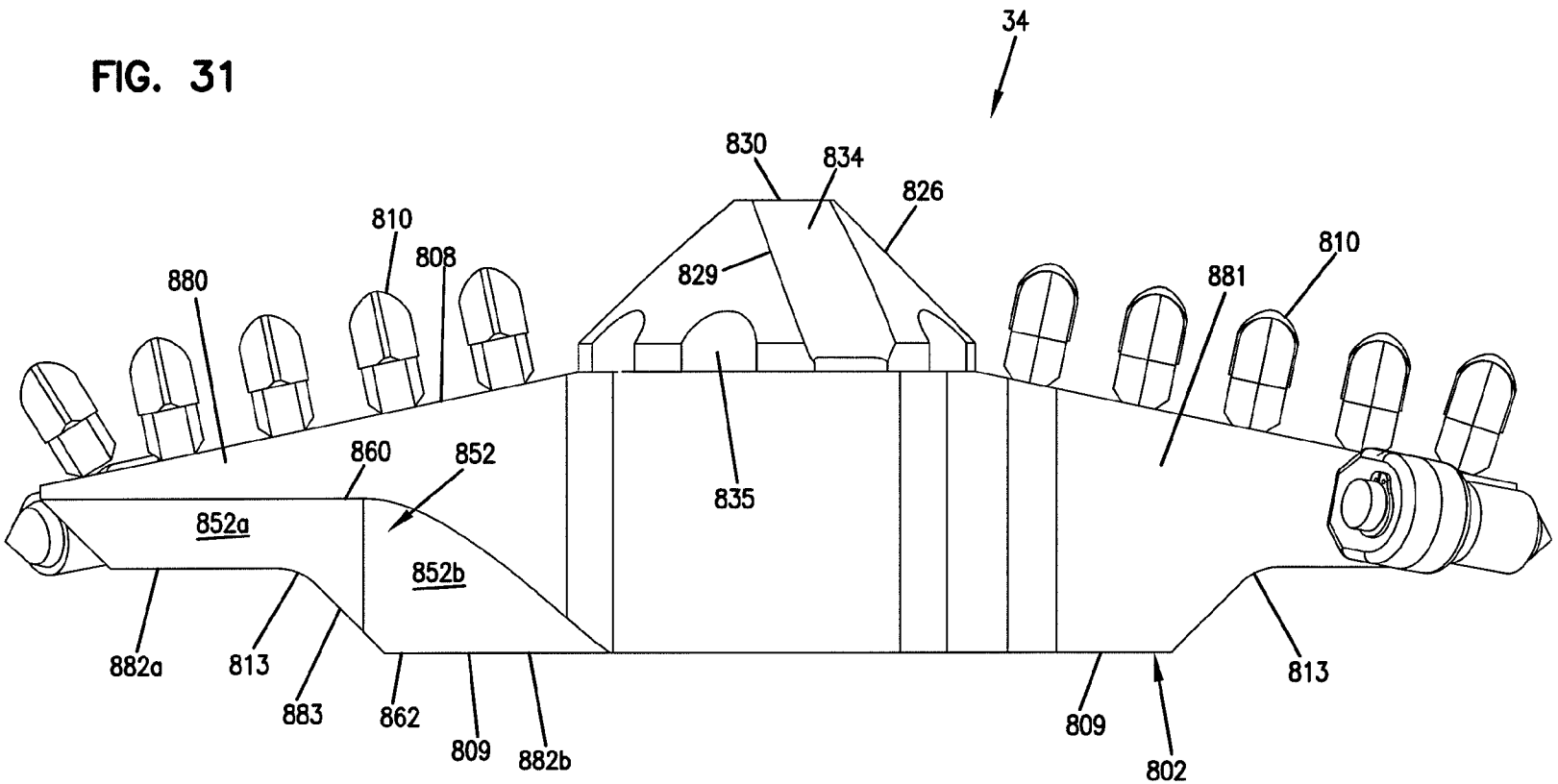
FIG. 31 is a top view of the cutting unit of FIG. 29.
Figure 32:
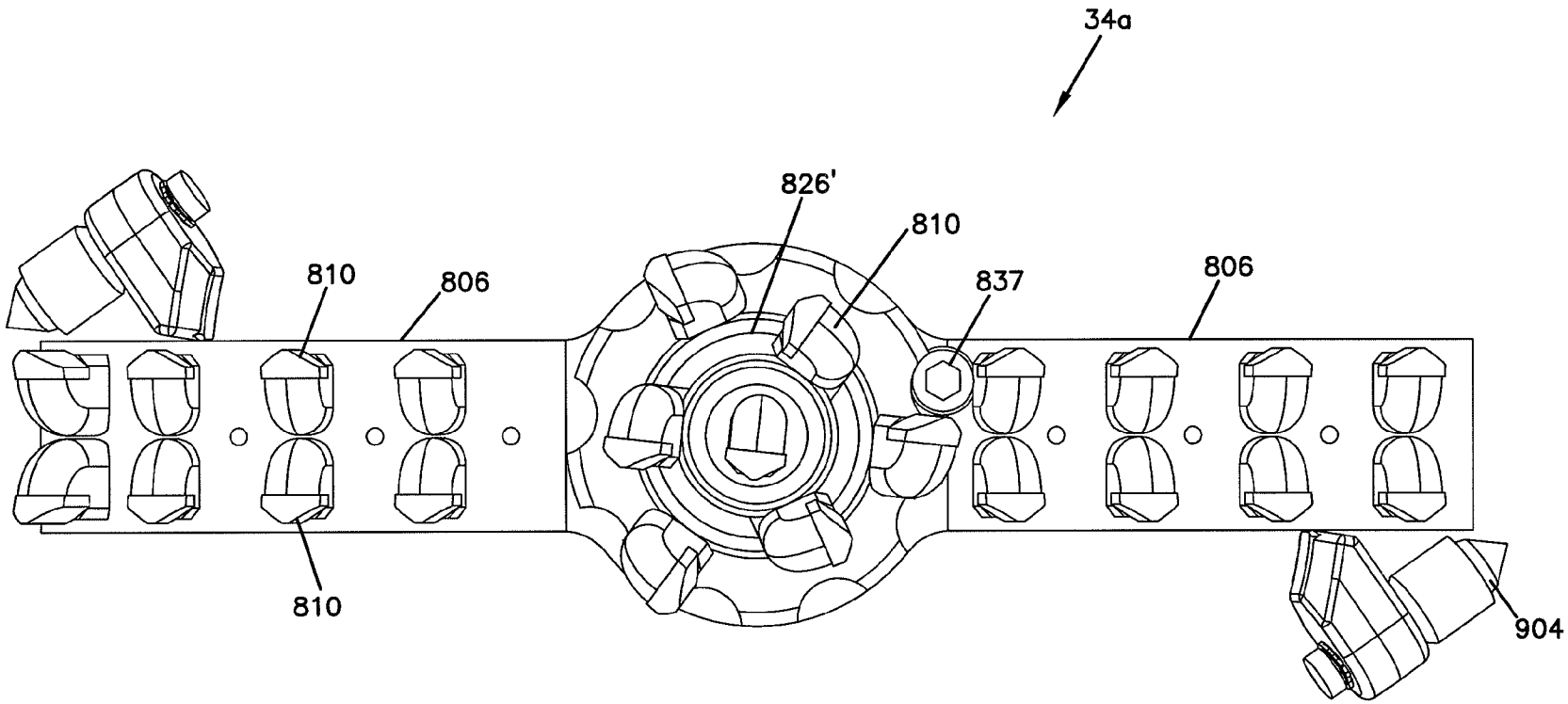
FIG. 32 shows a front/distal side of a second cutting unit suitable for use with drill heads in accordance with the principles of the present disclosure.
Figure 33:
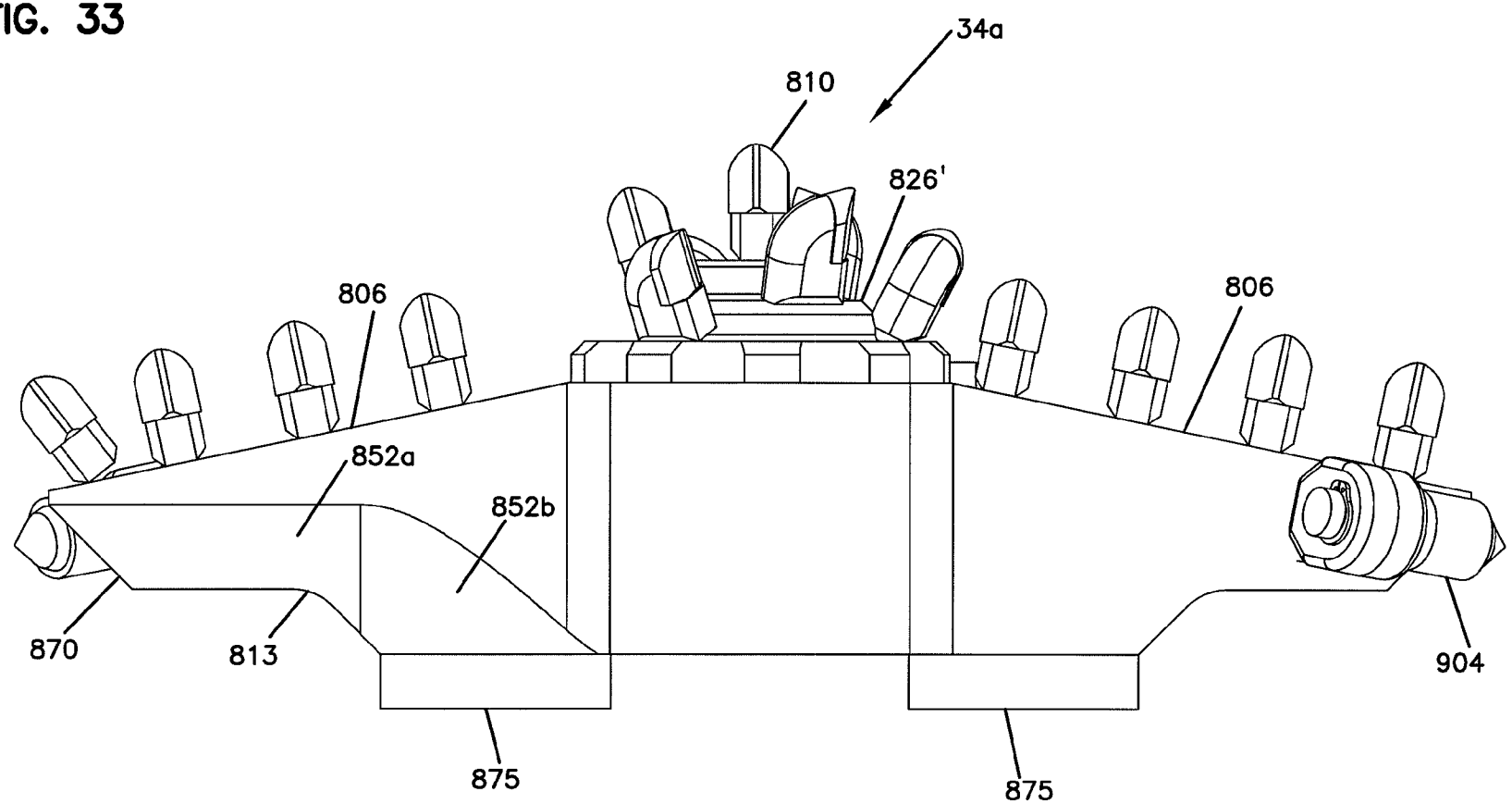
FIG. 33 is a bottom view of the cutting unit of FIG. 32.
Figure 34:
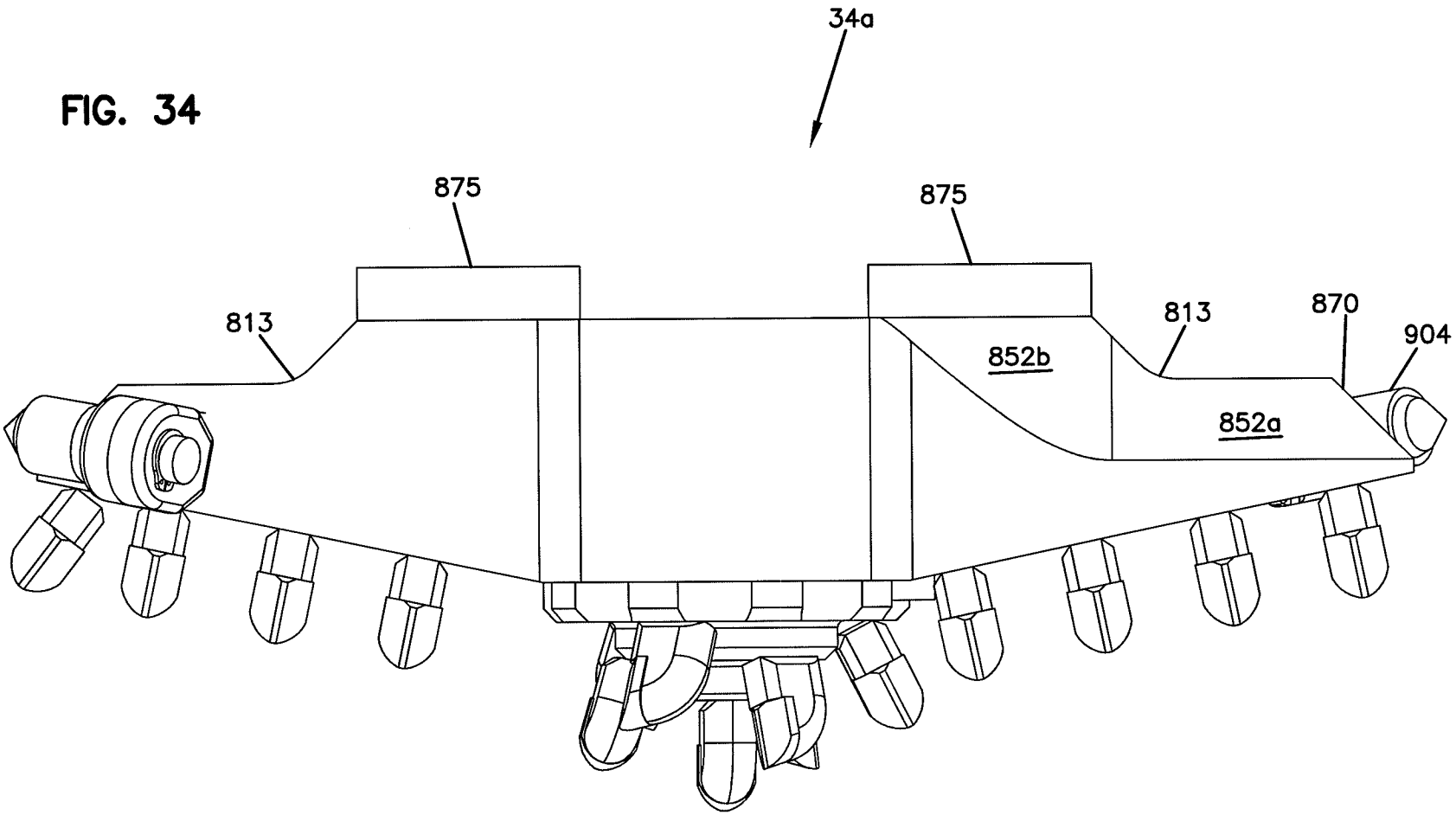
FIG. 34 is a top view of the cutting unit of FIG. 32.
Figure 35:
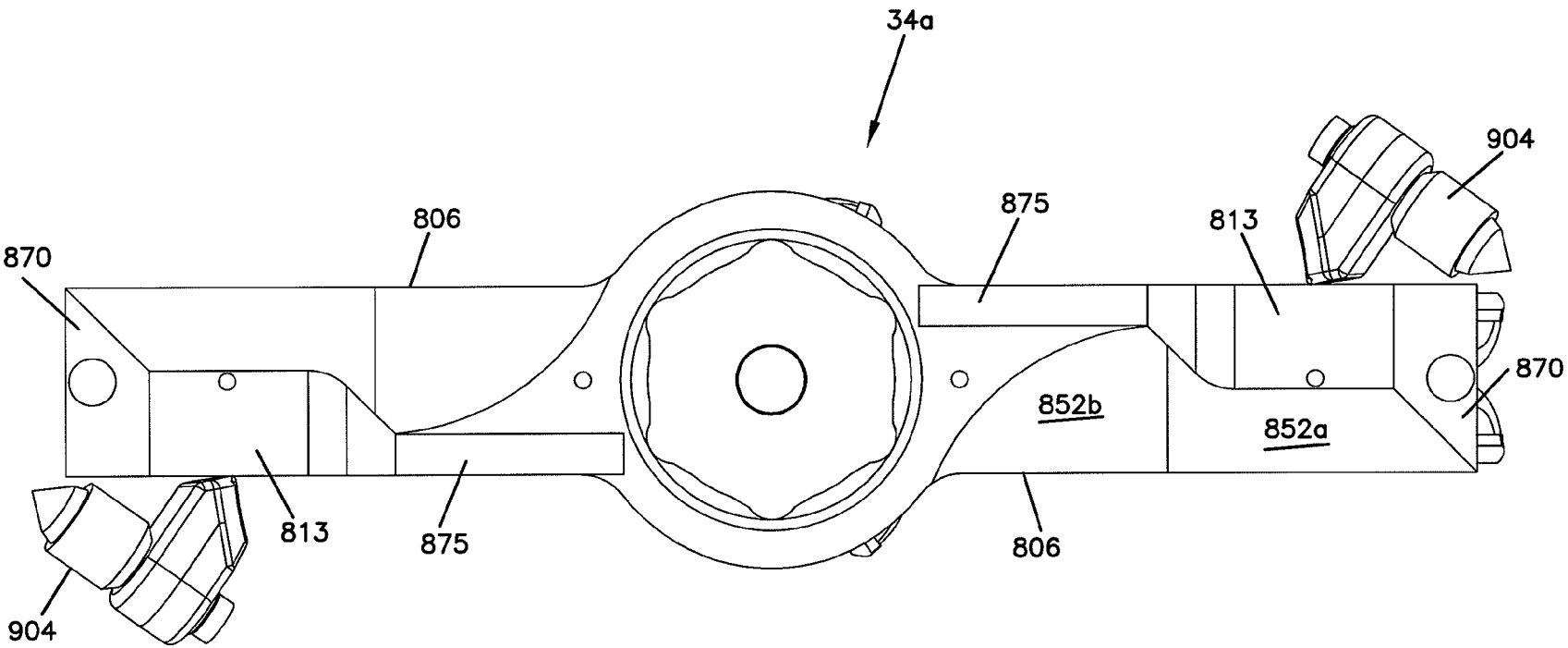
FIG. 35 is a back/proximal view of the cutting unit of FIG. 32.
Figure 37:
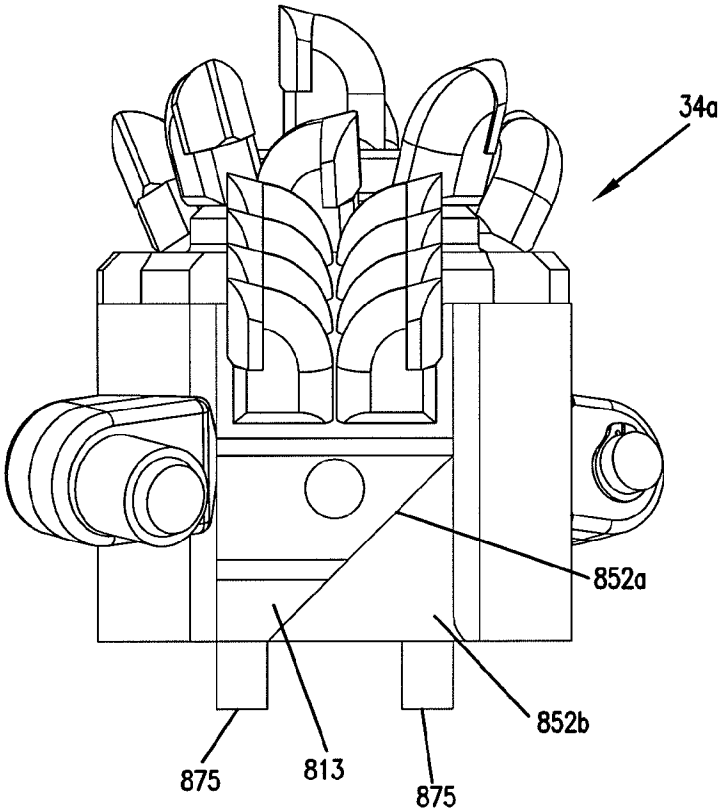
FIG. 37 is a left end view of the cutting unit of FIG. 32.
Figure 36:
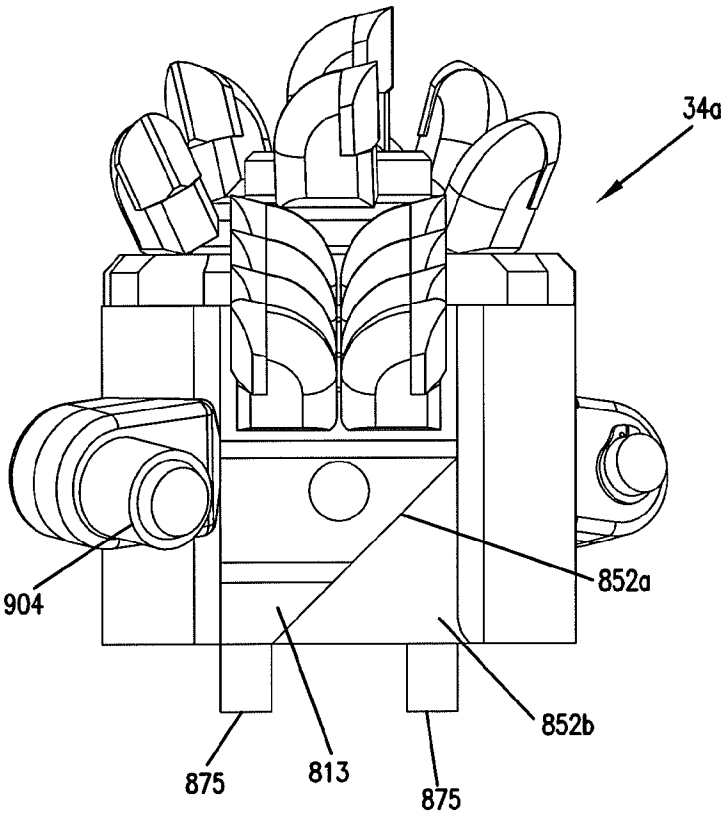
FIG. 36 is a right end view of the cutting unit of FIG. 32.
Figure 38:
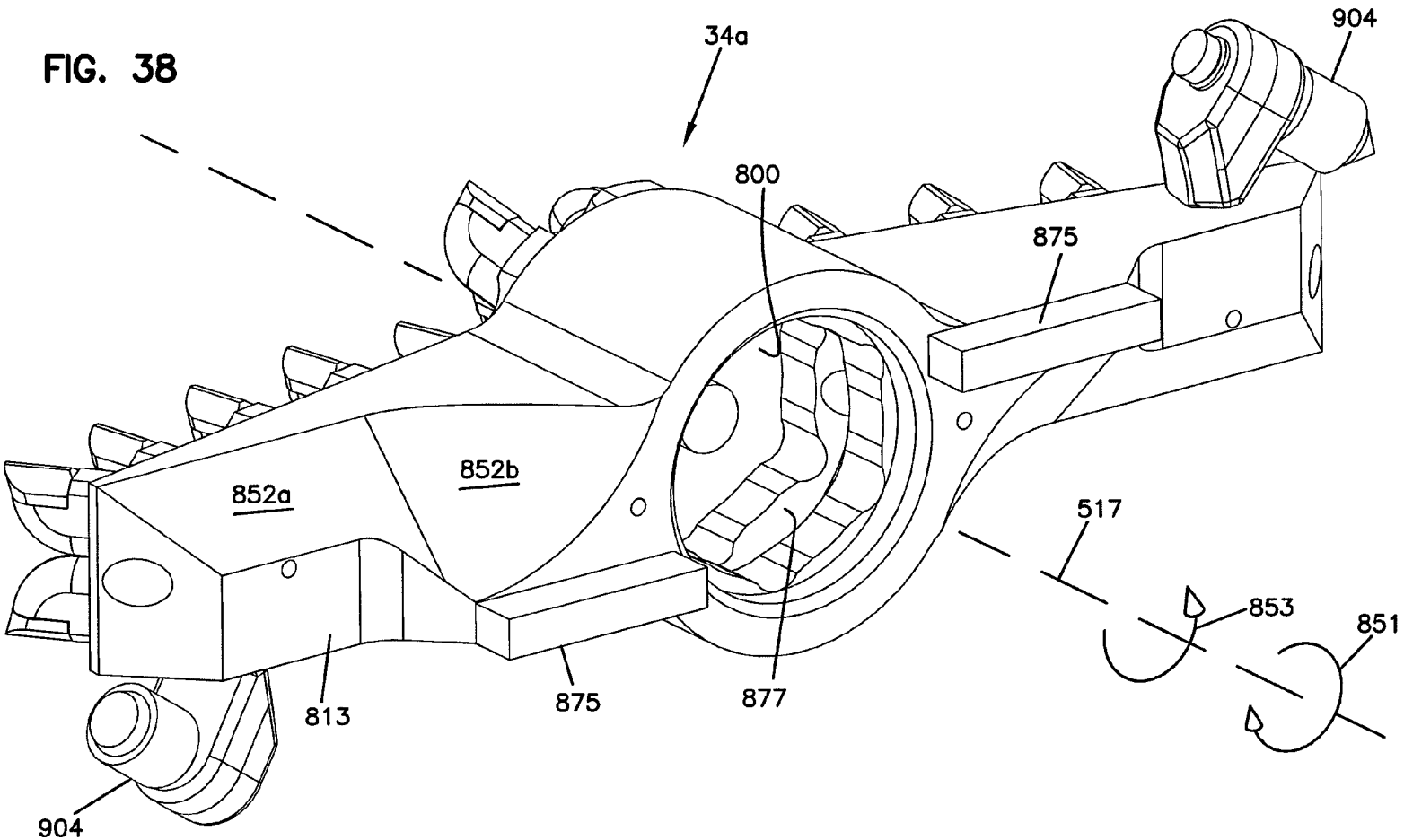
FIG. 38 is a perspective rear/proximal view of the cutting unit of FIG. 32.
Figure 39:
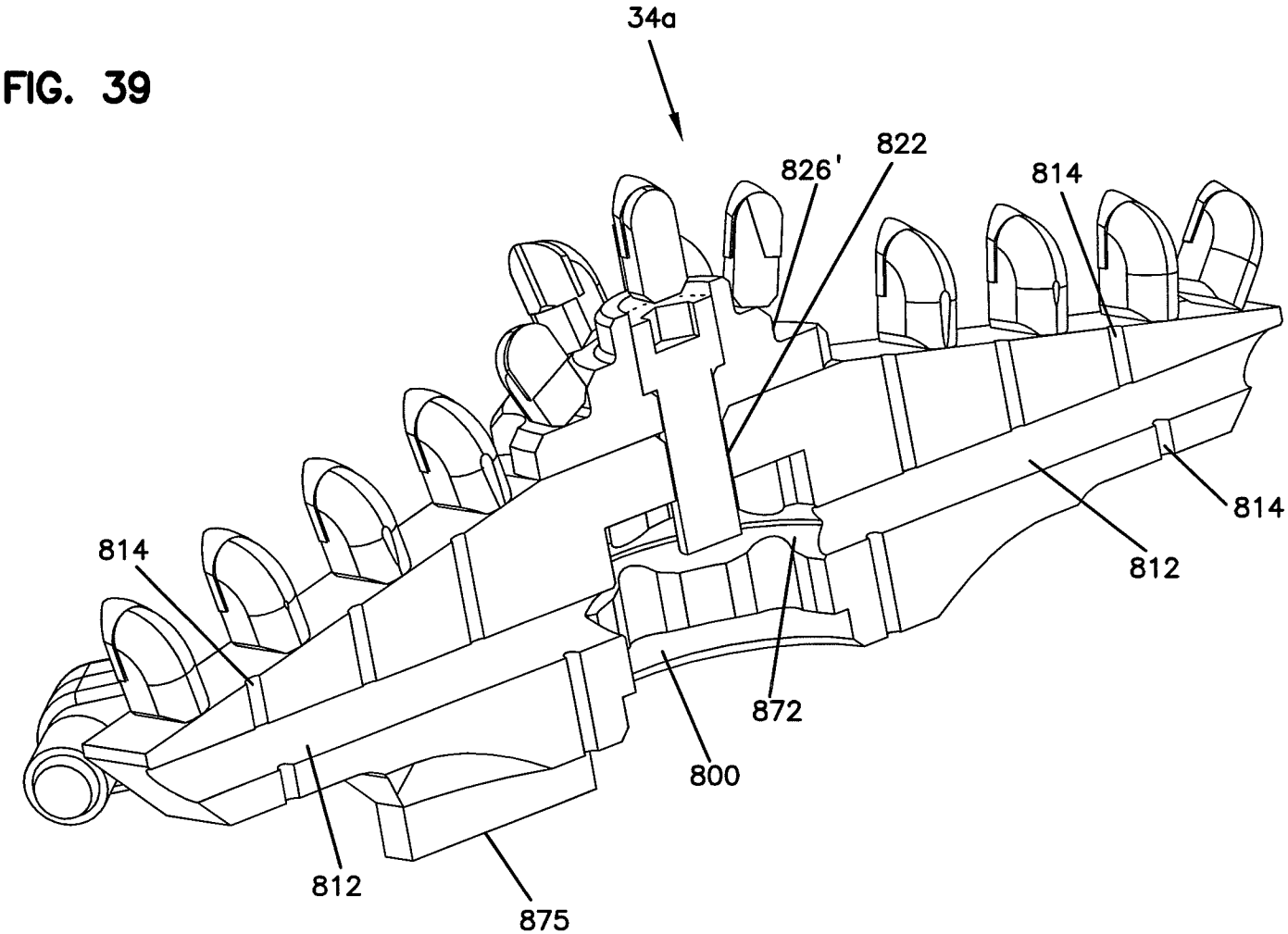
FIG. 39 is a cross-sectional view of the cutting unit of FIG. 32.

It will be appreciated that different types of cutting units can be used depending upon the type of materials in which the drilling apparatus 20 is being operated. For example, a double bar/arm cutter as shown at FIGS. 29-31 can be used to cut softer materials whereby a larger gap is provided between the bars for allowing material to pass therethrough. To drill in harder materials, it may be desirable to use cutting units with more than two bars and smaller gaps between the bars. In certain embodiments, two bar, three bar, four bar, five bar or six bar cutters could be used. In still other embodiments cutters having more than 6 bars could also be used.

Figure 17:
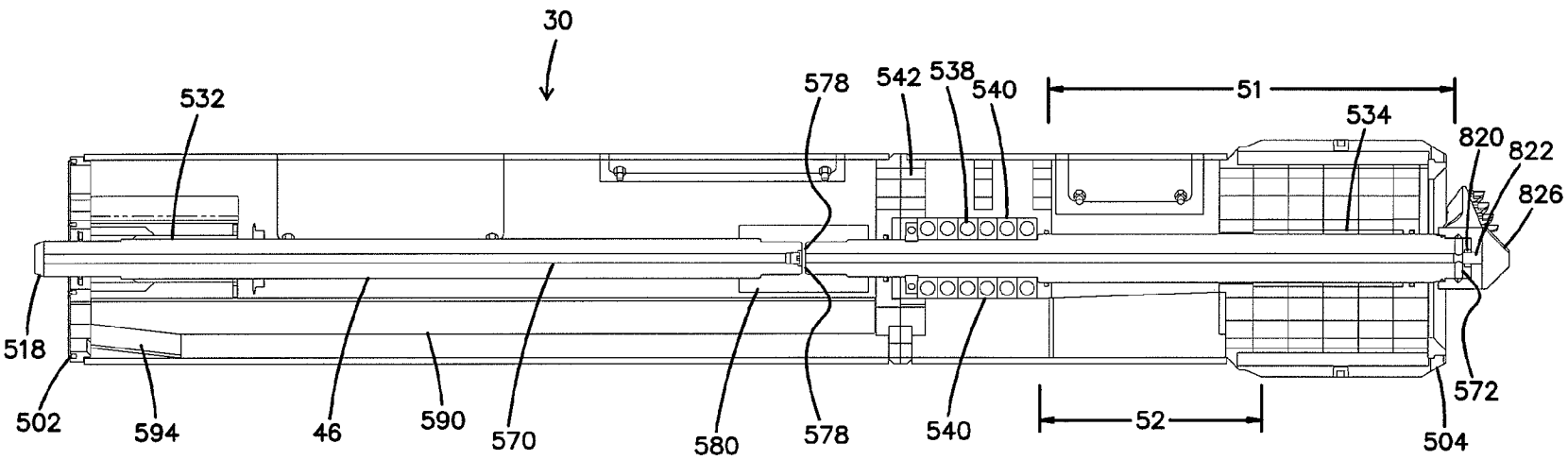
FIG. 17 is a side, cross-sectional view of the drill head of FIG. 14 with the drill head being cut by a vertical cross-sectional plane that bisects the drill head.
Figure 18:
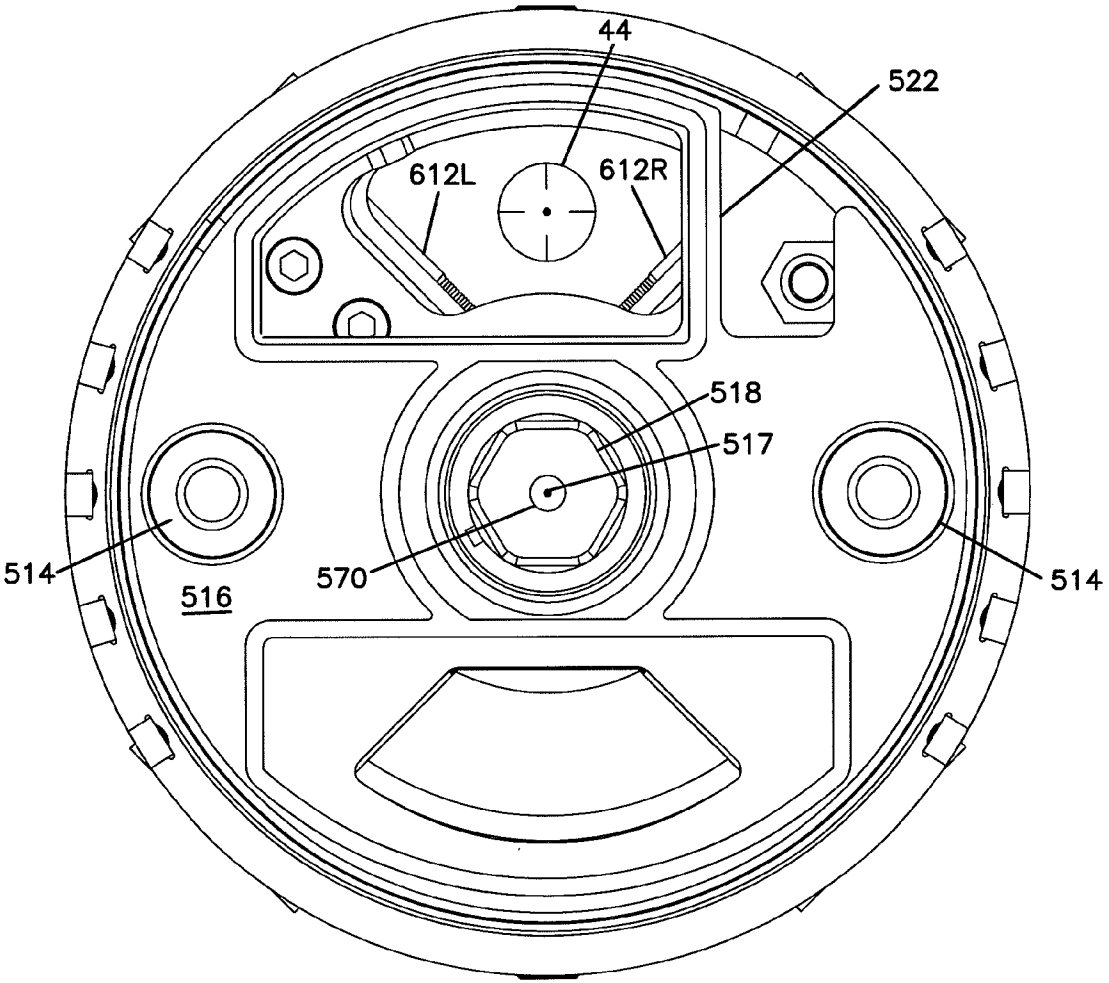
FIG. 18 is a proximal end view of the drill head of FIG. 14.

Referring back to FIGS. 16 and 17, the male torque transferring element 574 includes a central axial fastener opening 820 adapted for receiving a fastener (e.g., a bolt) used to retain the hub portion 804 axially on the male torque transferring feature 574. As shown at FIGS. 16 and 17, a fastener 822 is shown provided integrated on a back side of a front face cover 826 (e.g., a cutting nose such as a cone or other cutting element) that mounts at a front face 828 of the hub 804. The front face cover 826 has a plurality of cutting edges 829 that extend from a front tip region 830 of the front face cover 826 to a peripheral region 832 of the front face cover 826. Scoops/channels 834 are provided between the cutting edges 829. A plurality of notches 835 (e.g., pockets, receptacles, etc) are provided around the peripheral region 832. A fastener opening 836 is defined at the front face of the main body 802 at a location adjacent to a periphery of the hub 804. When the front face cover 826 is mounted to the hub, the fastener opening 836 is positioned at the peripheral region 832 of the front face cover 826 in alignment with one of the notches 835.

To secure the main body 802 of the cutting unit 34 to the male torque transferring feature 574, the male torque transferring feature 574 is slid axially into the female torque transferring feature 800 such that torque can be transferred between the two features. Once the male and female torque transferring features 574, 800 have been slid axially together (e.g., mated or nested), the fastener 822 provided on the back side of the front face cover 826 is secured (e.g., threaded) within the axial fastener opening 820 provided in the male torque transferring feature 574. With the fastener 822 fully secured within the male torque transferring feature 574, a back side of the front face cover 826 is compressed against the front face 828 of the hub portion 804 and one of the notches 835 around the periphery of the front face cover 826 aligns with the fastener opening 836 in the main body 802 of the cutting unit 34. Thereafter, a fastener 837 such as a socket head cap screw can be mounted within the fastener opening 836 with a portion of the fastener (e.g., the head) positioned within the notch 835 aligned with the fastener opening 836. In this way, the fastener 837 within the fastener opening 836 prevents the front face cover 826 from rotating about the central axis of the drive stem 46 and thereby prevents the fastener 822 securing the face cover 826 to the hub portion 804 from unscrewing from the fastener opening 820 of the male torque transferring feature 574. This type of configuration allows the cutting unit 34 to be rotated by the drive stem 46 in either a clockwise direction or a counterclockwise direction without causing the cutting unit 34 to disengage from the drive stem 46.

Referring to FIG. 29, cutter mounts 900 are secured to the cutter arms 806 (e.g., to the trailing sides 881 of the cutter arms 806) at locations adjacent to radial outermost ends of the cutter arms 806. The cutter mounts 900 define pockets or receptacles 902 adapted for detachably receiving mounting shafts 903 of removable cutters 904. The cutters 904 include cutting bits 905 secured to first ends of the mounting shafts 903. Back sides of the cutting bits 905 abut against radially outwardly facing surfaces 907 of the cutter mounts. Second ends of the mounting shafts 903 project outwardly beyond radially inwardly facing surfaces 909 of the cutter mounts 900. Fasteners 910 (e.g., cotter pins, retention clips or other structures) detachably mount to the second ends of the mounting shafts 903. Interference between the fasteners 910 and the radially inwardly facing surfaces 909 prevents the cutters 904 from unintentionally detaching from the cutter mounts 900. By removing the fasteners 910 from the second ends of the mounting shafts 903, the cutters 904 can be detached from the cutter mounts 900 by pulling the cutters 904 relative to the cutter mounts 900 such that the mounting shafts 903 slide out of the receptacles 902 of the cutter mounts 900.

When the cutters 904 are mounted to the cutter mounts 900, the tips of the cutting bits 905 of the cutters 904 project radially outwardly beyond the radial outermost portions of the cutter arms 806. This arrangement causes the outer tips of the cutters 904 to drill a hole having a diameter slightly larger than the outermost diameter of the steering shell 36. Such a configuration is particularly suitable for boring holes through relatively hard material. In softer materials, it may be desirable for the hole drilled by the cutting unit 34 to be of the same size as or slightly smaller than the outer diameter of the steering shell. To achieve this, the cutters 904 can be removed from the cutter mounts 900 thereby allowing the cutting unit 34 to drill a smaller hole than if the cutters 904 were present.

FIGS. 32-39 show a second cutting unit 34*a* in accordance with the principles of the present disclosure. The cutting unit 34*a* has many similarities with the cutting unit 34 of FIGS. 29-31 and identical parts have been assigned the same reference numerals. For example, the cutting unit 34*a* includes radial bars 806 including notches 813, flow directing surfaces 852*a* and 852*b*, and end surfaces 870. Also, cutters 904 are mounted at distal-most ends of the radial bars 806. However, unlike the cutting unit 34, the cutting unit 34*a* includes radially extending wiper members 875 (i.e., bars, blades, scrapers, etc.) mounted to the back side of the cutting unit 34*a* at locations radially inside from the flow directing surfaces 852*b*. The wiper members 875 function to wipe or scrape the distal end face 736 of the module 536*f* to prevent excessive material from collecting, caking or compressing between the back side of the cutting unit 34*a* and the end face 736. When the cutting unit 34*a* is rotated about the central axis of the drill head, the wiper members 875 define an annular path that extends at least partially across the mouth/entrance opening 738 of the vacuum passage 47. Thus, the wiper members 875 sweep material (i.e., slurry, cuttings, etc.) across the entrance opening 738 where the material is drawn by vacuum into the vacuum passage 47. Notches 813 allow the wiper members 875 to be recessed within the distal end of the drill head 30. For example, the wiper members 875 are positioned proximally with respect to the distal-most edge 732 of the steering shell 36 at least partially within the volume defined inside the inner chamfer surface 734 of the steering shell 36. Also, the cutting unit 34*a* includes a cover plate 826' having a stepped configuration with cutting elements 810 mounted on each of the steps. Further, the cutting unit 34*a* includes two rows of cutting elements 810 mounted on each of the radial bars 806. The rows of cutting elements 810 on each of the bars 806 face in opposite cutting direction. An annular groove 877 (see FIGS. 38 and 39) is defined within the female torque transferring feature 800 for providing fluid communication between radial passages 812 defined through the radial arms 806 and the radial passages 572 defined through the male torque transferring feature 574 of the drive stem 46.

During normal drilling operations, cutting unit 34*a* is rotated in the first rotational direction 851 about the axis 517 of the drive stem 46. However, if desired by the operator, the cutting unit 34*a* can be rotated in a second rotational direction 853 about the axis 517 that is opposite from the first rotational direction 851. For example, when drilling in the first rotational direction 851 the cutting unit 34*a* may hit an obstruction that causes the cutting unit 34*a* to veer off-line. In this situation, the operator can reverse the direction of rotation of the cutting unit 34*a* to cause the cutting unit 34*a* to cut into the obstruction and maintain a better line. Of course, the reverse rotation capabilities of the cutting unit 34*a* can be used for other applications as well. Similar to the cutting unit 34, fastener 837 is used to prevent the face cover 826' from unthreading when the cutting unit 34*a* is operated in the second rotational direction 853. Furthermore, the rows of cutting elements (e.g., teeth) facing in opposite cutting directions assist in facilitating bi-directional rotation of the cutting unit 34*a* during drilling.

Figure 40:
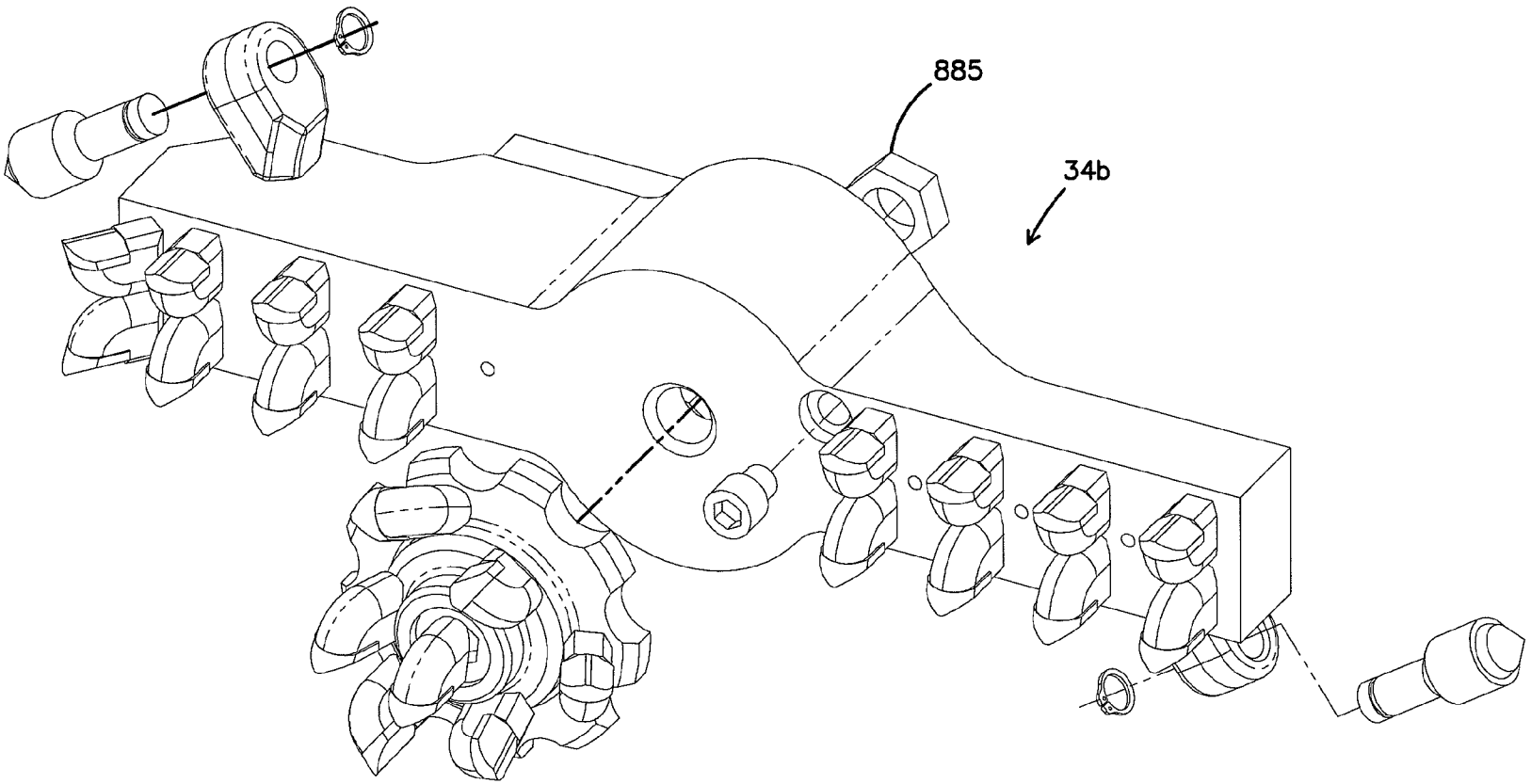
FIG. 40 is a front perspective view of a third cutting unit in accordance with the principles of the present disclosure.
Figure 41:
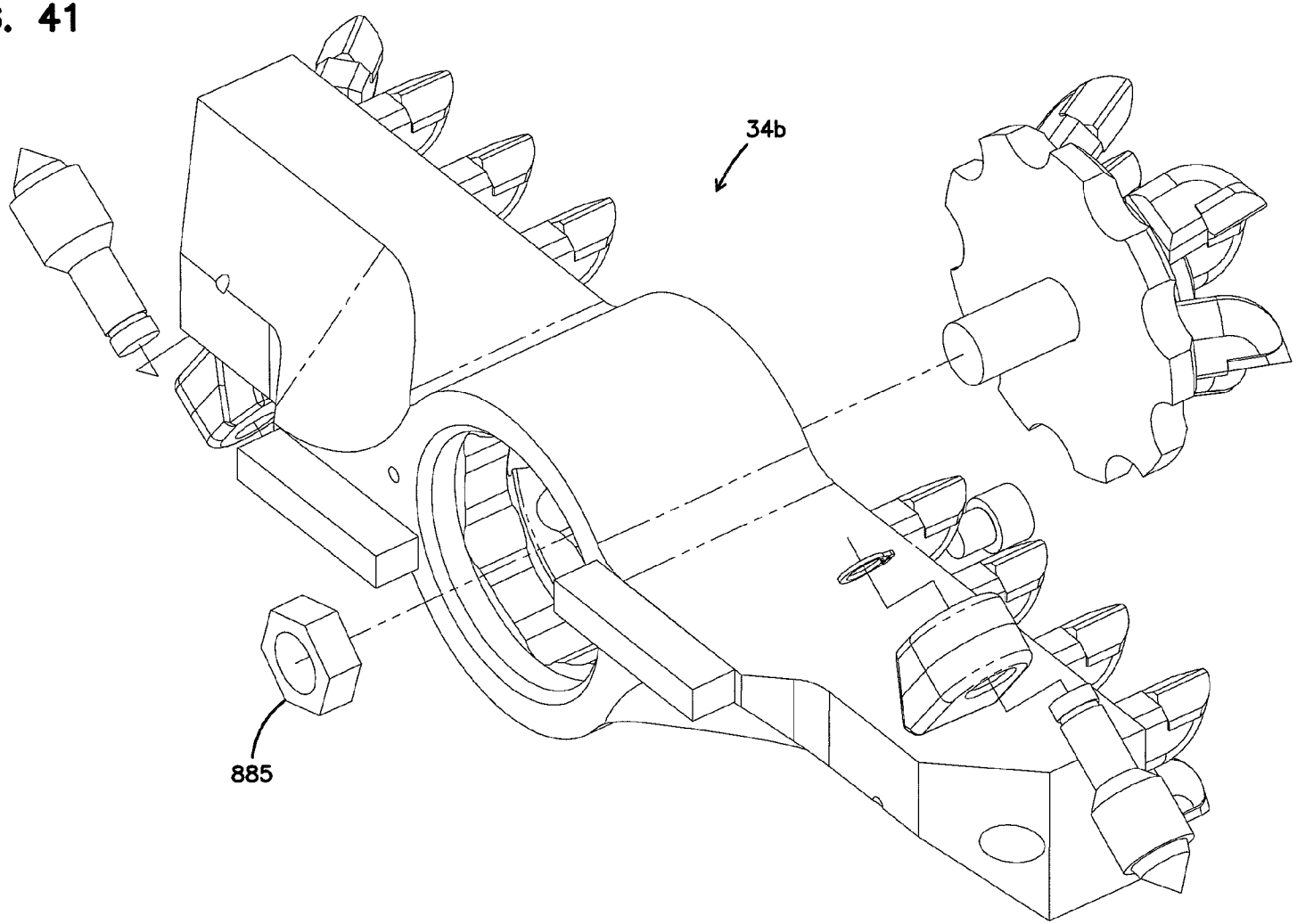
FIG. 41 is a rear perspective view of the cutting unit of FIG. 40.

FIGS. 40 and 41 depict a third cutting unit 34*b* in accordance with the principles of the present disclosure. The cutting unit 34*b* has the same basic configuration as the cutting unit 34*a* except the front sides of the cutting bars do not angle in a proximal direction as the front sides extend radially outwardly from the hub. Instead, the front sides of the cutting bars are aligned generally along a plane that is generally perpendicular relative to the central axis of rotation of the cutting unit 34*b*.

Figure 42:
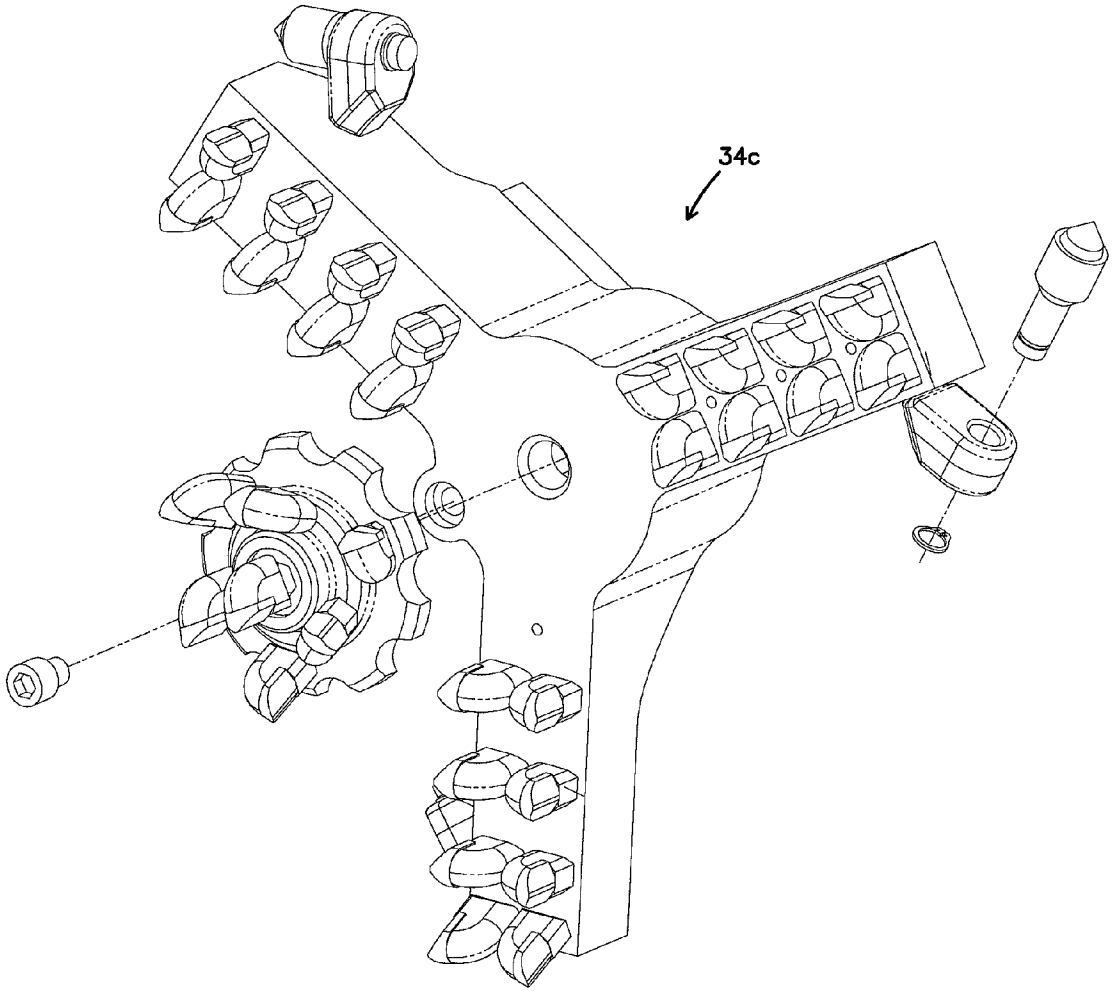
FIG. 42 is a front perspective view of a fourth cutting unit in accordance with the principles of the present disclosure.
Figure 43:
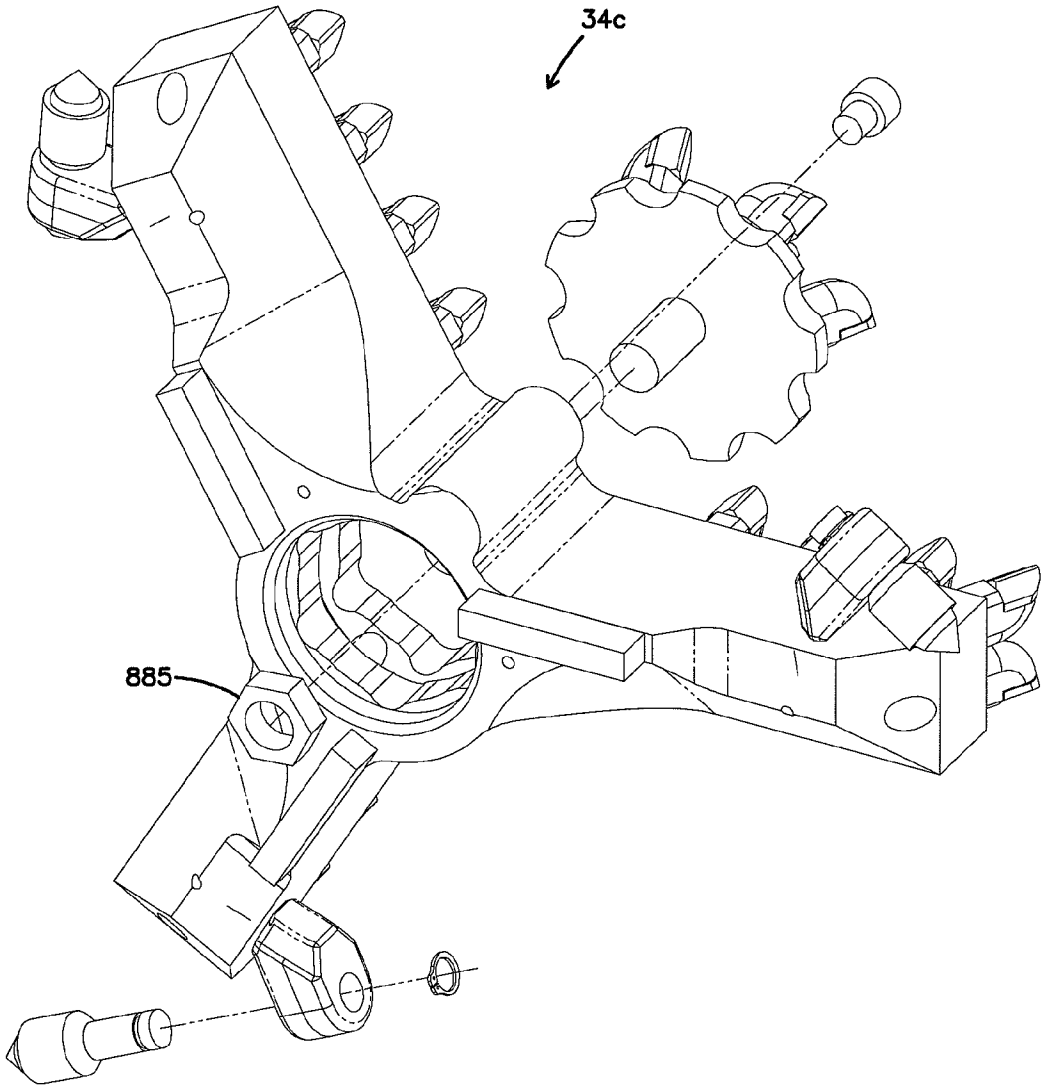
FIG. 43 is a rear perspective view of the cutting unit of FIG. 42.

FIGS. 42 and 43 depict a fourth cutting unit 34*c* in accordance with the principles of the present disclosure. The cutting unit 34*c* has the same basic configuration as the cutting unit 34*b* except the main body of the cutting unit includes three bars instead of two.

Figure 44:
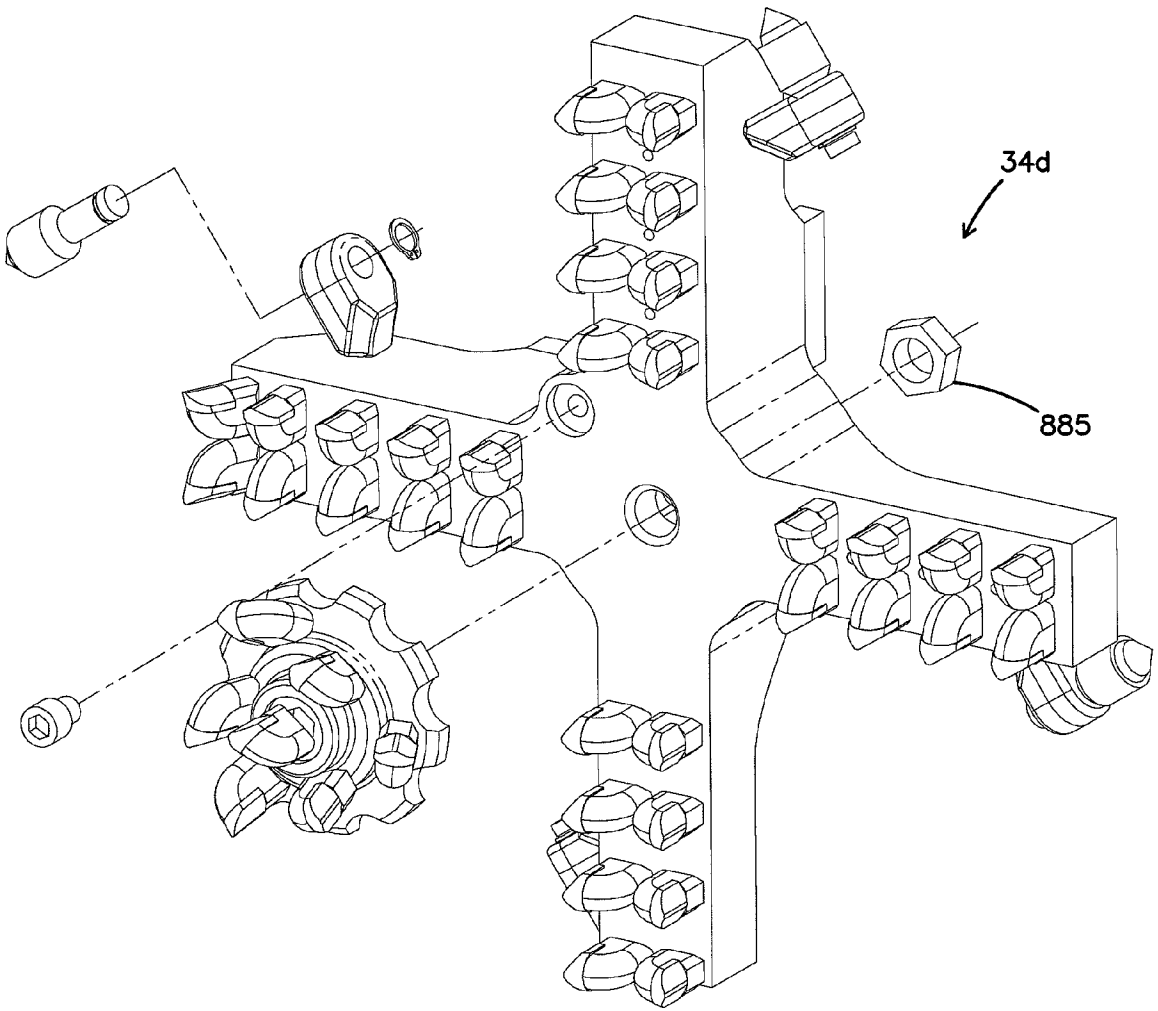
FIG. 44 is a front perspective view of a further fifth cutting unit in accordance with the principles of the present disclosure.
Figure 45:
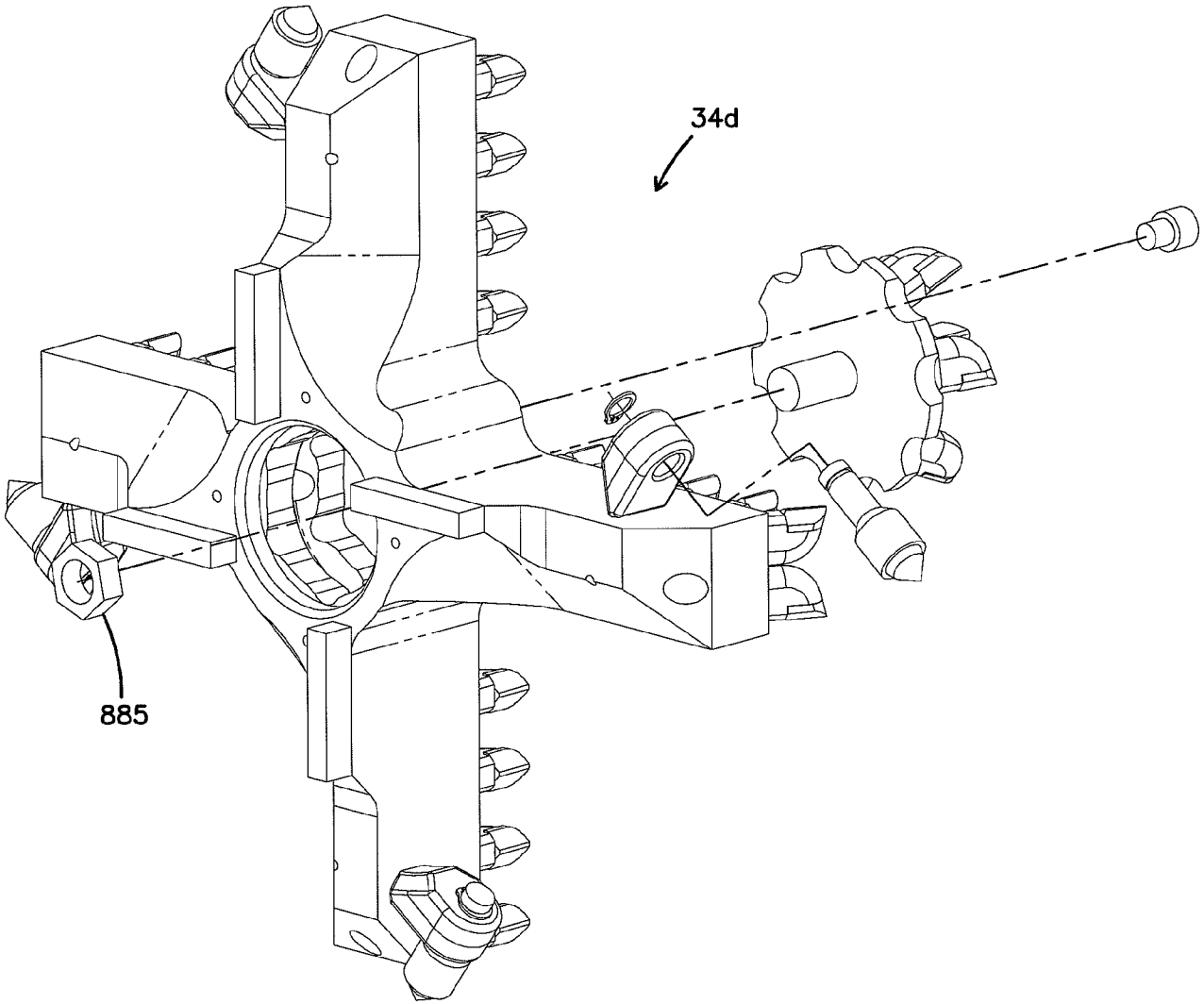
FIG. 45 is a rear perspective view of the cutting unit of FIG. 44.

FIGS. 44 and 45 depict a fifth cutting unit 34*d* in accordance with the principles of the present disclosure. The cutting unit 34*d* has the same basic configuration as the cutting unit 34*b* except the main body of the cutting unit includes four bars instead of two.

Figure 46:
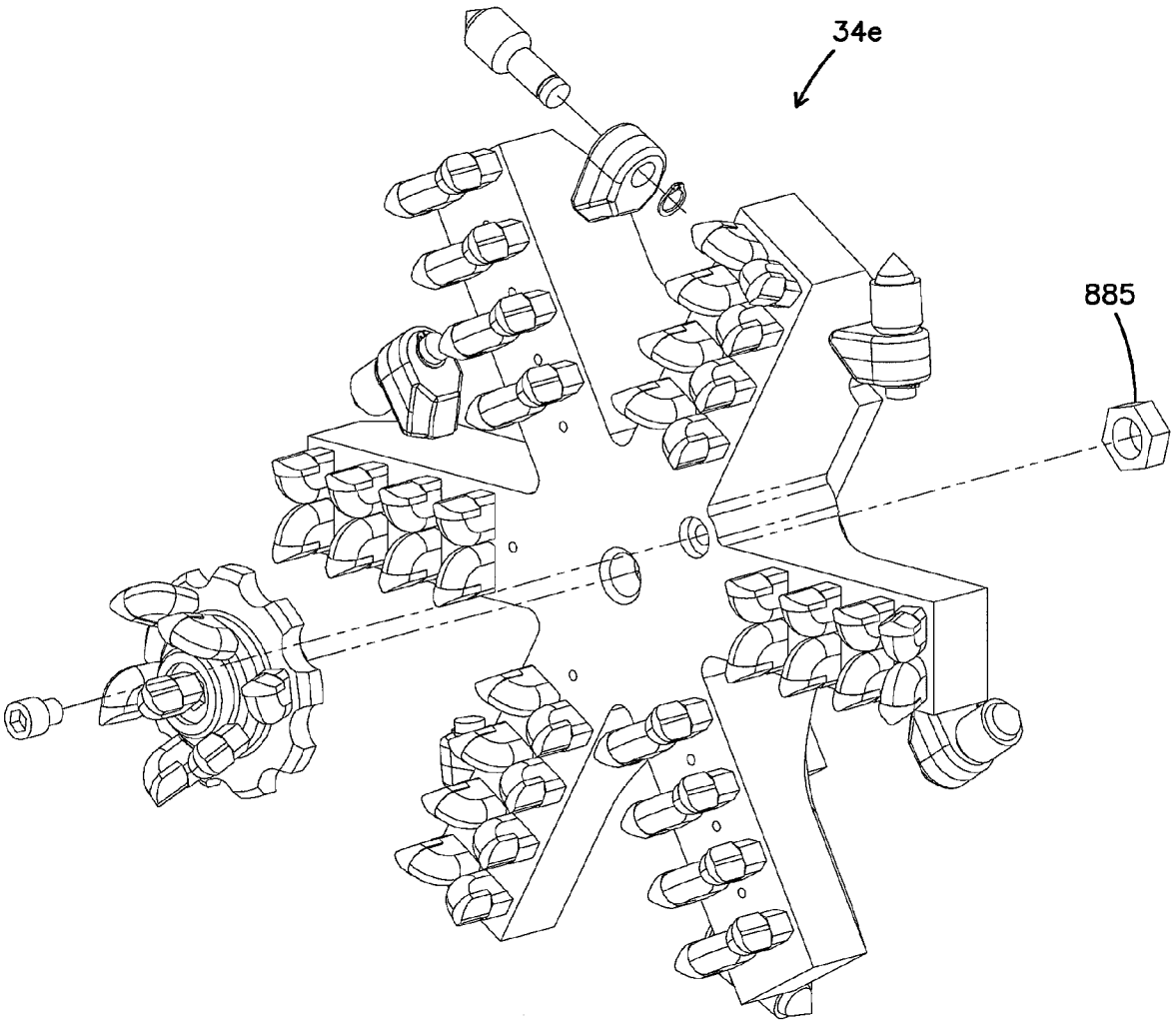
FIG. 46 is a front perspective view of a sixth cutting unit in accordance with the principles of the present disclosure.
Figure 47:
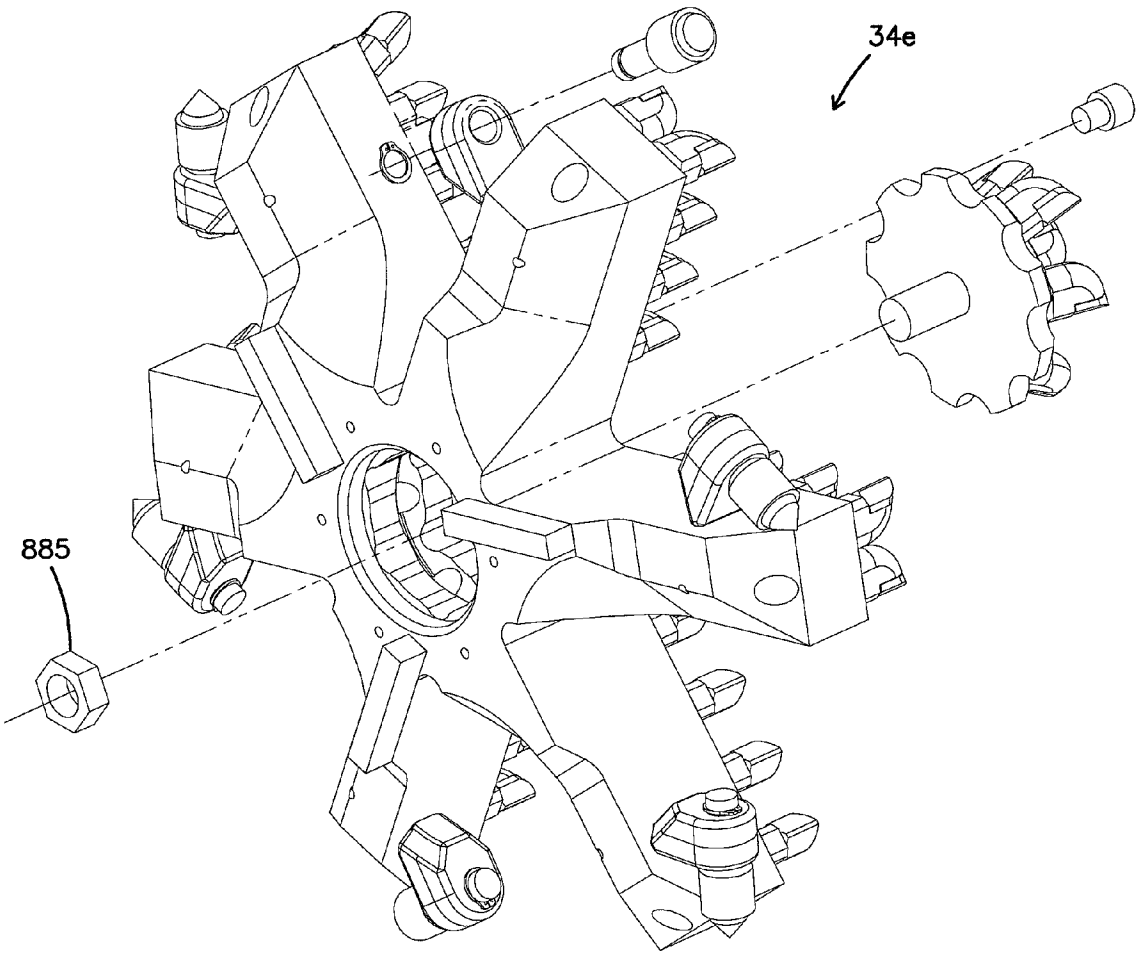
FIG. 47 is a rear perspective view of the cutting unit of FIG. 46.

FIGS. 46 and 47 depict a sixth cutting unit 34*e* in accordance with the principles of the present disclosure. The cutting unit 34*e* has the same basic configuration as the cutting unit 34*b* except the main body of the cutting unit includes six bars instead of two.

Figure 48:
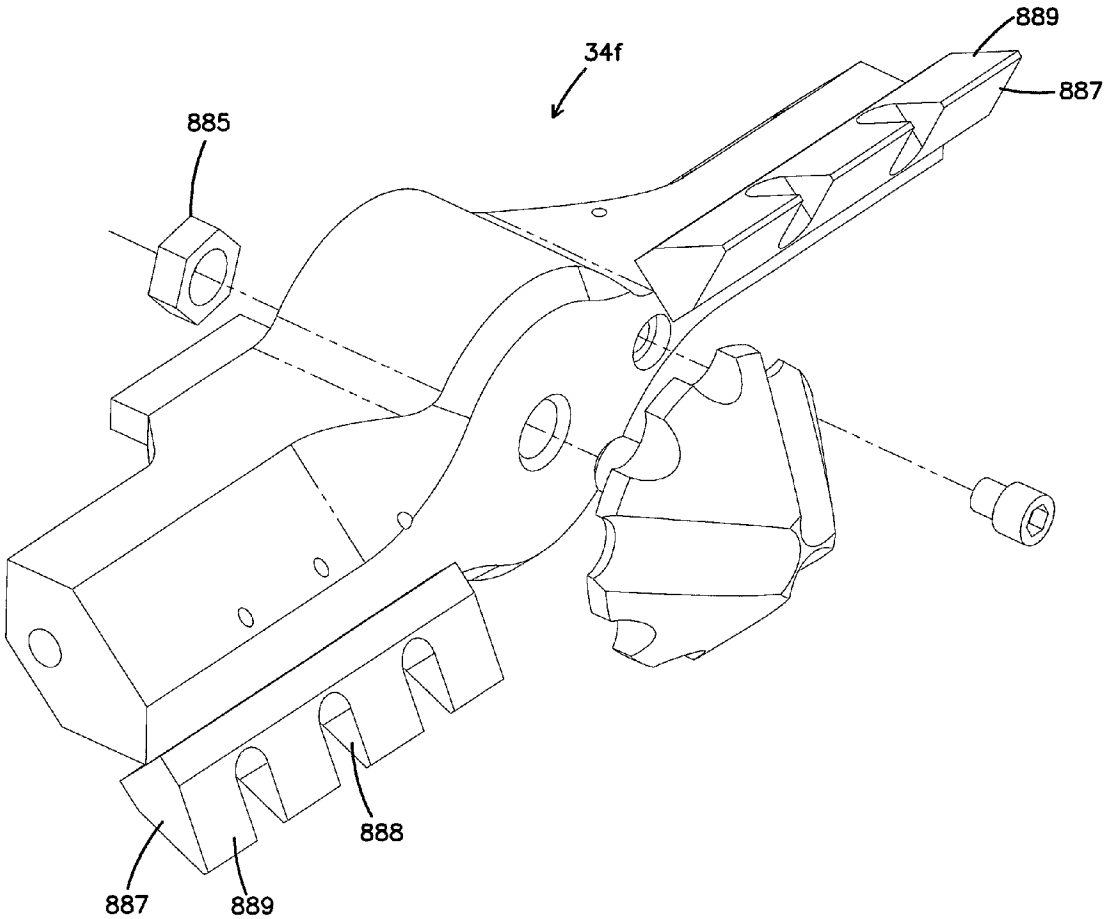
FIG. 48 is a front perspective view of a seventh cutting unit in accordance with the principles of the present disclosure.
Figure 49:
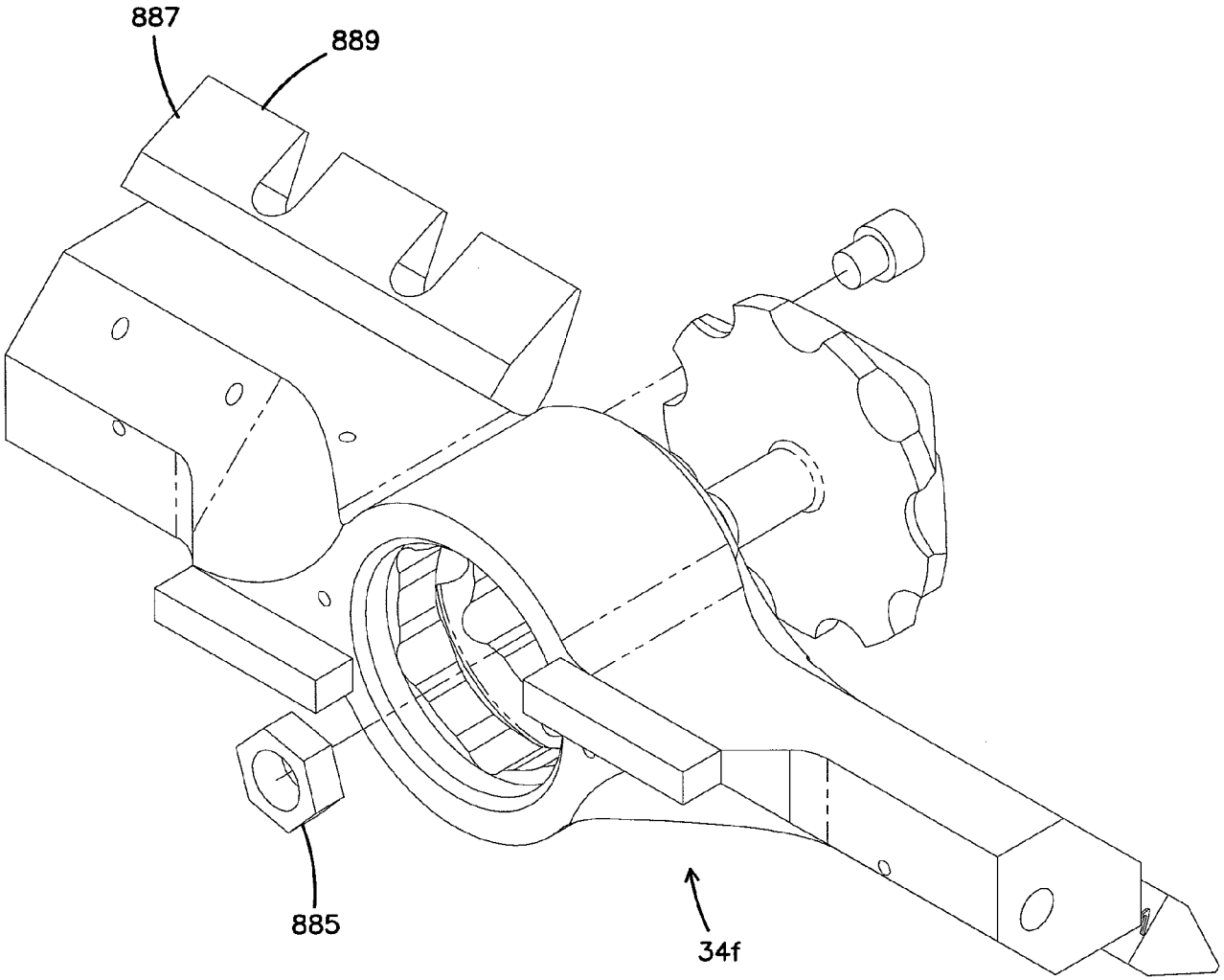
FIG. 49 is a rear perspective view of the cutting unit of FIG. 48.

FIGS. 48 and 49 depict a seventh cutting unit 34*f* in accordance with the principles of the present disclosure. The cutting unit 34*f* has the same basic configuration as the cutting unit 34*b* except cutting elements in the form of scraping blades 887 having radially extending scraping edges 889 have been mounted to the front sides of the radial arms of the main body of the cutting unit 34*f*. The scraping blades 887 are best suited from drilling through softer materials such as clay. For harder clays, hardened cutting teeth (e.g., teeth 810) can be mounted to the main body of the cutting unit 34*f* and used in combination with the scraping blades 887. For example, the hardened teeth can be mounted at notches 888 provided in the scraping blades 887.

In the embodiments of FIG. 40-49, nuts 885 are shown for securing the front retainers to the main bodies of the cutting units during shipping and storage. It will be appreciated that the nuts 885 can be discarded when the cutting units are installed on the drill head.

FIGS. 50-55 show an example backreamer 925 that can be used with the drilling apparatus 20. In use of the drilling apparatus, the drill head 30 can initially be used at the distal end of the drill string 24 to drill a bore from a first shaft (i.e., a pit) to a second shaft. When the drill head 30 reaches the second shaft, the drill head 30 can be removed from the distal end of the drill string 24 and replaced with the backreamer 925. The drill string is then pulled/withdrawn proximally from the bore. As the drill string 24 is withdrawn from the bore, the backreamer 925 is pulled by the drill string 24 proximally from the second shaft to the first shaft. The backreamer 925 enlarges the bore and allows slurry/cuttings to be evacuated from the bore through the vacuum passage 47 of the pipe sections 22 as the backreamer 925 is pulled from the second shaft to the first shaft. Pull-back load for pulling in the backreamer 925 through the bore is transferred from the drive unit 32 through the outer casing assemblies 28 of the pipe sections 22 of the drill string 24 to the backreamer 925.

The backreamer 925 includes a distal end 927 positioned opposite from a proximal end 929. The proximal end 929 is adapted for connection to the distal end of the distal most pipe section 22 while the distal end 927 is configured to be coupled to product desired to be pulled into the bore behind the backreamer 925. The backreamer 925 also includes a backreaming cutter 931 positioned at an intermediate location along the length of the backreamer 925. A vacuum blocking plate 933 is positioned at a distal side of the cutter 931.

The backreamer 925 includes a proximal assembly 935 that extends from the proximal end 929 to the cutter 931. The proximal assembly 935 includes a proximal end plate 937 positioned at the proximal end 929 of the backreamer 925 and a plate stack 939 positioned adjacent to the cutter 931. The proximal assembly 935 also includes an outer shell 941 that extends from the proximal end plate 937 to the plate stack 939. A bearing assembly 943 (see FIG. 52) is positioned within the outer shell 941. The bearing assembly 943 includes a bearing housing 945 mounted between the proximal end plate 937 and the plate stack 939, and a plurality of axial bearings 947 positioned within the bearing housing 945. An open region 949 is provided between the outer shell 941 and the bearing housing 945.

The backreamer 925 also includes a drive stem 951 including a proximal portion that extends from the proximal end 929 of the backreamer 925 to the cutter 931. The drive stem 951 is rotatably supported within the axial bearings 947 and is also rotatably supported within a radial bearing structure 953 positioned within the plate stack 939. The drive stem 951 is configured to transfer torque from the drive shaft 26 of the distal most pipe section 22 to the cutter 931. In this way, torque from the drive unit 32 can be transferred through the shafts 26 of the drill string 24 and also through the drive stem 951 so as to cause rotation of the cutter 931 about a central axis 957 (see FIG. 55) of the backreamer 925. The drive stem 951 includes a male rotational drive element 955 that engages with a corresponding female rotational drive element of the drive shaft of the distal most pipe section 22 when the backreamer 925 is coupled to the distal end of the drill string 24.

Figure 52:
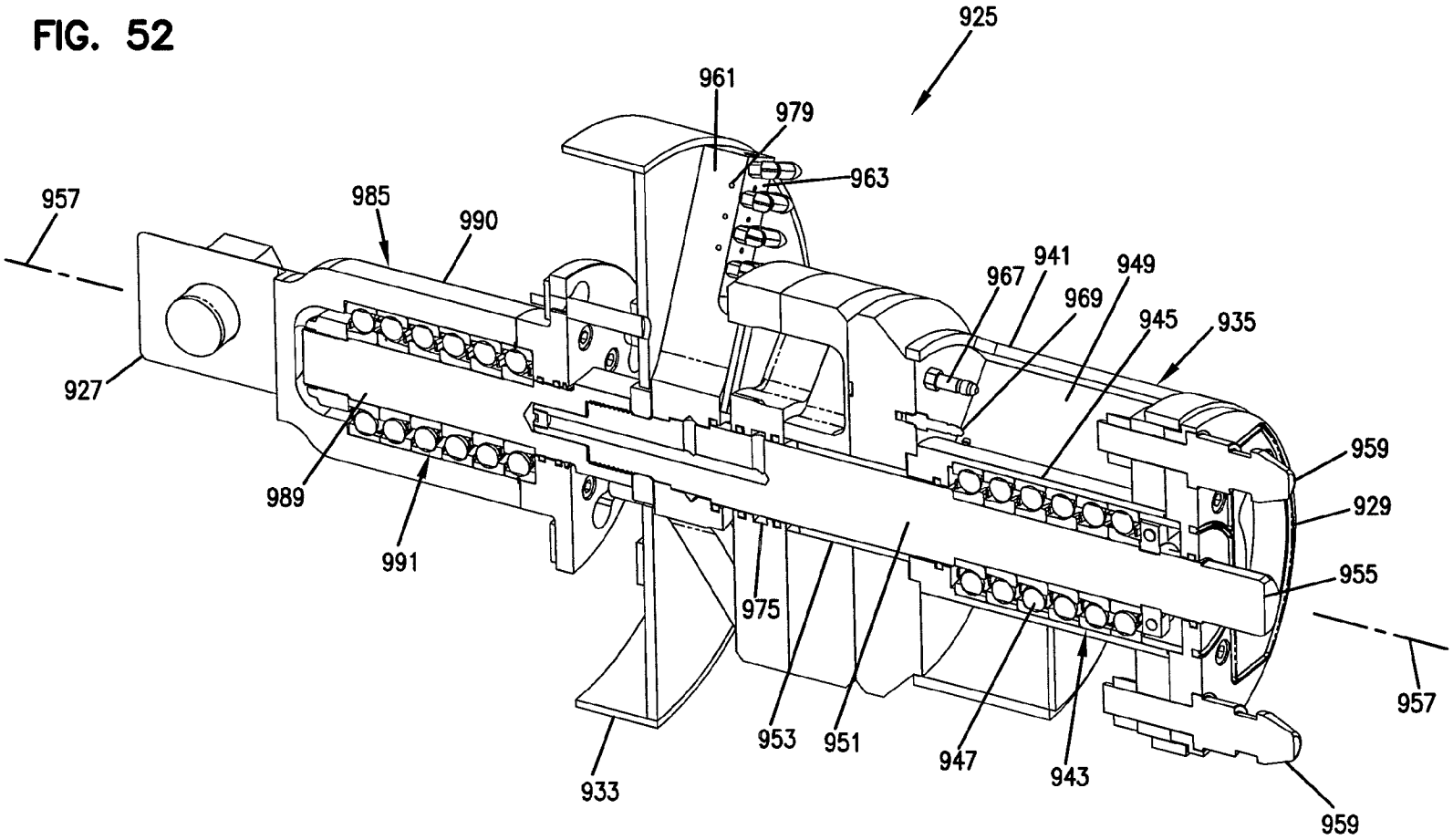
FIG. 52 is a cross-sectional view of the back reamer of FIG. 50.
Figure 53:
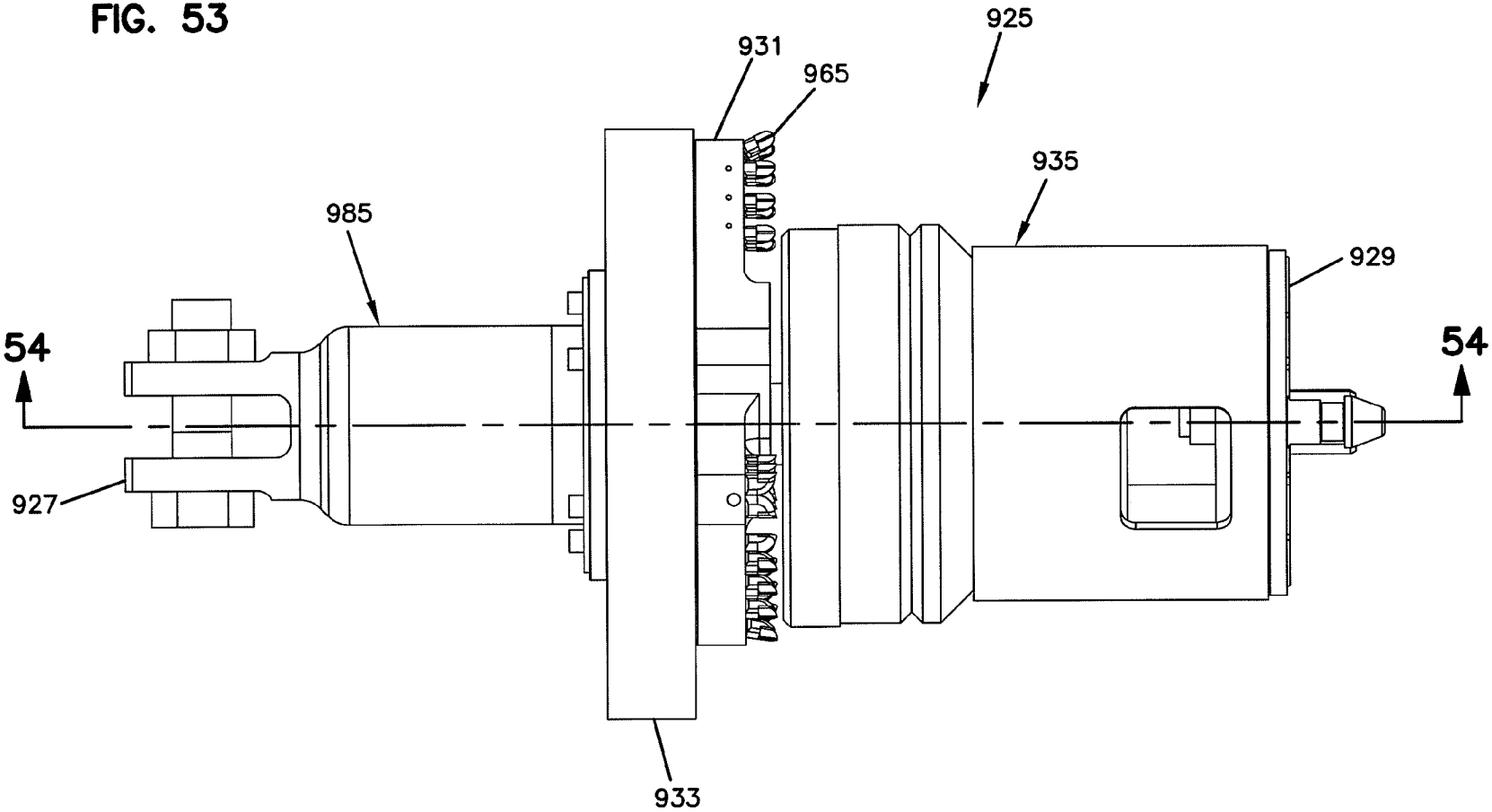
FIG. 53 is a side elevation view of the back reamer of FIG. 50.

Referring to FIG. 52, the drive stem 951 is aligned along the central axis 957 of the backreamer 925. The proximal end 929 of the backreamer 925 also includes two projections 959 positioned on diametrically opposite sides of the central axis 957. When the backreamer 925 is coupled to the distal end of the drill string 24, the projections 959 can be latched within corresponding receptacles defined by the distal most pipe section of the drill string 24 to allow a pull-back force to be applied from the casing assembly 28 of the distal most pipe section 22 to the proximal assembly 935 of the backreamer 925.

The cutter 931 of the backreamer 925 includes a plurality of radial bars 961 that project radially outwardly from the central axis 957. The radial bars 961 include proximal faces 963 at which a plurality of cutting teeth 965 is mounted. A majority of the cutting teeth 965 are positioned outside a boundary defined by an outer diameter of the plate stack 939.

Figure 54:
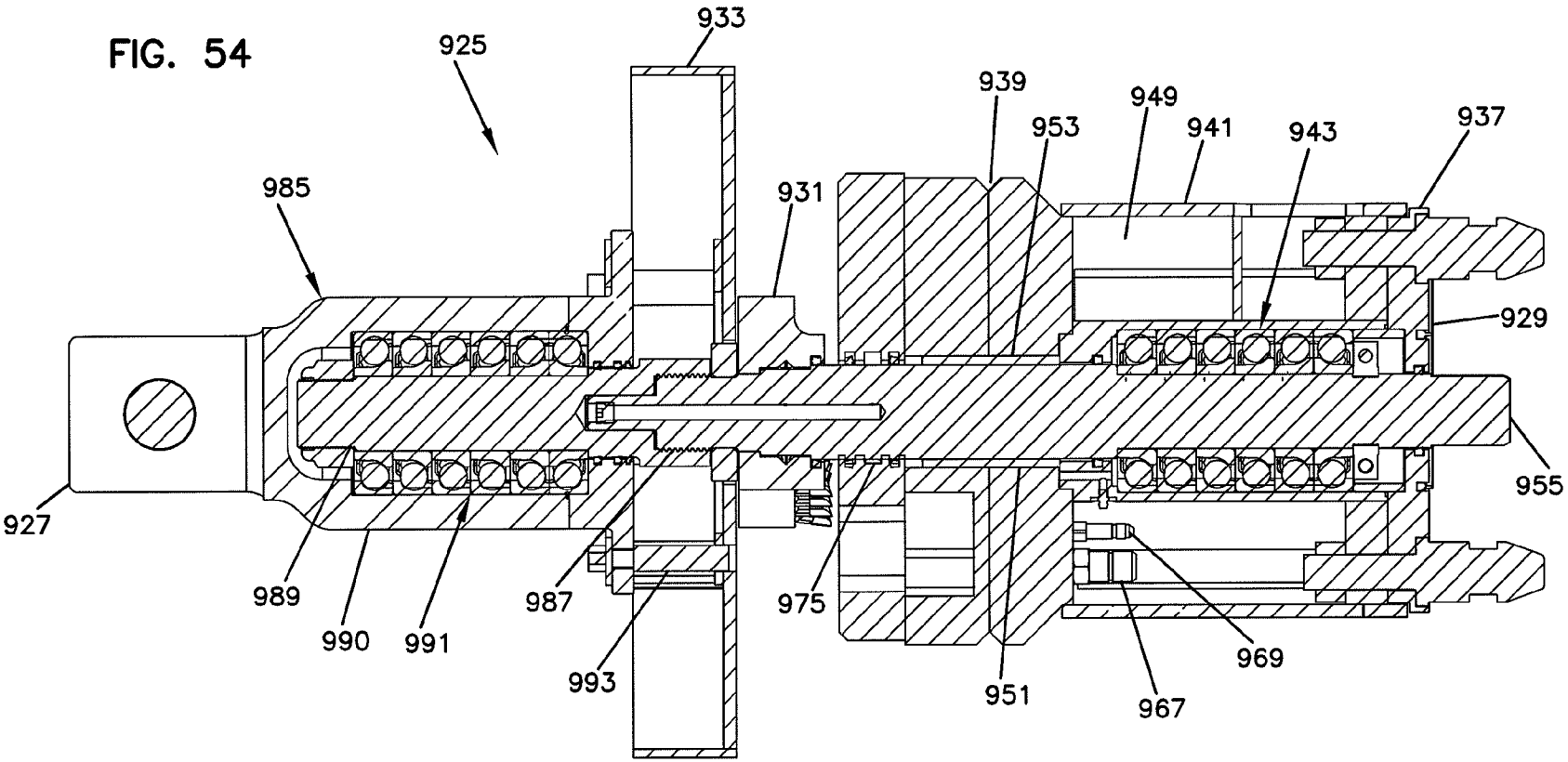
FIG. 54 is a cross-sectional view taken along section line 54-54 of FIG. 53.

As shown at FIGS. 52 and 54, a drilling fluid fitting 967 and a blind hydraulics fitting 969 are mounted at a proximal face of the plate stack 939. The blind hydraulics fitting 969 provides a location to store and manage the end of a hydraulics line when the backreamer 925 is attached to the distal end of the drill string 24. The hydraulics line can be used to provide hydraulic pressure to the steering arrangement of the drill head 30 when the drill head 30 is mounted to the distal end of the drill string 24. However, the backreamer embodiment 925 of FIGS. 50-55 does not utilize hydraulic pressure for steering or other functions. Therefore, the end of the hydraulic line is merely stored at the blind hydraulics fitting 969 for management and protection of the line.

A drilling fluid line (e.g., a water line) can be coupled to the drilling fluid fitting 967 for providing drilling fluid to the cutter 931. In certain embodiments, the drilling fluid line and the hydraulic line can be routed along the drill string 24 through the open-sided passage section 130 and can be directed into the open region 949 within the outer shell 941 through an open-sided slot 971 defined by the proximal end plate 937. When the backreamer 925 is coupled to the distal end of the drill string 24, the open-sided slot 971 coaxially aligns with the open-sided passage section 130. Once inside the outer shell 941, the hydraulics line and the drilling fluid line can be directed through the open region 949 to the fittings 967, 969. A side axis window 973 (see FIG. 50) through the outer shell 941 allows an operator to manually access the fittings 967, 969.

The drilling fluid fitting 967 is in fluid communication with a drilling fluid flow path that extends through the plate stack 939 to a water swivel 975 (see FIGS. 52 and 54). The water swivel 975 provides fluid communication between the drilling fluid path defined by the plate stack 939 and a plurality of drilling fluid passages defined through the radial bars 961 of the backreamer 925. The drilling fluid passages convey drilling fluid to a plurality of discharge ports 979 defined by the radial bars 961. Discharge ports 979 can be provided at the distal and proximal sides of the radial bars 961 as well as at the sides of the radial bars 961 that extend between the proximal and distal sides of the radial bars 961.

Figure 50:
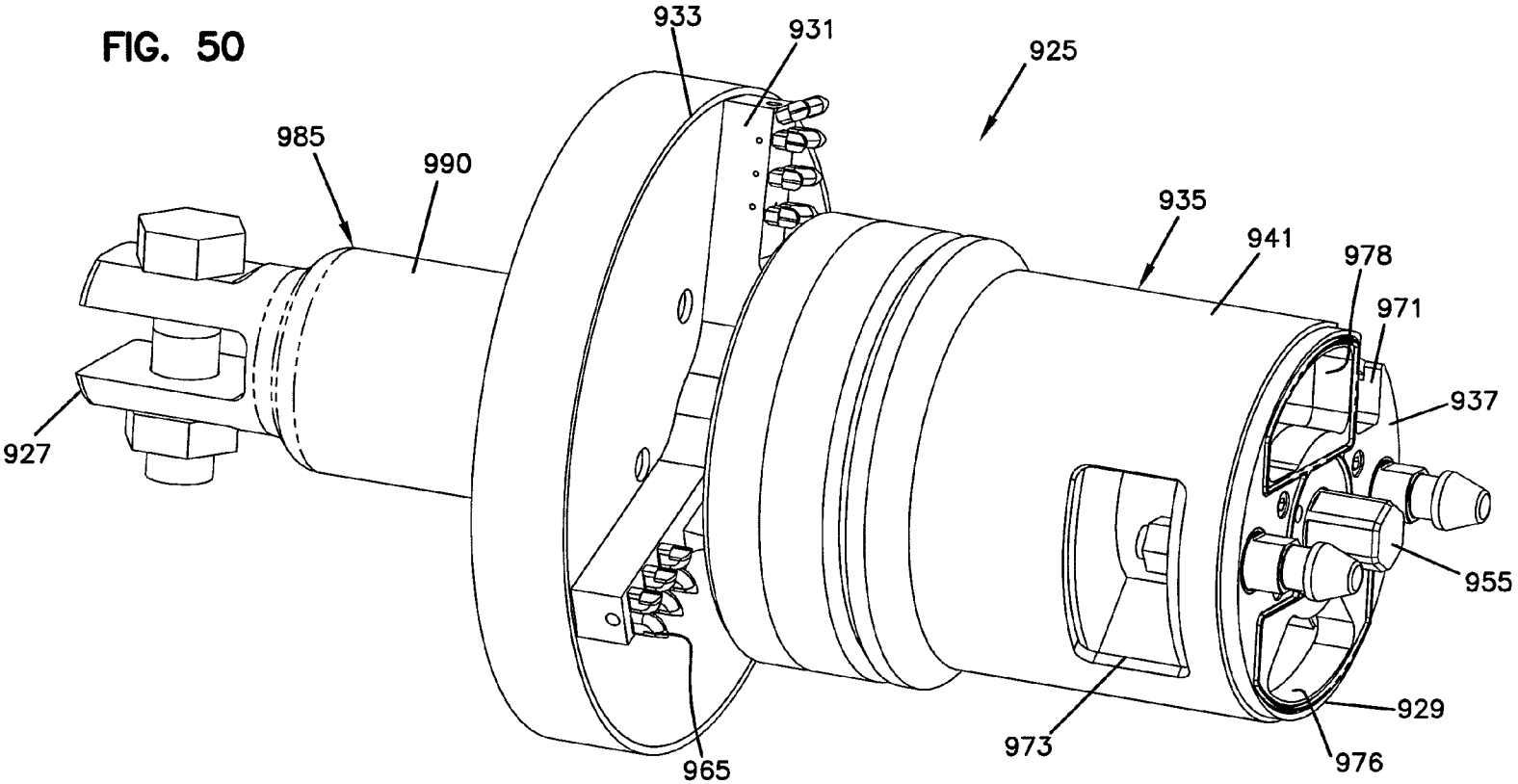
FIG. 50 is a perspective view showing a proximal end of a back reamer that can be mounted at the distal end of a drill string in accordance with the principles of the present disclosure.
Figure 51:
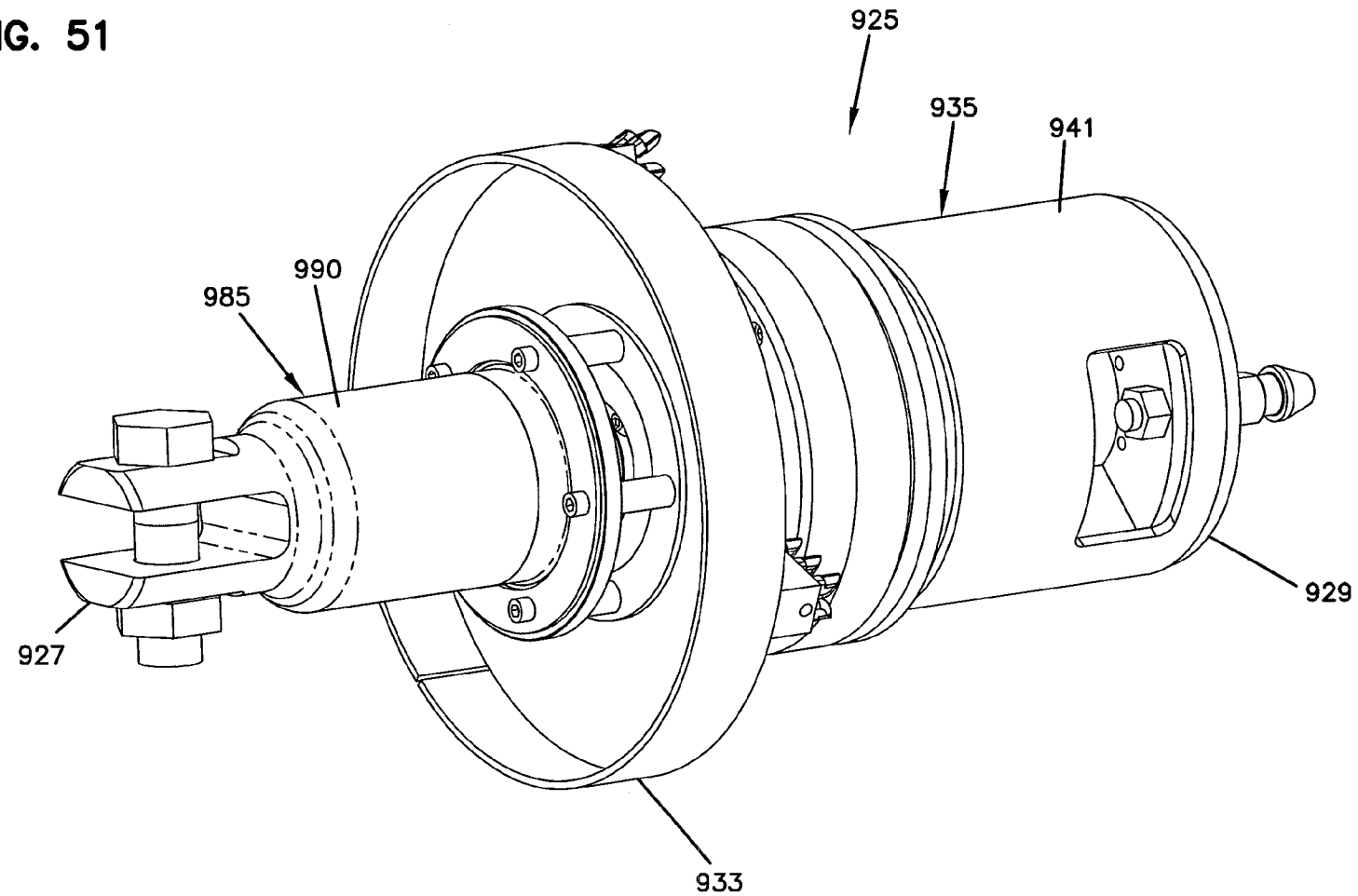
FIG. 51 is a perspective view showing a distal end of the back reamer of FIG. 50.
Figure 55:
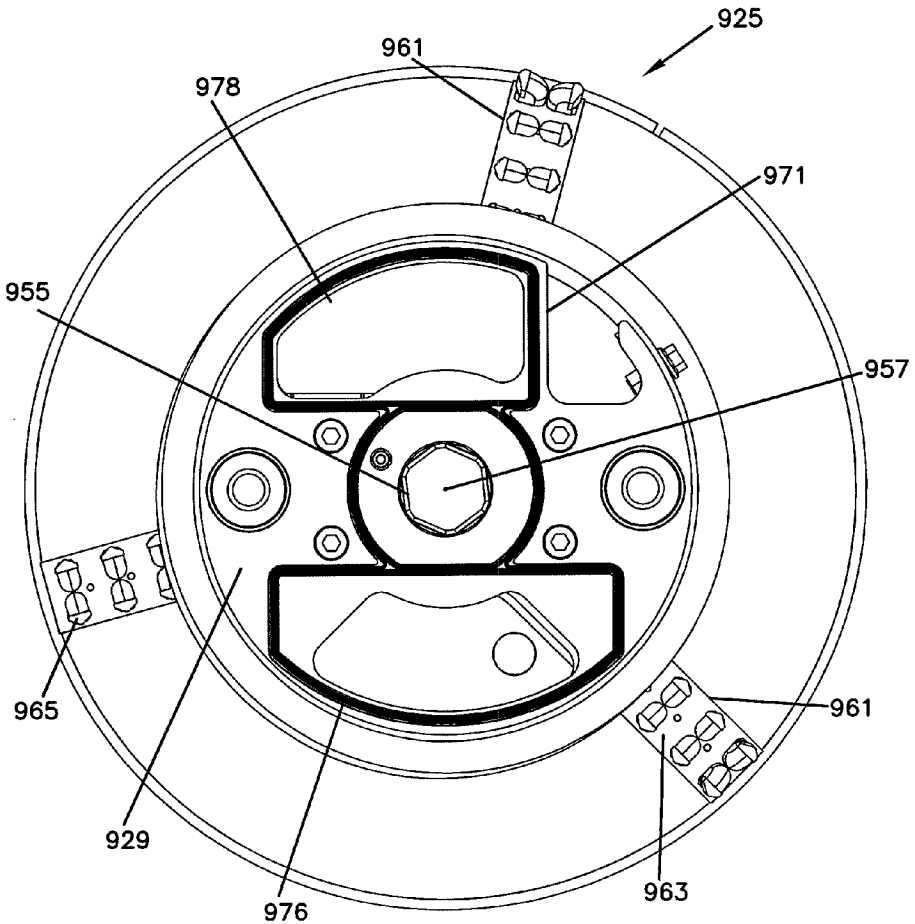
FIG. 55 is a proximal end view of the back reamer of FIG. 50.

The proximal assembly 935 of the backreamer 925 also defines a vacuum passage extension 976 and an air passage extension 978 (see FIGS. 50 and 55). The vacuum passage extension 976 and the air passage extension 978 extend through the proximal assembly 935 from the proximal end 929 of the backreamer 925 to the proximal side of the cutter 931. When the backreamer 925 is coupled to the distal end of the pipe string 24, the vacuum passage extension 976 aligns with the first internal passage section 170 of the distal most pipe section 22 and the air passage extension 978 aligns with the second internal passage section 172 of the distal most pipe section 22. In this way, the vacuum passage extension 976 forms the last leg of the vacuum passage 47 and the air passage extension 978 forms the last leg of the air passage 43. In use of the backreamer 925, spoils generated by the cutter 931 can be evacuated from the bore through the vacuum passage extension 976 with the assistance of air provided from the air passage extension 978 and also with the assistance of fluid provided from the discharge ports 979 of the cutter 931.

Referring to FIG. 52, the backreamer 925 further includes a distal assembly 985 coupled to a distal end 987 of the drive stem 951. The distal assembly 985 includes a center shaft 989 coupled to the distal end 987 of the drive stem 951 by a threaded connection. A distal housing 990 is mounted over the center shaft 989. An axial bearing pack 991 is mounted between the center shaft 989 and the distal housing 990 such that the distal housing 990 is free to rotate relative to the center shaft 989. The distal housing 990 is configured to be coupled to the product desired to be pulled through the bore behind the backreamer 925 (e.g., via fastener 999). Because the distal housing 990 is free to rotate relative to the center shaft 989, the product connected to the distal housing 990 does not rotate during the backreaming process. Instead, the cutter 931, the center shaft 989 and the drive stem 951 all rotate relative to the distal housing 990 and the product attached thereto during backreaming.

As indicated above, the vacuum blocking plate 933 is mounted adjacent the distal side of the cutter 931. As shown at FIG. 52, the vacuum blocking plate 933 is connected to the distal housing 990 by fasteners such as pins 993. Thus, the vacuum blocking plate 933 is rotationally fixed relative to the distal housing 990 such that the cutter 931 rotates relative to the vacuum blocking plate 933 during backreaming operations. The vacuum blocking plate 933 has an outer diameter that corresponds generally to the outer diameter of the bore being backreamed. The vacuum blocking plate 933 functions to block the backreamed bore at a location immediately distal to the cutter 931. In this way, the vacuum blocking plate 933 prevents spoils from entering the product being pulled behind the backreamer 925 and also prevents excessive amounts of air from being drawn from the inside of the product into the vacuum passage extension 981. By enclosing the backreamed bore at a location immediately distal to the cutter 931, the ability to effectively evacuate spoils through the vacuum passage extension 981 is enhanced. A distal side of the cutter 931 is configured to scrape a proximal face of the vacuum blocking plate 933 to prevent material from collecting thereon.

From the foregoing detailed description, it will be evident that modifications and variations can be made in the devices of the disclosure without departing from the spirit or scope of the invention.

What is claimed is:

1. A method for tunneling comprising:

forming a bore in the ground with a tunneling apparatus including a drilling apparatus and a cutting unit attached to a distal end of a string of pipe sections, the string of pipe sections defining a vacuum passage;

removing cuttings from the bore through the vacuum passage;

monitoring an operating characteristic related to vacuum operation that can provide an indication of a precursor blockage condition within the vacuum passage; and implementing a blockage prevention action for preventing full blockage of the vacuum passage when the operating characteristic indicates that the precursor blockage condition exists, wherein the blockage prevention action includes increasing a rotational cutting speed of the cutting unit.

2. The method of claim 1, wherein the operating characteristic is automatically monitored by an electronic controller, and wherein the blockage prevention action is automatically implemented by the electronic controller.

3. The method of claim 1, wherein the blockage prevention action includes reducing thrust applied to the string of pipe sections.

4. The method of claim 1, wherein the blockage prevention action includes increasing drilling fluid provided to the cutting unit.

5. The method of claim 1, wherein vacuum pressure within the vacuum channel is sensed and used as the operating characteristic.

6. The method of claim 5, wherein the vacuum pressure within the vacuum channel is sensed at a location outside of the bore between the string of pipe sections and a vacuum intake.

7. The method of claim 6, wherein the vacuum pressure within the vacuum channel is also sensed at a location inside the bore.

8. The method of claim 1, wherein air flow within the pipe sections is sensed and used as the operating characteristic.

9. A method for tunneling comprising:

forming a bore in the ground with a tunneling apparatus including a backreaming apparatus, and a cutting unit attached to a distal end of a string of pipe sections, the string of pipe sections defining a vacuum passage;

removing cuttings from the bore through the vacuum passage;

monitoring an operating characteristic related to vacuum operation that can provide an indication of a precursor blockage condition within the vacuum passage; and implementing a blockage prevention action for preventing full blockage of the vacuum passage when the operating characteristic indicates that the precursor blockage condition exists, wherein the blockage prevention action includes increasing a rotational cutting speed of the cutting unit.

10. The method of claim 9, wherein the blockage prevention action includes reducing pull-back applied to the string of pipe sections.

11. The method of claim 9, wherein the blockage prevention action includes increasing drilling fluid provided to the cutting unit.

* * * * *